US010369581B2

(12) United States Patent
Uchiyama

(10) Patent No.: US 10,369,581 B2
(45) Date of Patent: Aug. 6, 2019

(54) LIQUID-DISCHARGING CONTAINER

(71) Applicant: Kao Corporation, Tokyo (JP)

(72) Inventor: Takumi Uchiyama, Tokyo (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 16/064,319

(22) PCT Filed: Dec. 22, 2016

(86) PCT No.: PCT/JP2016/088409
§ 371 (c)(1),
(2) Date: Jun. 20, 2018

(87) PCT Pub. No.: WO2017/111037
PCT Pub. Date: Jun. 29, 2017

(65) Prior Publication Data

US 2019/0001357 A1 Jan. 3, 2019

(30) Foreign Application Priority Data

Dec. 24, 2015 (JP) ..... 2015-252663

(51) Int. Cl.
*B05B 11/00* (2006.01)
*B05B 7/00* (2006.01)

(52) U.S. Cl.
CPC ..... *B05B 11/0037* (2013.01); *B05B 11/3056* (2013.01); *B05B 7/0037* (2013.01); *B05B 11/3047* (2013.01)

(58) Field of Classification Search
CPC ..... B05B 11/0037; B05B 11/00
(Continued)

(56) References Cited

U.S. PATENT DOCUMENTS 3,897,006 A * 7/1975 Tada ..... B05B 11/3009 222/321.8
4,061,250 A 12/1977 Tada
(Continued)

FOREIGN PATENT DOCUMENTS

CN 101410310 A 4/2009
CN 103517766 A 1/2014
(Continued)

OTHER PUBLICATIONS

International Search Report dated Mar. 28, 2017 in PCT/JP2016/088409 filed Dec. 22, 2016.
(Continued)

*Primary Examiner* — Lien M Ngo
(74) *Attorney, Agent, or Firm* — Oblon, McClelland, Maier & Neustadt, L.L.P.

(57) ABSTRACT

A liquid-agent dispensing container (100) includes: a mounting portion (52) that is mounted on a container body (10); a swing portion (160) that is pivotally supported in a swingable manner with respect to the mounting portion (52) and has a force application portion (161) that receives a pressing force; an operating portion (20) that has a pressing portion that presses the force application portion (161) when pressed; an acting portion that transfers a pressing force from the swing portion (160) to a head portion (30) when the force application portion (161) is pressed; and a guide mechanism that guides a relative movement of the operating portion (20) with respect to the head portion (30) while maintaining a posture of the operating portion (20) when the operating portion (20) is pressed. At least a part of the head portion (30) is covered with the operating portion (20) when the liquid-agent dispensing container (100) is viewed in a direction in which the head portion (30) is pressed with respect to the mounting portion (52).

20 Claims, 35 Drawing Sheets

(58) Field of Classification Search
USPC ..... 222/321.1, 402.13, 383.1
See application file for complete search history.

(56) References Cited

U.S. PATENT DOCUMENTS

| | | | | |
|---|---|---|---|---|
| 5,624,055 | A * | 4/1997 | Clanet | B65D 83/206 222/135 |
| 9,737,903 | B2 * | 8/2017 | Notarianni | B05B 11/3014 |
| 9,955,765 | B2 * | 5/2018 | Schmitz | B05B 11/3014 |
| 10,046,349 | B2 * | 8/2018 | Tada | F04B 9/14 |
| 2005/0284888 | A1 * | 12/2005 | Rhodenbaugh | G01F 11/028 222/181.3 |
| 2006/0006198 | A1 * | 1/2006 | Lasserre | B05B 11/3014 222/383.1 |
| 2009/0071985 | A1 | 3/2009 | Ki | |
| 2009/0188947 | A1 * | 7/2009 | Dodd | B05B 1/3026 222/321.8 |
| 2011/0155764 | A1 * | 6/2011 | Lee | B05B 11/3057 222/153.13 |
| 2011/0284578 | A1 * | 11/2011 | Wong | A47G 19/183 222/40 |
| 2011/0284592 | A1 * | 11/2011 | Alluigi | B05B 11/3025 222/321.8 |
| 2014/0001209 | A1 | 1/2014 | Le Maner | |
| 2014/0061252 | A1 * | 3/2014 | Sweeton | B05B 11/0037 222/321.8 |
| 2016/0193617 | A1 * | 7/2016 | Tada | B05B 11/0067 222/324 |

FOREIGN PATENT DOCUMENTS

| | | | |
|---|---|---|---|
| JP | 52-3711 | | 1/1977 |
| JP | 63-25170 | U | 2/1988 |
| JP | 5-7359 | U | 2/1993 |
| JP | 5-51469 | U | 7/1993 |
| JP | 2013-249087 | A | 12/2013 |
| WO | WO 2011/142035 | A1 | 11/2011 |

OTHER PUBLICATIONS

Decision to Grant a Patent dated Jul. 4, 2017 in JP Patent Application No. 2016-248584 (with English translation).
Office Action dated Jan. 30, 2019 issued in corresponding Chinese patent application No. 201680072164.2 (with English translation).

* cited by examiner

LIQUID-DISCHARGING CONTAINER

TECHNICAL FIELD

The present invention relates to a liquid-agent dispensing container, a liquid-agent dispensing cap, an attachment for a liquid-agent dispenser, and a liquid-agent dispensing container product.

BACKGROUND ART

Patent Documents 1 and 2 each describe a liquid-agent dispensing container having a structure that employs the principle of leverage. These liquid-agent dispensing containers have a structure in which an operating portion that receives the push-down operation is pivotally supported at the pivotally supporting portion, and by pushing down the operating portion, the head portion is caused to be pushed down using the principle of leverage.

RELATED ART DOCUMENT

Patent Document 1: Japanese Utility Model Application Laid-open No. H5-7359

Patent Document 2: Japanese Utility Model Application Laid-open No. H5-51469

SUMMARY OF THE INVENTION

The present invention provides a liquid-agent dispensing container that includes a container body that stores a liquid agent, including:

a mounting portion that is mounted on the container body;

a head portion that is held by the mounting portion movably with respect to the mounting portion in one direction and a direction opposite to the one direction, and allows the liquid agent to pass through the head portion with the head portion being pressed in the one direction relatively to the mounting portion;

a dispensing outlet that discharges the liquid agent that has passed through the head portion;

a swing portion that is pivotally supported at a pivotally supporting portion in a swingable manner relatively to the mounting portion in a direction having a component of the one direction and a direction opposite to this direction, and has a force application portion that receives a pressing force;

an operating portion that is pressed relatively to the mounting portion with an operation made by a user, and has a pressing portion that presses the force application portion when the operating portion is pressed;

an acting portion that is located between the force application portion and the pivotally supporting portion, and transfers a pressing force from the swing portion to the head portion when the swing portion swings in the direction having the component of the one direction with the force application portion being pressed; and a guide mechanism that guides a relative movement of the operating portion with respect to the head portion while maintaining a posture of the operating portion when the operating portion is pressed, in which at least a part of the head portion is covered with the operating portion when the liquid-agent dispensing container is viewed in the one direction.

Furthermore, the present invention provides a liquid-agent dispensing container, including:

a container body that stores a liquid agent;

a mounting portion that is mounted on the container body;

a head portion that is held by the mounting portion so as to be able to move in a top-bottom direction with respect to the mounting portion, and allows the liquid agent to pass through the head portion with the head portion being pushed down relatively to the mounting portion;

a dispensing outlet that discharges the liquid agent that has passed through the head portion;

a swing portion that is pivotally supported at a pivotally supporting portion in a manner swingable in a direction having a downward component relatively to the mounting portion and a direction opposite to this direction, and has a force application portion that receives a pushing-down force;

an operating portion that is pushed down relatively to the mounting portion, and has a pushing-down portion that pushes down the force application portion when the operating portion is pushed down;

an acting portion that is located between the force application portion and the pivotally supporting portion, and transfers a pushing-down force from the swing portion to the head portion when the swing portion swings in the direction having the downward component with the force application portion being pushed down; and a guide mechanism that guides a relative movement of the operating portion with respect to the head portion while maintaining a posture of the operating portion when the operating portion is pushed down, in which the guide mechanism includes a guiding portion that the head portion has, and a guided portion that the operating portion has, the guided portion being guided by the guiding portion.

Furthermore, the present invention provides a liquid-agent dispensing cap including a mounting portion that is mounted on a container body that stores a liquid agent, the liquid-agent dispensing cap including:

a head portion that is held by the mounting portion movably with respect to the mounting portion in one direction and a direction opposite to the one direction, and allows the liquid agent to pass through the head portion with the head portion being pressed in the one direction relatively to the mounting portion;

a dispensing outlet that discharges the liquid agent that has passed through the head portion;

a swing portion that is pivotally supported at a pivotally supporting portion in a swingable manner relatively to the mounting portion in a direction having a component of the one direction and a direction opposite to this direction, and has a force application portion that receives a pressing force;

an operating portion that is pressed relatively to the mounting portion with an operation made by a user, and has a pressing portion that presses the force application portion when the operating portion is pressed;

an acting portion that is located between the force application portion and the pivotally supporting portion, and transfers a pressing force from the swing portion to the head portion when the swing portion swings in the direction having the component of the one direction with the force application portion being pressed; and a guide mechanism that guides a relative movement of the operating portion with respect to the head portion while maintaining a posture of the operating portion when the operating portion is pressed, in which at least a part of the head portion is covered with the operating portion when the liquid-agent dispensing cap is viewed in the one direction.

Furthermore, the present invention provides an attachment for a liquid-agent dispenser used by being mounted on a liquid-agent dispensing cap including: a mounting portion that is mounted on a container body that stores a liquid agent; a head portion that is held by the mounting portion movably with respect to the mounting portion in one direction and a direction opposite to the one direction, and allows the liquid agent to pass through the head portion with the head portion being pressed in the one direction relatively to the mounting portion; and a dispensing outlet that discharges the liquid agent that has passed through the head portion, the attachment for a liquid-agent dispenser including:

a second mounting portion that is mounted on the mounting portion;

a swing portion that is pivotally supported at a pivotally supporting portion in a swingable manner relatively to the second mounting portion in a direction having a component of the one direction and a direction opposite to this direction, and has a force application portion that receives a pressing force;

an operating portion that is pressed relatively to the second mounting portion with an operation made by a user, and has a pressing portion that presses the force application portion when the operating portion is pressed;

a head cover portion that is mounted on the head portion in a state where a movement thereof to the one direction relatively to the head portion is restricted;

an acting portion that is located between the force application portion and the pivotally supporting portion, and transfers a pressing force from the swing portion to the head cover portion when the swing portion swings in the direction having the component of the one direction with the force application portion being pressed; and a guide mechanism that guides a relative movement of the operating portion with respect to the head cover portion while maintaining a posture of the operating portion when the operating portion is pressed, in which at least a part of the head portion is covered with the operating portion when the attachment for a liquid-agent dispenser is viewed in the one direction.

Furthermore, the present invention provides a liquid-agent dispensing container product, which includes the liquid-agent dispensing container according to the present invention, and the liquid agent filled in the container body.

BRIEF DESCRIPTION OF THE DRAWINGS

FIG. 7(*a*) is a side view of the second mounting portion, and FIG. 7(*b*) is a plan view thereof.

FIG. 8(*a*) is a side view of the head portion, and FIG. 8(*b*) is a bottom view thereof.

FIG. 9(*a*) is a side view of the operating portion, and FIG. 9(*b*) is a bottom view thereof.

FIG. 16(*a*) is a perspective view illustrating a state where the head cover portion is detached from the head portion, and FIG. 16(*b*) is a perspective view illustrating a state where the head cover portion is mounted on the head portion.

FIG. 26(*a*) is a side view of the liquid-agent dispensing cap, and FIG. 26(*b*) is a sectional view thereof as viewed from the side.

FIG. 27(*a*) is a side view of the liquid-agent dispensing cap, and FIG. 27(*b*) is a sectional view thereof as viewed from the side.

FIG. 28(*a*) is a side view of the liquid-agent dispensing cap, and FIG. 28(*b*) is a sectional view thereof as viewed from the side.

DETAILED DESCRIPTION OF THE INVENTION

Figure 1:
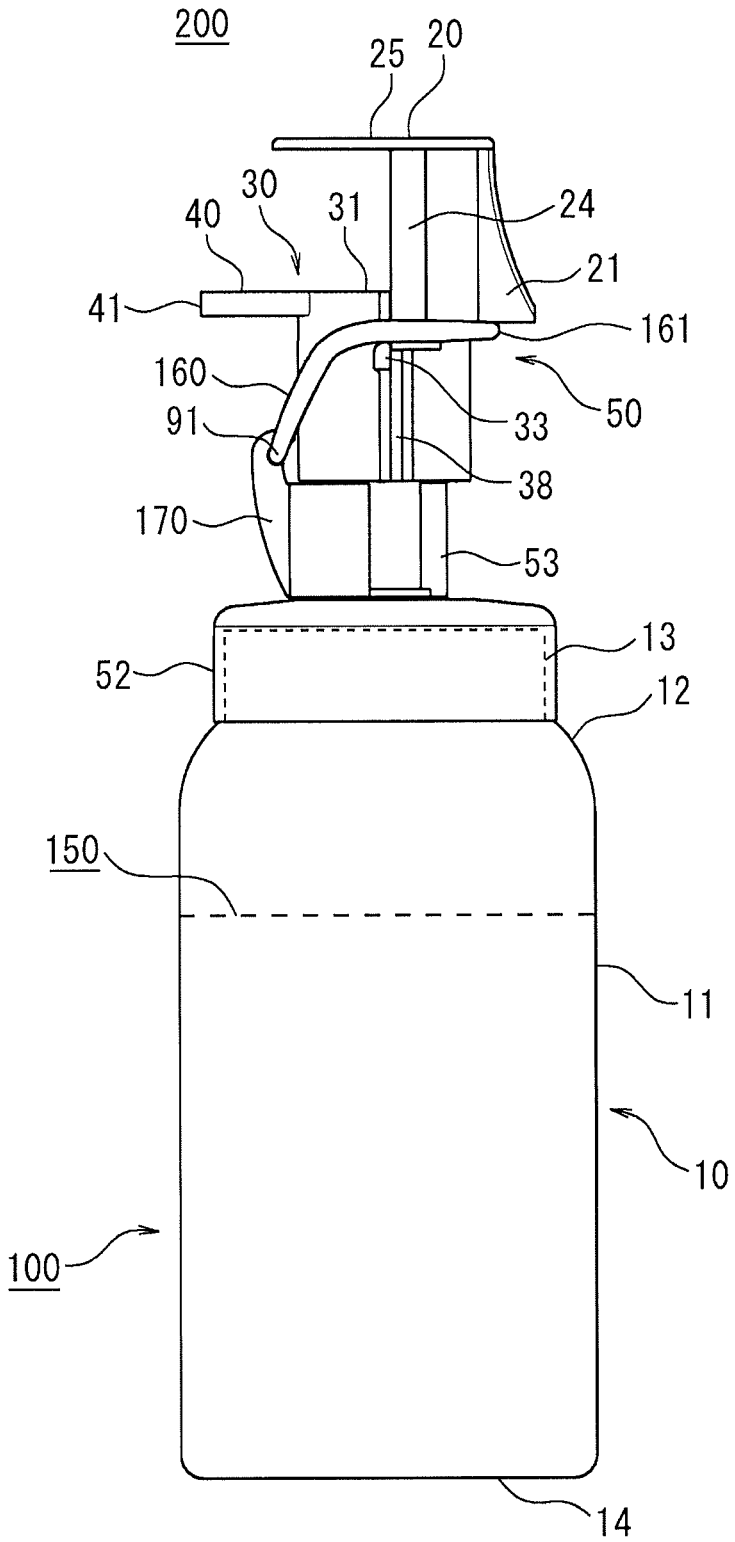
FIG. 1 is a side view illustrating a liquid-agent dispensing container product according to a first exemplary embodiment.

In the case of the techniques described in Patent Documents 1 and 2, when the operating portion is pushed down, the operating portion swings with the pivotally supporting portion being the fulcrum. This leads to an operational feeling of the operating portion largely different from that of general liquid-agent dispensing containers of the type in which the head portion is directly pushed down, which results in unfavorable operability.

The present invention has been made in view of the problem described above, and relates to a liquid-agent dispensing container, a liquid-agent dispensing cap, an attachment for a liquid-agent dispenser, and a liquid-agent dispensing container product, which employ the principle of leverage to press (typically, push down) the head portion, and have a structure that can achieve operational feeling close to a liquid-agent dispensing container of the type in which the head portion is directly pushed down.

Hereinbelow, embodiments according to the present invention will be described with reference to the drawings. Note that, in all the drawings, the same reference characters are attached to similar constituent components, and detailed explanation thereof will not be repeated.

First Exemplary Embodiment

First, a first exemplary embodiment will be described with reference to FIGS. 1 to 10.

A liquid-agent dispensing container 100 according to this exemplary embodiment including a container body 10 that stores a liquid agent 150 includes: a mounting portion 52 that is mounted on a container body 10; a head portion 30 that is held by the mounting portion 52 movably with respect to the mounting portion 52 in one direction and a direction opposite to the one direction, and allows the liquid agent 150 to pass through the head portion 30 with the head portion 30 being pressed in the one direction with respect to the mounting portion 52; and a dispensing outlet 41 that discharges the liquid agent 150 that has passed through the head portion 30.

Here, the "one direction" represents a direction in which the head portion 30 is pressed with respect to the mounting portion 52.

Furthermore, the liquid-agent dispensing container 100 includes a swing portion 160 that is pivotally supported at a pivotally supporting portion 91 in a swingable manner relatively to the mounting portion 52 in a direction having a component of the one direction described above and a direction opposite to this direction, and has a force application portion 161 that receives a pressing force. Here, as one preferable example, the axis of the pivotally supporting portion 91 extends in a direction perpendicular to the one direction described above. However, it may be possible that the direction of the axis of the pivotally supporting portion 91 extends in a direction that intersects the direction perpendicular to the one direction described above, provided that the direction of swinging of the swing portion 160 with respect to the mounting portion 52 is the direction having the component of the one direction described above and the direction opposite to this direction. In the case of this exemplary embodiment, the direction of the axis of the pivotally supporting portion 91 is the direction perpendicular to the one direction described above.

Furthermore, the liquid-agent dispensing container 100 includes an operating portion 20 that is pressed relatively to the mounting portion 52 with an operation made by a user. The operating portion 20 has a pressing portion (for example, a pushing-down portion 21) that presses the force application portion 161 when the operating portion 20 is pressed.

Figure 3:
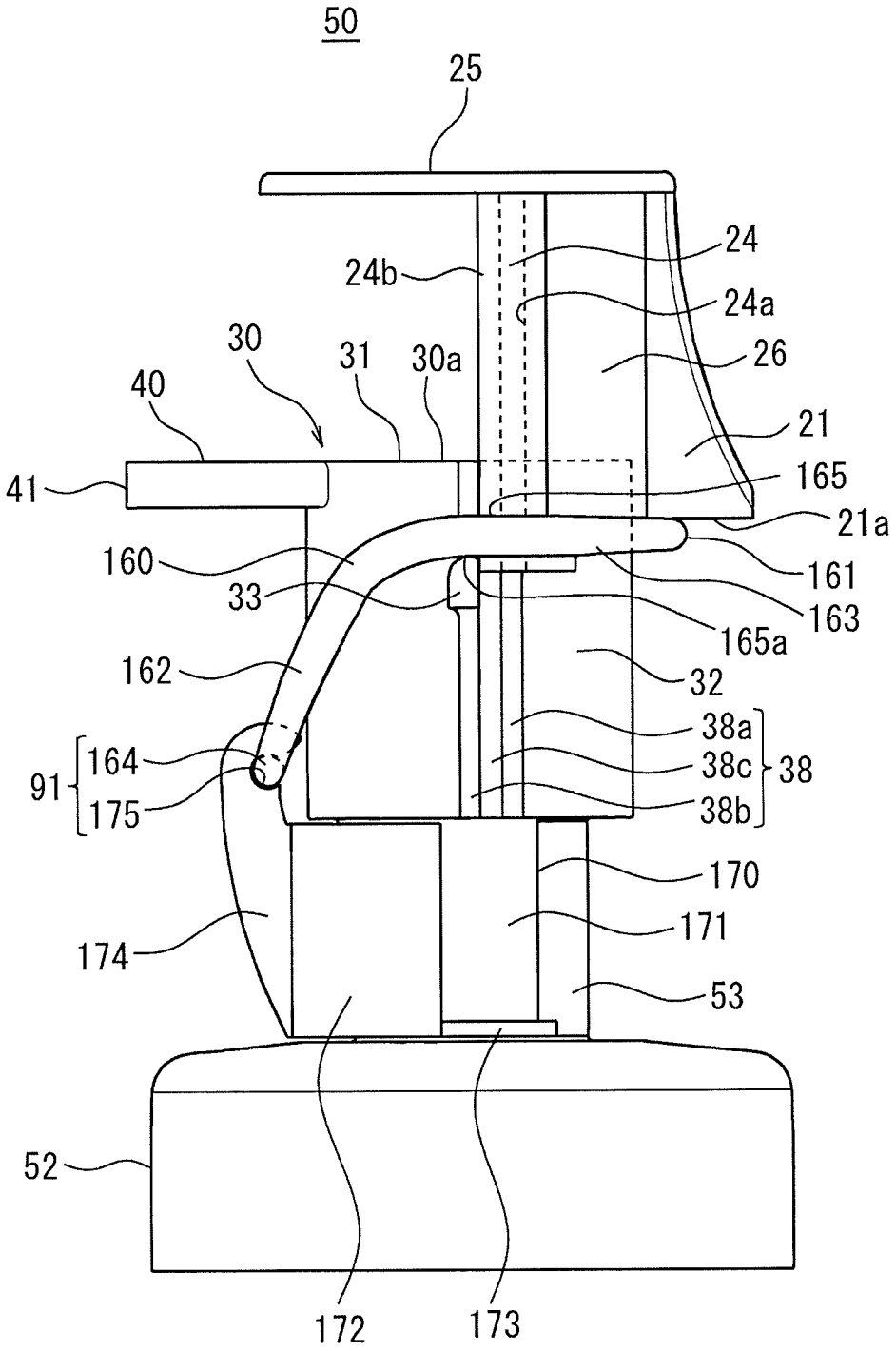
FIG. 3 is a side view illustrating an upper portion of the liquid-agent dispensing cap according to the first exemplary embodiment.

Furthermore, the liquid-agent dispensing container 100 includes an acting portion (for example, comprised of an acting surface 165*a* and a projection portion 33 illustrated in FIG. 3) that is located between the force application portion 161 and the pivotally supporting portion 91, and transfers a pressing force from the swing portion 160 to the head portion 30 when the swing portion 160 swings in the direction having the component of the one direction described above with the force application portion 161 being pressed.

Furthermore, the liquid-agent dispensing container 100 includes a guide mechanism (for example, comprised of a guiding portion 38 and a guided portion 24) that guides a relative movement of the operating portion 20 with respect to the head portion 30 while maintaining a posture of the operating portion 20 when the operating portion 20 is pressed. Here, the "maintaining a posture of the operating portion 20" means that changes in posture of the operating portion 20 are less than changes in posture of the swing portion 160, and preferably, means that the posture of the operating portion 20 is maintained constant.

In addition, the liquid-agent dispensing container 100 is configured such that at least a part of the head portion 30 is covered with the operating portion 20 when the liquid-agent dispensing container 100 is viewed in the one direction described above.

When the operating portion 20 is pressed, the force application portion 161 of the swing portion 160 is pressed by the pressing portion (pushing-down portion 21) of the operating portion 20, and hence, the swing portion 160 swings in a direction having a component of the one direction described above with the pivotally supporting portion 91 being the fulcrum. At this time, the acting portion transfers a pressing force from the swing portion 160 to the head portion 30 to press the head portion 30.

Here, the acting portion is located between the force application portion 161 and the pivotally supporting portion 91, and hence, due to the principle of leverage, the force of the pressing portion pushing the force application portion 161 is less than the force of the swing portion 160 pushing the head portion 30.

In addition, when the operating portion 20 is pressed, the posture of the operating portion 20 is maintained by the guide mechanism.

Thus, it is possible to use the principle of leverage to press the head portion 30, and to achieve the operational feeling close to a liquid-agent dispensing container of the type in which the head portion 30 is directly pushed down.

Since the operating portion 20, which is an element separate from the swing portion 160 having the force application portion 161, receives the pressing operation, the operating portion 20 does not have to swing, so that it is possible to move the operating portion 20 in a movement path different from that of the swing portion 160. Thus, it is possible to easily achieve the configuration in which the operating portion 20 makes a relative movement with respect to the head portion 30 while maintaining the posture of the operating portion 20, and it is possible to easily achieve the operational feeling close to a liquid-agent dispensing container of the type in which the head portion 30 is directly pushed down.

On the other hand, with the techniques of Patent Documents 1 and 2, the operating portion itself serves as the force application portion and swings, and hence, it is not possible to achieve the operational feeling close to the type in which the head portion 30 is directly pushed down.

When the liquid-agent dispensing container 100 is viewed in the one direction described above, it is preferable that at least a part of the acting portion is covered with the operating portion 20, and it is more preferable that the entire acting portion is covered with the operating portion 20.

When the liquid-agent dispensing container 100 is viewed in the one direction described above, it is preferable that at least a part of the force application portion 161 is covered with the operating portion 20, and it is more preferable that the entire force application portion 161 is covered with the operating portion 20.

In the case of this exemplary embodiment, the entire force application portion 161 is covered with the operating portion 20 when the liquid-agent dispensing container 100 is viewed in the one direction described above.

In the case of this exemplary embodiment, the operating portion 20 includes an operation receiving portion 25 that is formed into a plate-like shape perpendicular to the one direction and receives the pressing operation, and at least a part of the head portion 30 is covered with the operation receiving portion 25 when the liquid-agent dispensing container 100 is viewed in the one direction described above.

In the case of this exemplary embodiment, the head portion 30 includes a tubular portion (external tubular portion 32) having the shaft center extending in the one direction described above, and the operating portion 20 is disposed on the extension of the shaft center of the tubular portion. More specifically, the operation receiving portion 25 is disposed on the extension of the shaft center of the external tubular portion 32.

Furthermore, in the case of this exemplary embodiment, the entire tubular portion (external tubular portion 32) is covered with the operating portion 20 (for example, the operation receiving portion 25) when the liquid-agent dispensing container 100 is viewed in the one direction described above.

In addition, in the case of this exemplary embodiment, at least a part of the guide mechanism is covered with the operating portion 20 (for example, the operation receiving portion 25) when the liquid-agent dispensing container 100 is viewed in the one direction described above. More specifically, the entire guide mechanism is covered with the operating portion 20 (for example, the operation receiving portion 25) when the liquid-agent dispensing container 100 is viewed in the one direction described above.

Moreover, preferably, the center of gravity of the outside shape of the operating portion 20 overlaps with the head portion 30 when the liquid-agent dispensing container 100 is viewed in the one direction described above.

Here, the present invention is preferably applied to a container having the operating portion 20 and the head portion 30, each of which is pressed in the downward direction. Thus, in the case of this exemplary embodiment, the one direction described above is the downward direction, whereas the direction opposite to the one direction described above is the upward direction. Thus, "when the liquid-agent dispensing container 100 is viewed in the one direction described above" is synonymous with "when the liquid-agent dispensing container 100 is viewed in plan view."

That is, the liquid-agent dispensing container 100 according to this exemplary embodiment includes: the container body 10 that stores the liquid agent 150; the mounting portion 52 that is mounted on the container body 10; the head portion 30 that is held by the mounting portion 52 so as to be able to move in a top-bottom direction with respect to the mounting portion 52, and allows the liquid agent 150 to pass through the head portion 30 with the head portion 30 being pushed down relatively to the mounting portion 52; and the dispensing outlet 41 that discharges the liquid agent 150 that has passed through the head portion 30.

In addition, the liquid-agent dispensing container 100 further includes the swing portion 160 that is pivotally supported at the pivotally supporting portion 91 in a manner swingable in a direction having a downward component relatively to the mounting portion 52 and a direction opposite to this direction, and has the force application portion 161 that receives a pushing-down force. Here, as one preferable example, the direction of the axis of the pivotally supporting portion 91 extends in the horizontal direction. However, it may be possible that the direction of the axis of the pivotally supporting portion 91 extends in a direction intersecting the horizontal direction, provided that the direction of swinging of the swing portion 160 with respect to the mounting portion 52 is the direction having a downward component and the direction opposite to this direction.

In addition, the liquid-agent dispensing container 100 further includes the operating portion 20 that is pushed down relatively to the mounting portion 52. The operating portion 20 includes the pushing-down portion 21 that pushes down the force application portion 161 when the operating portion 20 is pushed down.

In addition, the liquid-agent dispensing container 100 further includes the acting portion (for example, comprised of the acting surface 165*a* and the projection portion 33 illustrated in FIG. 3) that is located between the force application portion 161 and the pivotally supporting portion 91, and transfers a pushing-down force from the swing portion 160 to the head portion 30 when the swing portion 160 swings in a direction having the downward component with the force application portion 161 being pushed down.

In addition, the liquid-agent dispensing container 100 further includes the guide mechanism (for example, comprised of the guiding portion 38 and the guided portion 24) that guides a relative movement of the operating portion 20 with respect to the head portion 30 while maintaining a posture of the operating portion 20 when the operating portion 20 is pushed down.

Here, the "maintaining a posture of the operating portion 20" means that changes in posture of the operating portion 20 are reduced so as to be less than changes in posture of the swing portion 160, and preferably, means that the top/bottom direction of the operating portion 20 is maintained constant.

Furthermore, at least a part of the head portion 30 is covered with the operating portion 20 in plan view.

The present invention is not limited to this example, and the one direction described above is not limited to the downward direction. For example, the one direction described above may be the horizontal direction or may be other directions.

In the case of this exemplary embodiment, when the operating portion 20 is pushed down, the force application portion 161 of the swing portion 160 is pushed down by the pushing-down portion 21 of the operating portion 20, and hence, the swing portion 160 swings in a direction having a downward component with the pivotally supporting portion 91 being the fulcrum. At this time, the acting portion transfers a pushing-down force from the swing portion 160 to the head portion 30, whereby the head portion 30 is pushed down.

Here, the acting portion is located between the force application portion 161 and the pivotally supporting portion 91, and hence, due to the principle of leverage, the force of the pushing-down portion 21 pushing the force application portion 161 is less than the force of the swing portion 160 pushing the head portion 30.

In addition, the posture of the operating portion 20 is maintained by the guide mechanism when the operating portion 20 is pushed down.

Thus, it is possible to use the principle of leverage to push down the head portion 30, and to achieve the operational feeling close to a liquid-agent dispensing container of the type in which the head portion 30 is directly pushed down.

Since the operating portion 20, which is an element separate from the swing portion 160 having the force application portion 161, receives the pushing-down operation, the operating portion 20 does not have to swing, so that it is possible to move the operating portion 20 in a movement path different from that of the swing portion 160. Thus, it is possible to easily achieve the configuration in which the operating portion 20 makes a relative movement with respect to the head portion 30 while maintaining the posture of the operating portion 20, and it is possible to easily achieve the operational feeling close to a liquid-agent dispensing container of the type in which the head portion 30 is directly pushed down.

On the other hand, with the techniques of Patent Documents 1 and 2, the operating portion itself serves as the force application portion and swings, and hence, it is not possible to achieve the operational feeling close to the type in which the head portion 30 is directly pushed down.

Furthermore, the liquid-agent dispensing container product 200 according to this exemplary embodiment is configured to include the liquid-agent dispensing container 100 according to this exemplary embodiment, and the liquid agent 150 filled in the container body 10.

Figure 10:
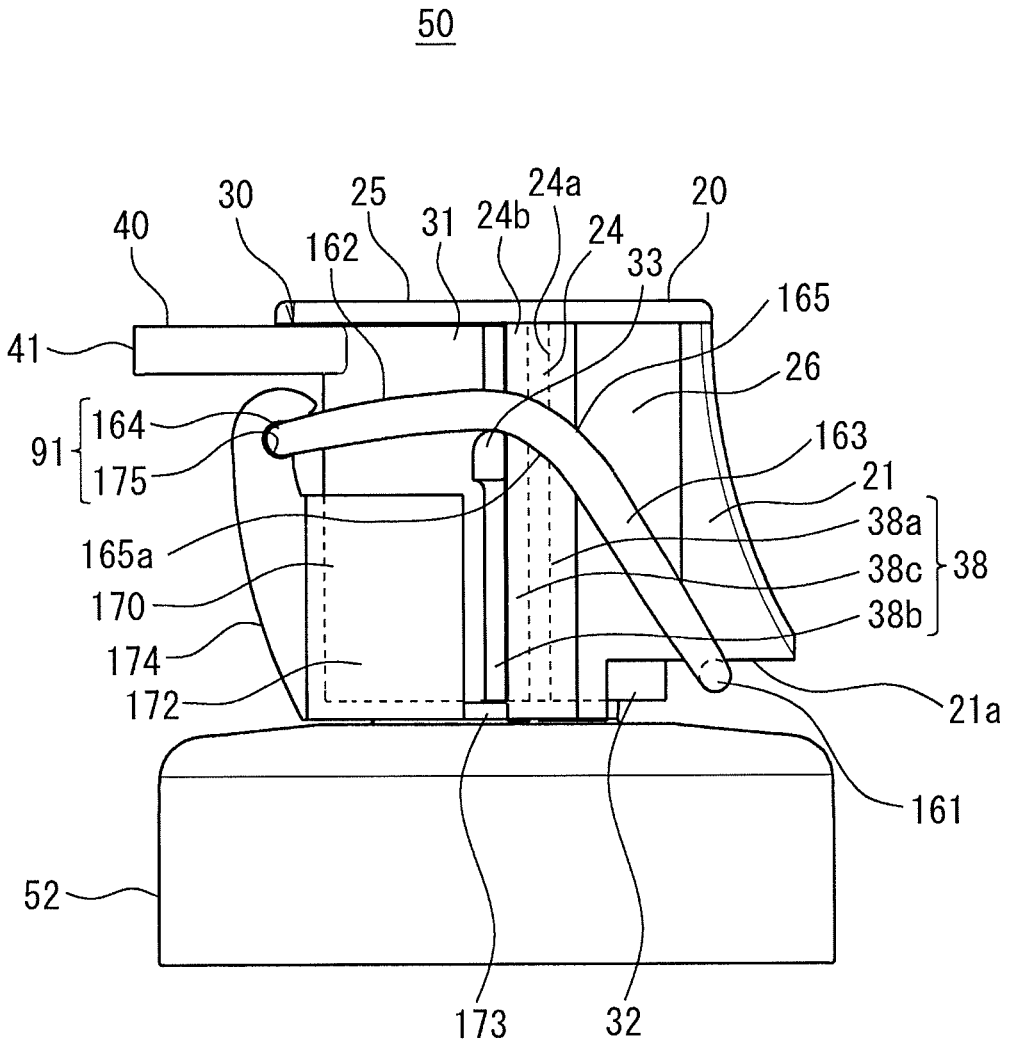
FIG. 10 is a side view illustrating the liquid-agent dispensing cap according to the first exemplary embodiment in a state where the operating portion is pushed down.

The states illustrated in the drawings from FIG. 1 to FIG. 5 each show a state (normal state) at the normal time where neither the operating portion 20 nor the head portion 30 is pushed down. In addition, the state illustrated in FIG. 10 shows a state (hereinafter, also simply referred to as a pushed-down state) where the operating portion 20 and the head portion 30 are pushed down to the lower limit position.

The left direction in FIGS. 1 to 3, FIG. 5, and FIGS. 7(*a*) to 10 is defined as the forward direction, and the right direction in FIGS. 1 to 3, FIG. 5, and FIGS. 7(*a*) to 10 is defined as the backward direction. The back side direction of the paper surface of FIGS. 1 to 3, FIG. 5, FIG. 7(*a*), FIG. 8(*a*), FIG. 9(*a*), and FIG. 10 is defined as the left, and the front side direction of the paper surface of FIGS. 1 to 3, FIG. 5, FIG. 7(*a*), FIG. 8(*a*), FIG. 9(*a*), and FIG. 10 is defined as the right.

In addition, the direction (hereinafter, referred to as the axial direction, the direction in which the shaft portion 164, which will be described later, extends) of the axis of the pivotally supporting portion 91 extends, for example, in the left-right direction.

This exemplary embodiment gives an example in which the liquid agent 150 is discharged in a foam shape. A typical example of such a liquid agent includes hand soap. However, the liquid agent is not limited to this. Various types of liquid agent used in a foam shape may be given as examples, which include facial cleanser, makeup remover, dishwashing liquid, hairstyle product, body soap, shaving cream, cosmetic agent for skin such as foundation and skin care agent, hair dye, and disinfectant.

However, the liquid agent 150 according to the present invention is not limited to those discharged in the foam shape, and includes those discharged as a liquid agent having fluidity as it is. Examples of such a liquid agent 150 include hand soap, facial cleanser, makeup remover, dishwashing liquid, hairstyle product, body soap, shaving gel, cosmetic agent for skin such as foundation and skin care agent, hair dye, and disinfectant.

In the container body 10, the liquid agent 150 is stored at atmospheric pressures or in a pressurized manner. The liquid-agent dispensing container 100 changes the liquid agent 150 into a foam shape by bringing the liquid agent 150 stored at atmospheric pressures into contact with air, or by releasing the liquid agent 150 stored in a pressurized manner, to atmospheric pressures at the time of discharging. In this specification, the liquid agent 150 in the foam shape is referred to as a foam body, and is distinguished from the liquid agent 150 in a non-foam shape stored in the container body 10.

The liquid-agent dispensing container 100 is, for example, a mechanical pump container, and discharges the liquid agent 150 as a foam body by causing the head portion 30 to be pushed down indirectly through the operating portion 20.

However, unlike this exemplary embodiment, the liquid-agent dispensing container may be configured such that the liquid agent 150 (foam body) is discharged using, for example, high-pressure gas stored, for example, in a cylinder.

There is no specific limitation as to the shape of the container body 10. For example, as illustrated in FIG. 1, the container body 10 has a shape including: a tubular body portion 11; a shoulder portion 12 connected to the upper side of the body portion 11 and having the bore of which horizontal cross-sectional area decreases toward the upper direction; a tubular neck portion 13 connected to the upper side of the shoulder portion 12; and a bottom portion 14 that closes the bottom end of the body portion 11. There is no specific limitation as to the material of the container body 10. For example, the container body 10 is formed using synthetic resin. The neck portion 13 has an upper end having an opening formed therein.

The liquid-agent dispensing cap 50 according to this exemplary embodiment is comprised of the elements of the liquid-agent dispensing container 100 except for the container body 10.

That is, the liquid-agent dispensing cap 50 including the mounting portion 52 that is mounted on the container body 10 that stores the liquid agent 150, includes: the head portion 30 that is held by the mounting portion 52 movably with respect to the mounting portion 52 in the one direction described above and the direction opposite to the one direction described above, and allows the liquid agent 150 to pass through the head portion 30 with the head portion 30 being pressed in the one direction described above relatively to the mounting portion 52; the dispensing outlet 41 that discharges the liquid agent 150 that has passed through the head portion 30; the swing portion 160 that is pivotally supported at the pivotally supporting portion 91 in a swingable manner relatively to the mounting portion 52 in a direction having the component of the one direction described above and the direction opposite to this direction, and has the force application portion 161 that receives a pressing force; the operating portion 20 that is pressed relatively to the mounting portion 52 with an operation made by a user, and has the pressing portion (pushing-down portion 21) that presses the force application portion 161 when the operating portion 20 is pressed; the acting portion (for example, comprised of the acting surface 165*a* and the projection portion 33 illustrated in FIG. 3) that is located between the force application portion 161 and the pivotally supporting portion 91, and transfers a pressing force from the swing portion 160 to the head portion 30 when the swing portion 160 swings in the direction having the component of the one direction described above with the force application portion 161 being pressed; and the guide mechanism (for example, comprised of the guiding portion 38 and the guided portion 24) that guides a relative movement of the operating portion 20 with respect to the head portion 30 while maintaining a posture of the operating portion 20 when the operating portion 20 is pressed, in which at least a part of the head portion 30 is covered with the operating portion 20 when the liquid-agent dispensing cap 50 is viewed in the one direction described above.

More specifically, the liquid-agent dispensing cap 50 includes: the mounting portion 52 that is mounted on the container body 10 that stores the liquid agent 150; the head portion 30 that is held by the mounting portion 52 so as to be able to move in a top-bottom direction with respect to the mounting portion 52, and allows the liquid agent 150 to pass through the head portion 30 with the head portion 30 being pushed down relatively to the mounting portion 52; the dispensing outlet 41 that discharges the liquid agent 150 that has passed through the head portion 30; the swing portion 160 that is pivotally supported at the pivotally supporting portion 91 in a manner swingable in a direction having a downward component relatively to the mounting portion 52 and a direction opposite to this direction, and has the force application portion 161 that receives a pushing-down force; the operating portion 20 that is pushed down relatively to the mounting portion 52, and has the pushing-down portion 21 that pushes down the force application portion 161 when the operating portion 20 is pushed down; the acting portion (for example, comprised of the acting surface 165*a* and the projection portion 33 illustrated in FIG. 3) that is located between the force application portion 161 and the pivotally supporting portion 91, and transfers a pushing-down force from the swing portion 160 to the head portion 30 when the swing portion 160 swings in a direction having the downward component with the force application portion 161 being pushed down; and the guide mechanism (for example, comprised of the guiding portion 38 and the guided portion 24) that guides a relative movement of the operating portion 20 with respect to the head portion 30 while maintaining a posture of the operating portion 20 when the operating portion 20 is pushed down, in which, in plan view, at least a part of the head portion 30 is covered with the operating portion 20.

The mounting portion 52 is mounted detachably on the neck portion 13 through, for example, a fastening method such as screwing. With this configuration, the whole of the liquid-agent dispensing cap 50 including the mounting portion 52, the head portion 30, the operating portion 20, and the swing portion 160 and the like, is mounted on the neck portion 13. With the liquid-agent dispensing cap 50 being mounted on the neck portion 13, the opening of the neck portion 13 is closed by the liquid-agent dispensing cap 50.

The mounting portion 52 includes a tubular portion having a thread ridge formed on the inner peripheral surface thereof, and a top surface portion that closes the upper end of the tubular portion except for the central portion of this upper end.

The liquid-agent dispensing cap 50 further includes a tubular erected tube 53 that stands upward from the top surface portion of the mounting portion 52.

The head portion 30 includes, for example, a head main body portion 31, and a nozzle portion 40 that projects from the head main body portion 31 toward a direction having a component of the horizontal direction and has the dispensing outlet 41 formed therein.

The head main body portion 31 is held by an elevation portion 50*a* (FIG. 6), which will be described later. The elevation portion 50*a* can make a relative movement with respect to the erected tube 53 in the axial direction of the erected tube 53 (in other words, in the top-bottom direction). Thus, the head main body portion 31 as well as the entire head portion 30 also can make a relative movement with respect to the erected tube 53 in the axial direction of the erected tube 53.

Figure 5:
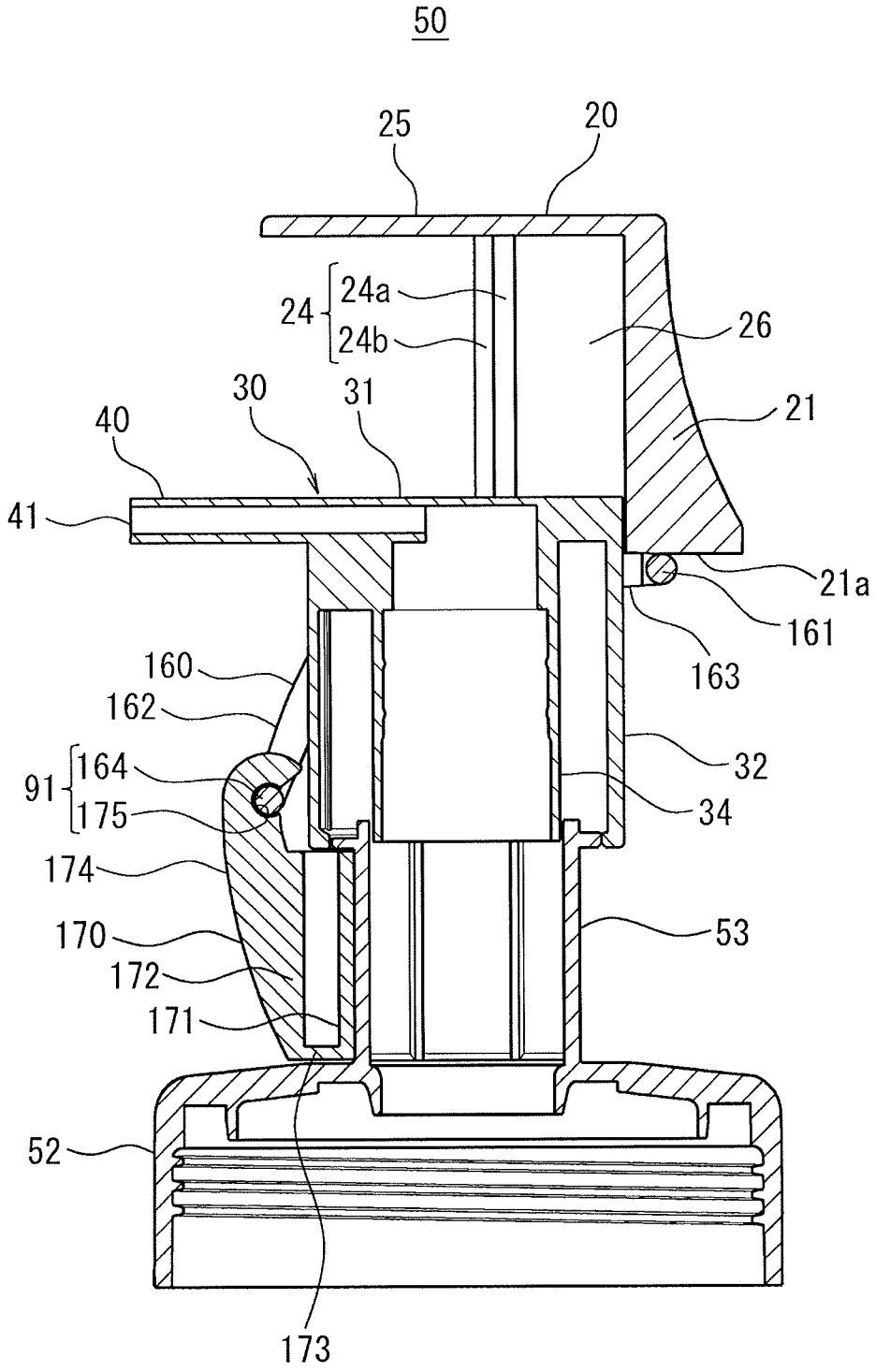
FIG. 5 is a sectional view illustrating the upper portion of the liquid-agent dispensing cap according to the first exemplary embodiment as viewed from the side.

As illustrated in FIG. 5, the head main body portion 31 has a double-tube structure, which includes, for example, an external tubular portion 32 and an internal tubular portion 34 disposed inside of the external tubular portion 32 coaxially with the external tubular portion 32. In the case of this exemplary embodiment, the external tubular portion 32 and the internal tubular portion 34 are connected with each other at the upper end portion of the head main body portion 31.

The external tubular portion 32 and the internal tubular portion 34 are disposed coaxially with the erected tube 53. In plan view, the external tubular portion 32 is disposed outside of the erected tube 53, and the internal tubular portion 34 is disposed inside of the erected tube 53. In addition, the external tubular portion 32, the internal tubular portion 34, and the head main body portion 31 as a whole are guided by the erected tube 53 in the top-bottom direction. The upper end portion of the erected tube 53 communicates with the internal space of the internal tubular portion 34.

The upper end surface of the internal tubular portion 34 is closed. More specifically, the upper end surface of the external tubular portion 32 is closed.

The nozzle portion 40 is formed into a tubular shape, and projects horizontally from the upper end portion of the head main body portion 31 toward the forward direction. The internal space of the base end portion of the nozzle portion 40 communicates with the internal space of the upper end portion of the internal tubular portion 34 (see FIG. 5). The dispensing outlet 41 is formed at the tip end of the nozzle portion 40, for example, in a state of being opened toward the forward direction.

Figure 2:
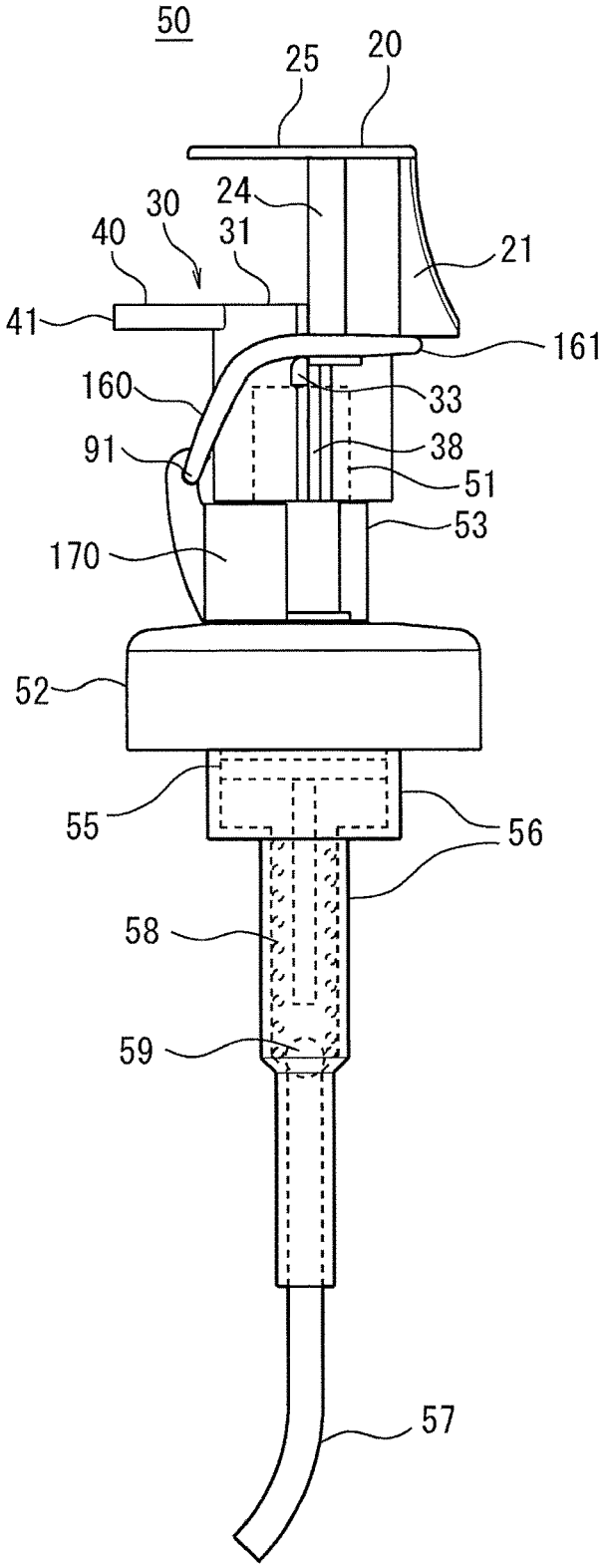
FIG. 2 is a side view illustrating a liquid-agent dispensing cap according to the first exemplary embodiment.

In a state of normal (normal state) where the head portion 30 is not pushed down by the operating portion 20, the positions of the elevation portion 50*a* (FIG. 6) and the head portion 30 in the top-bottom direction with respect to the erected tube 53 are at the upper limit position (FIGS. 1 to 5) due to action of a spring body 58 illustrated in FIG. 2.

On the other hand, as a user pushes down the operating portion 20, a pushing-down force is transferred to the head portion 30 through the swing portion 160, and the head portion 30 is pushed down against the urging force of the spring body 58, and together with the elevation portion 50*a*, is pushed down in an integral manner, details of which will be described later. Thus, the head main body portion 31 descends relatively to the erected tube 53, and the external tubular portion 32 approaches the mounting portion 52, which results in a state where the erected tube 53 is covered, for example, with the external tubular portion 32 (FIG. 10).

If the pushing-down operation to the operating portion 20 is released, the head portion 30 together with the elevation portion 50*a* integrally ascends due to the urging force of the spring body 58, returning to the normal state. At this time, the operating portion 20 returns to a position before the pushing-down operation.

As illustrated in FIG. 2, the liquid-agent dispensing cap 50 includes a piston 55, a housing 56, a suction pipe 57, and a foam generating portion 51, in addition to the head portion 30, the erected tube 53, the mounting portion 52, and the spring body 58.

The housing 56 houses the piston 55 and the spring body 58, and communicates with the dispensing outlet 41 through the erected tube 53, the internal tubular portion 34, and the inside of the nozzle portion 40.

The suction pipe 57 is a pipe for sucking up the liquid agent 150 in the container body 10, communicates with the inside of the housing 56, and is suspended downward from the housing 56.

In a state where the liquid-agent dispensing cap 50 is mounted on the neck portion 13, the housing 56 and the suction pipe 57 are located inside of the container body 10.

The piston 55 can reciprocate in the top-bottom direction within the housing 56. The piston 55 has the bottom end having a spherical valve body 59 formed thereat. The valve body 59 restricts the liquid agent 150 stored in the housing 56 and the suction pipe 57 from flowing down.

As a user pushes down the operating portion 20, the head portion 30 is pushed down through the swing portion 160. Then, the air pressure within the housing 56 increases in a state where elevation (opening) of the valve body 59 at the bottom end of the piston 55 is restricted by the piston 55. The piston 55 is provided with a liquid flow path (not illustrated), which is a small hole and allows the housing 56 and the head portion 30 to communicate with each other. As the opening area of the liquid flow path is sufficiently small, the air pressure within the housing 56 increases with the head portion 30 being pushed down. Then, the liquid agent 150 is pushed up from the housing 56 to the head portion 30. The head portion 30 is provided with an airflow path (not illustrated) that communicates with the outside.

Within the liquid-agent dispensing cap 50, the foam generating portion 51 is provided on the flow path for the liquid agent 150. In the foam generating portion 51, air is sprayed over the liquid agent 150 to make the liquid agent 150 into coarse bubbles. These coarse bubbles pass through a mesh disposed at the latter stage in the foam generating portion 51 to be a finer, uniform foam body. Then, this foam body is introduced from the inside of the internal tubular portion 34 into the nozzle portion 40, and is discharged from the dispensing outlet 41 through the nozzle portion 40.

When the pushing-down operation to the operating portion 20 is released, the spring body 58 elastically returns to make the piston 55 return to the upper position. This causes the pressure within the housing 56 to be reduced, and opens the valve body 59 to suck up the next liquid agent 150 into the housing 56 through the suction pipe 57. As the external air is taken into the inside of the liquid-agent dispensing cap 50 through the airflow path, the inside of the liquid-agent dispensing cap 50 is maintained at atmospheric pressure.

Figure 6:
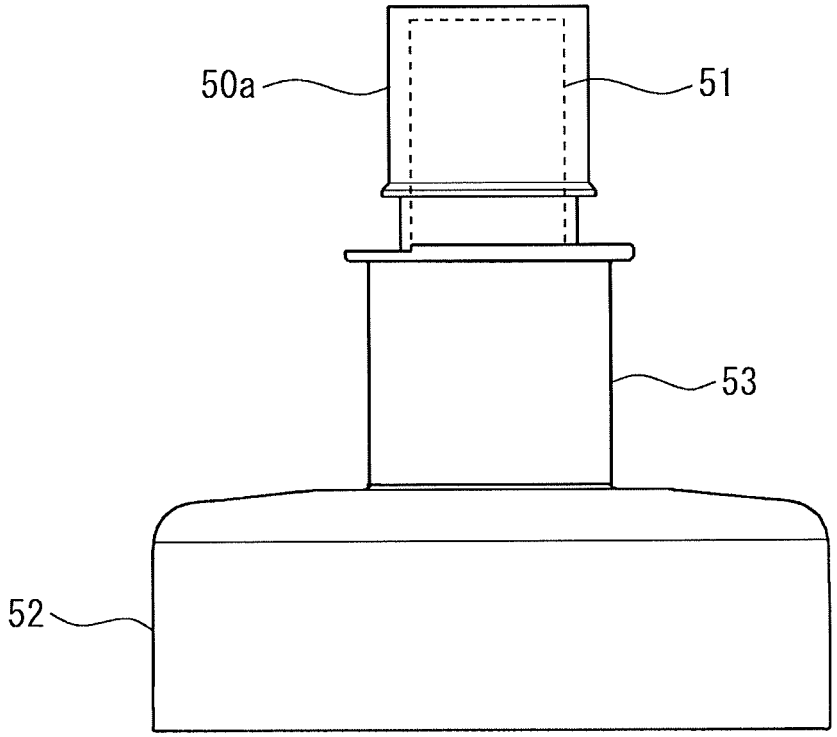
FIG. 6 is a side view illustrating a state where a second mounting portion, a head portion, a swing portion, and an operating portion are removed from the liquid-agent dispensing cap according to the first exemplary embodiment.

Here, FIG. 6 is a side view illustrating a state where a second mounting portion 170, which will be described later, the head portion 30, the swing portion 160, and the operating portion 20 are removed from the liquid-agent dispensing cap 50. As illustrated in FIG. 6, the foam generating portion 51 is disposed, for example, in the elevation portion 50*a* (see FIG. 6). The elevation portion 50*a* can move up and down in conjunction with the piston 55.

The structure and operations of the liquid-agent dispensing cap 50 described above are merely examples, and any elements having widely known structures may be applied to this exemplary embodiment.

Each of the diagrams of FIG. 3 to FIG. 5, and FIG. 10 only illustrates the external view of the structure of the upper portion of the liquid-agent dispensing cap 50, and no illustration is given as to the foam generating portion 51, the piston 55, the housing 56, the spring body 58, the valve body 59, the suction pipe 57 and the like, from among the configuration of the liquid-agent dispensing cap 50.

In addition, in FIG. 6, the configurations disposed lower than the mounting portion 52 of the configuration of the liquid-agent dispensing cap 50 are not illustrated.

In the other exemplary embodiments described later, the external view of the configuration of the upper portion of the liquid-agent dispensing cap 50 is illustrated in each of the diagrams illustrating the liquid-agent dispensing cap 50 (except for the sectional view), and no illustration is given as to the foam generating portion 51, the piston 55, the housing 56, the spring body 58, the valve body 59, the suction pipe 57 and the like, from among the configuration of the liquid-agent dispensing cap 50, as appropriate. In addition, in the sectional views in the other exemplary embodiments described later, the foam generating portion 51, the piston 55, the housing 56, the spring body 58, the valve body 59, the suction pipe 57 and the like, are not illustrated.

The liquid-agent dispensing container 100 further includes the second mounting portion 170 that is mounted (for example, is mounted detachably) on the mounting portion 52, and the swing portion 160 is pivotally supported at the pivotally supporting portion 91 by the second mounting portion 170.

Figure 7A:
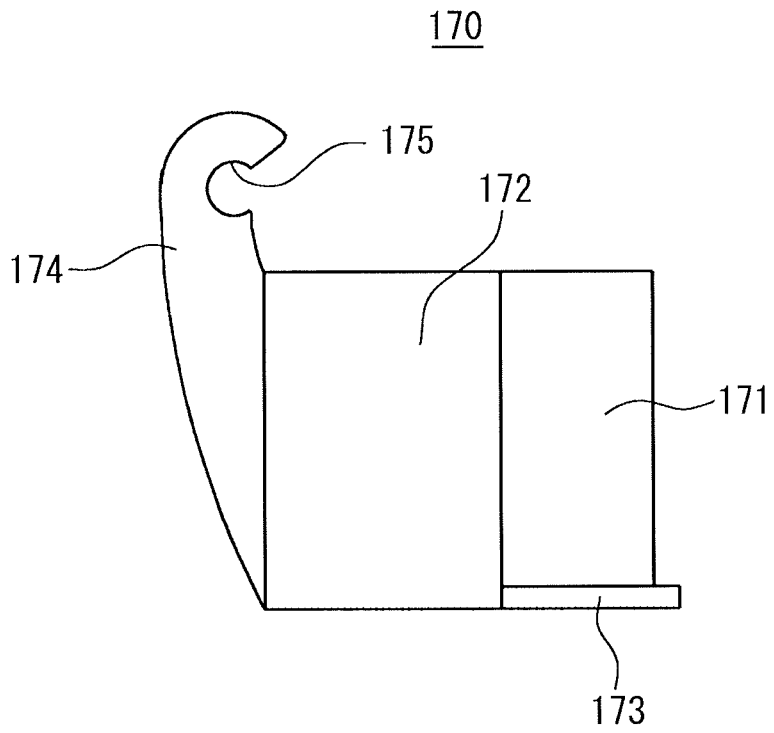
FIGS. 7(*a*) and 7(*b*) are diagrams each illustrating a second mounting portion.
Figure 7B:
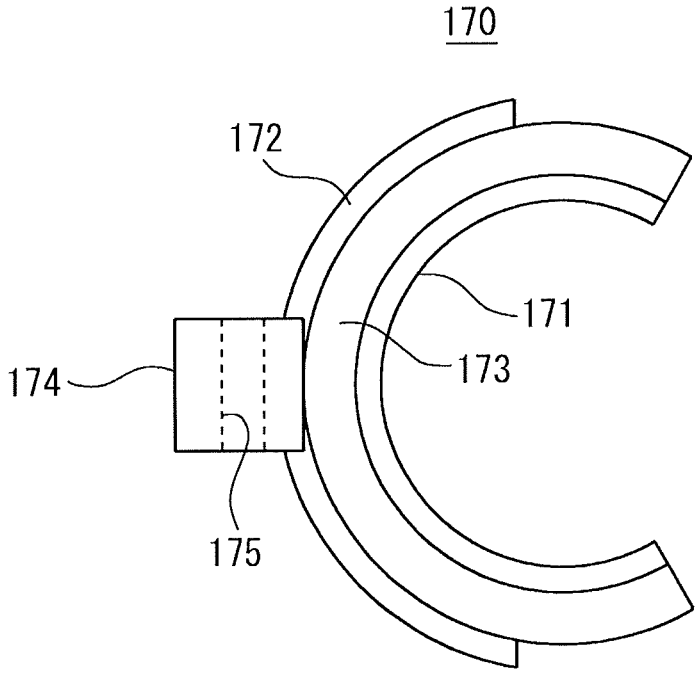

As illustrated in FIGS. 7(*a*) and 7(*b*), the second mounting portion 170 is configured to include: an inner-peripheral wall portion 171 having an arc shape in plan view; an outer-peripheral wall portion 172 disposed on the outer peripheral side of the inner-peripheral wall portion 171 coaxially with the inner-peripheral wall portion 171 and having an arc shape in plan view; a connecting portion 173 that connects the inner-peripheral wall portion 171 and the outer-peripheral wall portion 172 with each other; and a supporting portion 174 that stands upward from the front portion of the outer-peripheral wall portion 172.

The inner-peripheral wall portion 171 is set such that the inner diameter thereof has the size equivalent to the outer diameter of the erected tube 53. The erected tube 53 is press-fitted into the inner-peripheral wall portion 171, whereby the second mounting portion 170 is mounted on the mounting portion 52 (FIG. 3). That is, the second mounting portion 170 is detachably mounted on the mounting portion 52 indirectly through the erected tube 53. The up-down movement of the second mounting portion 170 relatively to the mounting portion 52 is restricted in a state of being mounted on the mounting portion 52.

The connecting portion 173 is, for example, a horizontal plate-like portion having an arc shape in plan view, and connects the bottom end of the inner-peripheral wall portion 171 and the bottom end of the outer-peripheral wall portion 172 with each other.

The upper portion of the supporting portion 174 projects upward farther than the upper end of the outer-peripheral wall portion 172. The upper portion of the supporting portion 174 includes a bearing portion 175 formed so as to support the shaft portion 164 (FIG. 3) of the swing portion 160. More specifically, the bearing portion 175 supports the shaft portion 164 in a manner such that the axial direction of the shaft portion 164 extends in the horizontal direction (for example, in the left-right direction). The pivotally supporting portion 91 is comprised of the shaft portion 164 and the bearing portion 175.

In this way, the liquid-agent dispensing container 100 includes the second mounting portion 170 that is mounted on the mounting portion 52, and the swing portion 160 is pivotally supported at the pivotally supporting portion 91 by the second mounting portion 170.

With the head portion 30 being pushed down, a part of the peripheral wall of the external tubular portion (tubular portion) 32 of the head portion 30 is entered into the space between the inner-peripheral wall portion 171 and the outer-peripheral wall portion 172.

In this way, the liquid-agent dispensing container 100 includes the erected tube 53 that stands from the mounting portion 52 in a direction opposite to the one direction described above. The second mounting portion 170 includes: the inner-peripheral wall portion 171 into which the erected tube 53 is fitted, so that the inner-peripheral wall portion 171 is mounted on the mounting portion 52; and the outer-peripheral wall portion 172 that is disposed coaxially with the inner-peripheral wall portion 171. The inner-peripheral wall portion 171 and the outer-peripheral wall portion 172 are each formed into an arc shape when viewed in the one direction described above. The head portion 30 has the tubular portion (external tubular portion 32). With the head portion 30 being pressed, a part of the peripheral wall of the tubular portion (external tubular portion 32) is entered into the space between the inner-peripheral wall portion 171 and the outer-peripheral wall portion 172.

Figure 8A:
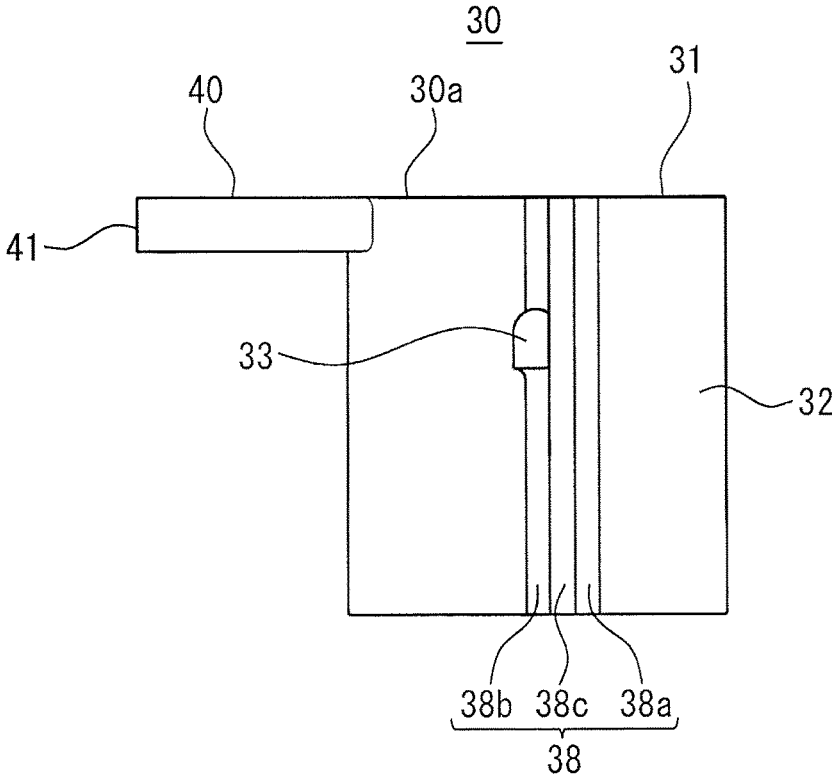
FIGS. 8(*a*) and 8(*b*) are diagrams each illustrating a head portion.
Figure 8B:
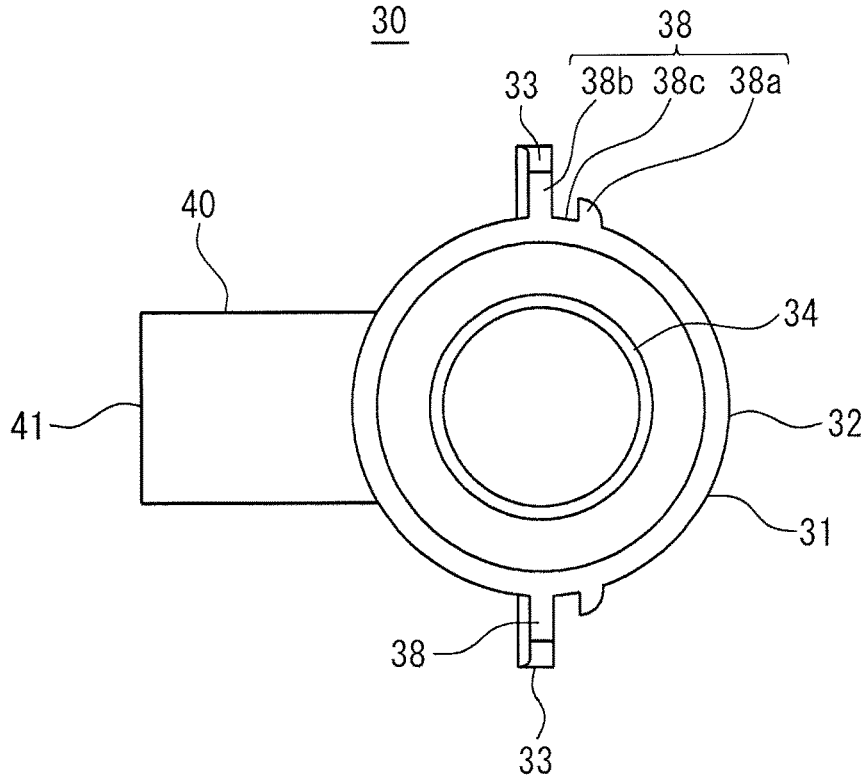

As illustrated in FIGS. 8(*a*) and 8(*b*), the head portion 30 includes the head main body portion 31 having the external tubular portion 32 and the internal tubular portion 34, and the nozzle portion 40 having the dispensing outlet 41 formed therein.

The external tubular portion 32 has left and right side surfaces each having the guiding portion 38 and the projection portion 33 formed thereon.

More specifically, the guiding portion 38 is configured, for example, to include: a first guiding rib 38*a* that linearly extends in the top-bottom direction; a second guiding rib 38*b* that linearly extends in the top-bottom direction on the forward side of the first guiding rib 38*a*; and a guiding groove 38*c* that is disposed between the second guiding rib 38*b* and the first guiding rib 38*a* in the front-rear direction and linearly extends in the top-bottom direction. The guiding portion 38 (the first guiding rib 38*a*, the second guiding rib 38*b*, and the guiding groove 38*c*) extends in the top-bottom direction, for example, from the upper end to the bottom end of the head main body portion 31.

Figure 4:
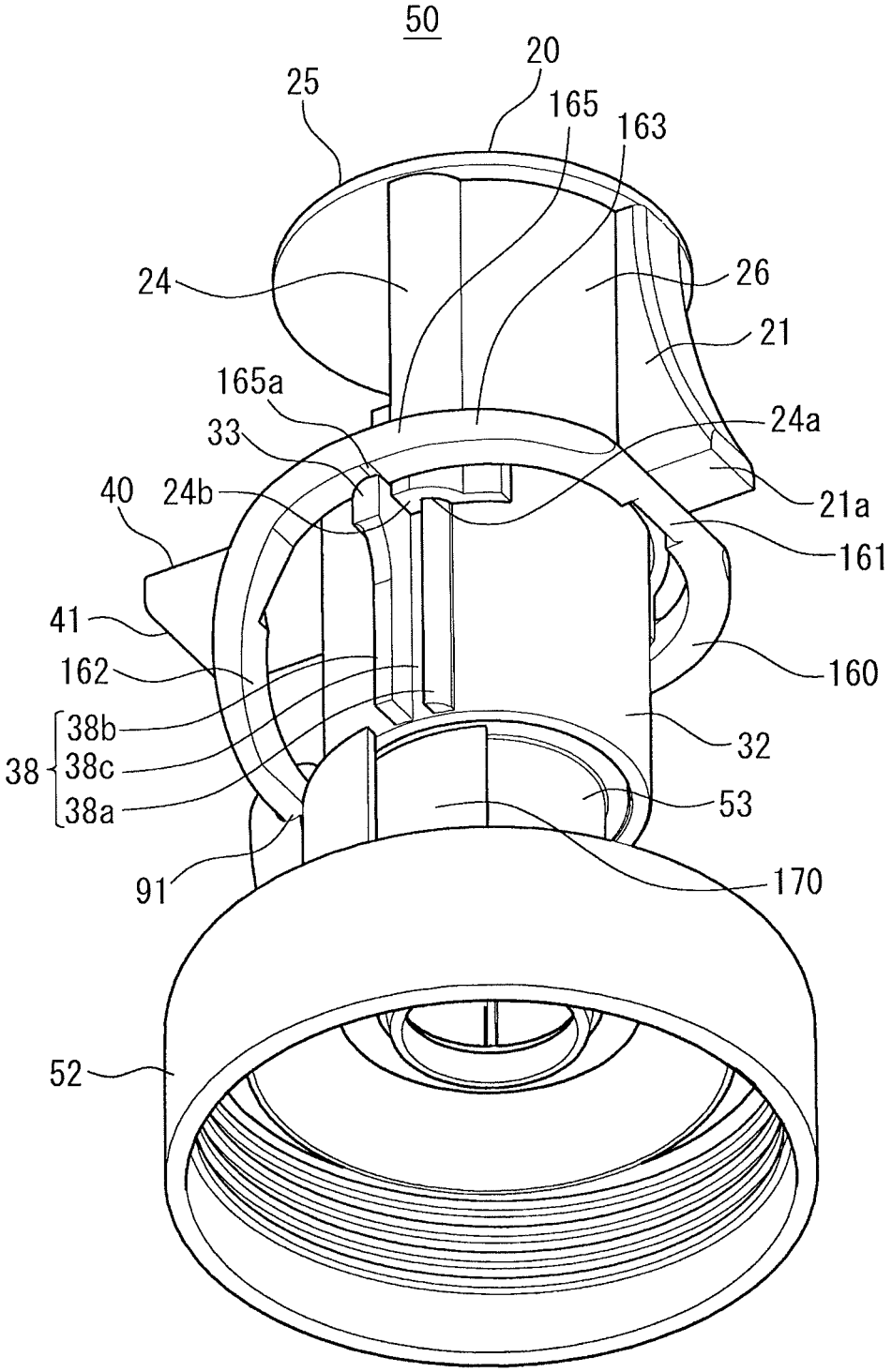
FIG. 4 is a perspective view illustrating the upper portion of the liquid-agent dispensing cap according to the first exemplary embodiment as viewed obliquely from a rear lower side.

In addition, the projection portion 33 is formed, for example, so as to project in the side direction from the second guiding rib 38*b* (see FIG. 4). The top portion (side end surface) of the second guiding rib 38*b* is sloped in a smoothly curved manner at the bottom side of the projection portion 33 (the length of projection of the second guiding rib 38*b* from the side surface of the external tubular portion 32 gradually increases toward the projection portion 33). This configuration enhances the structural strength of the second guiding rib 38*b* and the projection portion 33, and also suppresses fingers from being caught between the projection portion 33 and the mounting portion 52 when the head portion 30 is pushed down.

The upper end of the projection portion 33 is disposed at a position lower than the upper surface 30*a* of the head portion 30.

As the elevation portion 50*a* (FIG. 6) is inserted into the inside of the internal tubular portion 34, the head portion 30 is held by the elevation portion 50*a*.

As illustrated in FIG. 3, the pivotally supporting portion 91 is disposed on the forward side of the external tubular portion 32 of the head portion 30. In addition, the force application portion 161 is disposed on the backward side of the external tubular portion 32. That is, the pivotally supporting portion 91 and the force application portion 161 are disposed on the opposite sides to each other with the tubular portion (external tubular portion 32) being disposed therebetween in a direction (for example, in the front-rear direction) perpendicular to both of the one direction described above and the axial direction of the pivotally supporting portion 91.

Here, when viewed from the side (in other words, when the liquid-agent dispensing container 100 is viewed in the axial direction of the pivotally supporting portion 91), the swing portion 160 includes a first portion 162 that extends from the pivotally supporting portion 91 in a direction having a component of the direction opposite to the one direction described above and on the side of the force application portion 161, and also includes a second portion 163 that extends toward the force application portion 161 from the end portion of the first portion 162 on the side of the force application portion 161. In addition, when the liquid-agent dispensing container 100 is viewed in the axial direction of the pivotally supporting portion 91, the swing portion 160 is bent at the boundary portion 165 between the first portion 162 and the second portion 163 convexly toward the direction opposite to the one direction described above.

In other words, in the case of this exemplary embodiment, the swing portion 160 bends convexly upward at the boundary portion 165 between the first portion 162 and the second portion 163 when viewed from the side.

Here, the boundary portion 165 represents a portion extending from the end portion of the first portion 162 on the second portion 163 side, to the end portion of the second portion 163 on the first portion 162 side (a portion extending from the backward end portion of the first portion 162 to the forward end portion of the second portion 163).

The swing portion 160 includes: the shaft portion 164 that is supported by the bearing portion 175; the force application portion 161 that receives a pushing-down force from the pushing-down portion 21 of the operating portion 20; the first portion 162 that extends obliquely upward and backward from the pivotally supporting portion 91 in the normal state where the operating portion 20 is not pushed down; and the second portion 163 that extends backward from the backward end of the first portion 162 at a sloped angle less than that of the first portion 162 in the normal state.

More specifically, the swing portion 160 is formed into an annular shape in plan view, and is formed so as to be right-and-left symmetry. Thus, the swing portion 160 includes a pair of left and right first portions 162 and a pair of left and right second portions 163. Accordingly, the swing portion 160 has a pair of left and right boundary portions 165.

Here, as described above, the head portion 30 includes the tubular portion (external tubular portion 32) that has the shaft center extending in the one direction described above. In addition, the swing portion 160 is formed into an annular shape that surrounds the tubular portion (external tubular portion 32) when the liquid-agent dispensing container 100 is viewed in the one direction described above.

As illustrated in FIGS. 4 and 5, the force application portion 161 is, for example, formed into a round-rod shape, and extends in the left and right direction. In addition, the shaft portion 164 is also formed into a round-rod shape, and extends in the left and right direction.

Furthermore, the first portion 162 and the second portion 163 are also formed into a rod shaped.

That is, in the case of this exemplary embodiment, the swing portion 160 is formed into an annular and rod shape.

Furthermore, the acting portion is configured to include the acting surface 165*a* that serves as the lower surface of the boundary portion 165 of the swing portion 160, and the projection portion 33 that projects in the side direction from the side surface of the head portion 30.

That is, the acting portion is configured to include the boundary portion 165 of the swing portion 160 and the projection portion 33 that projects from the outer peripheral surface of the tubular portion (external tubular portion 32) of the head portion 30.

More specifically, the swing portion 160 includes a pair of left and right acting surfaces 165*a*, and the acting surfaces 165*a* are each mounted on the corresponding projection portion 33. In addition, the acting portion includes the acting surfaces 165*a* and the projection portion 33.

Here, as described above, the swing portion 160 is formed into the annular shape that surrounds the external tubular portion 32 when the liquid-agent dispensing container 100 is viewed in the one direction described above, and includes the pair of left and right boundary portions 165. In other words, the liquid-agent dispensing container 100 includes a pair of acting portions that are spaced apart from each other in the axial direction of the pivotally supporting portion 91.

Figure 9A:
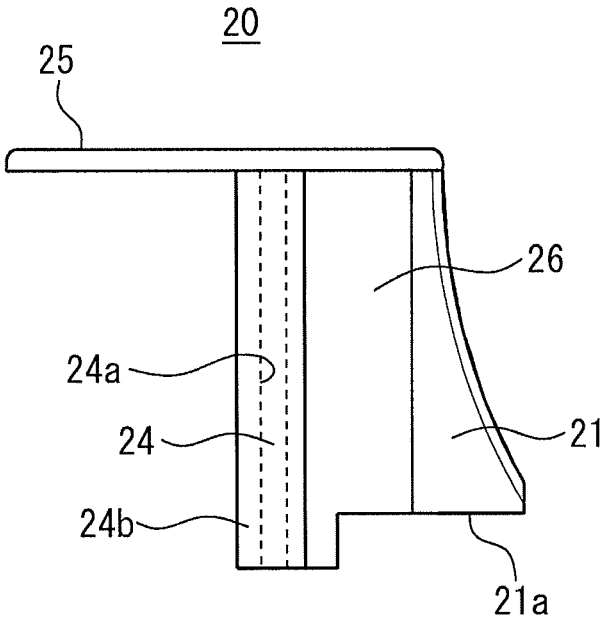
FIGS. 9(*a*) and 9(*b*) are diagrams each illustrating an operating portion.
Figure 9B:
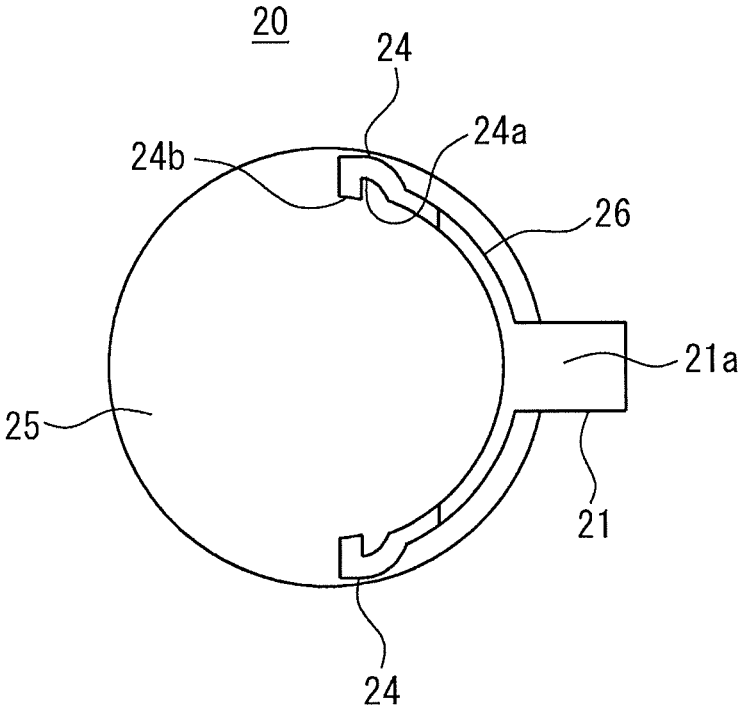

As illustrated in FIGS. 9(*a*) and 9(*b*), the operating portion 20 includes: the pushing-down portion 21 that pushes down the force application portion 161 (FIG. 3) of the swing portion 160 when the operating portion 20 is pushed down; the guided portion 24 that is guided by the guiding portion 38 (FIG. 3); the operation receiving portion 25 that is located above the head portion 30 and receives a pushing-down operation; and a cover portion (space covering portion) 26 (see FIG. 3) that covers, from the side direction, the space between the lower surface of the operation receiving portion 25 and the upper surface 30*a* of the head portion 30.

That is, the operating portion 20 includes: the operation receiving portion 25 that is disposed at a position in a direction opposite to the one direction described above with the head portion 30 being the reference, and receives a pressing operation; and the cover portion (space covering portion) 26 that, when the liquid-agent dispensing container 100 is viewed in the axial direction of the pivotally supporting portion 91, covers the space between the plane of the operation receiving portion 25 on the head portion 30 side and the plane (upper surface 30*a*) of the head portion 30 on the operation receiving portion 25 side.

There is no specific limitation as to the shape of the operation receiving portion 25. However, in the case of this exemplary embodiment, the operation receiving portion 25 is, for example, a flat plate-like portion formed on the upper end portion of the operating portion 20, and is disposed horizontally. More specifically, the operation receiving portion 25 is formed, for example, into a round plate shape.

The cover portion 26 is formed, for example, into a half-tubular shape, and is provided in a state of being suspended from the rear half portion of the operation receiving portion 25. More specifically, the cover portion 26 is formed, for example, into a half-tubular shape having a radius equivalent to that of the operation receiving portion 25 and is disposed coaxially with the operation receiving portion 25. In addition, the cover portion 26 is suspended from the peripheral edge portion, located on the backward side, of the operation receiving portion 25.

The pushing-down portion 21 is provided, for example, in a state of projecting in the backward direction from the rear portion of the cover portion 26, and extends in the top-bottom direction. More specifically, the pushing-down portion 21 has the size in the front-rear direction increasing toward the lower portion of the pushing-down portion 21, and the amount of projection in the backward direction increases toward the lower portion of the pushing-down portion 21.

Here, the pressing portion (pushing-down portion 21) has a plane (lower surface 21*a*) that is perpendicular to the one direction described above and faces the one direction described above, and presses the force application portion 161 with this plane (lower surface 21*a*) (see FIGS. 3 and 10).

More specifically, the pushing-down portion 21 has a horizontal lower surface 21*a*, and pushes down the force application portion 161 with this lower surface 21*a* (see FIGS. 3 and 10).

This configuration makes it possible to push down the head portion 30 at a substantially constant speed (although this speed is slower than the descent speed of the operating portion 20) in the case where the operating portion 20 is pushed down at a constant speed. Thus, it is possible to discharge the foam body at a constant discharging rate.

The guided portion 24 is formed on each of left and right front portions of the cover portion 26, and extends linearly in the top-bottom direction. More specifically, the guided portion 24 is configured to include a guided groove 24*a* that is formed, for example, on the inner surface of the cover portion 26 and extends linearly in the top-bottom direction; and a guided rib 24*b* that is adjacent to the frontward side of the guided groove 24*a* and extends linearly in the top-bottom direction. The guided portion 24 reaches the bottom end of the cover portion 26.

The guided portion 24 on the left side and the guiding portion 38 on the left side are engaged with each other, and the guided portion 24 on the right side and the guiding portion 38 on the right side are engaged with each other.

As illustrated in FIGS. 3 and 4, the guided rib 24*b* is inserted into the guiding groove 38*c* and they are engaged with each other, whereas the first guiding rib 38*a* is inserted into the guided groove 24*a* and they are engaged with each other, whereby the corresponding guided portions 24 are each engaged with the corresponding guiding portions 38.

In addition, each of the guided portions 24 as well as the entire operating portion 20 are guided in the top-bottom direction with each of the guiding portions 38.

That is, in the case of this exemplary embodiment, the guide mechanism guides the operating portion 20 in the top-bottom direction relatively to the head portion 30.

In this way, in the case of this exemplary embodiment, the guide mechanism is configured to include the guiding portions 38 that are formed on the head portion 30, and the guided portions 24 that are formed on the space covering portion (cover portion 26) and are guided by the guiding portions 38.

Each of the guided portions 24 slides along the corresponding guiding portion 38 when the operating portion 20 is pushed down.

As the operating portion 20 is guided linearly in the top-bottom direction by the guiding portions 38, the top/bottom direction of the operating portion 20 is maintained constant.

Here, the direction in which the operating portion 20 is pressed is the same as the direction in which the operating portion 20 is guided by the guide mechanism. The guide mechanism includes the guiding portions 38 that the head portion 30 has, and the guided portions 24 that the operating portion 20 has, the guided portions 24 being guided by the guiding portions 38. The guiding portions 38 each guide, in the one direction described above and in the direction opposite to this one direction described above, at least two portions of the guided portions 24 that are spaced apart from each other in the one direction described above.

With the guide mechanism having such a configuration, it is possible to guide the operating portion 20 in the one direction and the direction opposite to the one direction described above relatively to the head portion 30 while maintaining the posture of the operating portion 20 constant.

In the case of this exemplary embodiment, the direction in which the operating portion 20 is pushed down is the downward direction (more specifically, downward in the vertical direction), and the direction in which the operating portion 20 is guided by the guide mechanism is also the downward direction (more specifically, downward in the vertical direction). In addition, these directions extend in the same direction.

As described above, the guide mechanism includes the guiding portions 38 that the head portion 30 has, and the guided portions 24 that the operating portion 20 has, the guided portions 24 being guided by the guiding portions 38.

Furthermore, the guiding portion 38 and the guided portion 24 are fitted with each other throughout the region having a certain length or more in the top-bottom direction, and can be slid with each other in the top-bottom direction. Thus, the guiding portions 38 guide, in the top-bottom direction, at least two portions of the guided portions 24 that are vertically spaced apart from each other.

With the guide mechanism having such a configuration, it is possible to guide the operating portion 20 in the top-bottom direction (more specifically, in the vertical direction) relative to the head portion 30 while maintaining the top and bottom of the operating portion 20 constant.

The guiding portion 38 and the guided portion 24 are in a relative relationship in which one side guides the other side. Thus, the "guiding portion 38 guiding at least two portions of the guided portions 24 in the top-bottom direction" also means that the guided portions 24 guide at least two portions of the guiding portions 38 in the top-bottom direction. Thus, instead of the exemplary embodiment described above, it is obvious that, while the guiding portions 38 on the head portion 30 side have the structure equivalent to that of the guided portions 24 described above, the guided portions 24 on the operating portion 20 side have the structure equivalent to that of the guiding portions 38. This applies to the other exemplary embodiments, and also applies to the other guide mechanisms (mechanism comprised of the guiding portion and the guided portion) described in the present specification.

In this way, the guiding portion 38 includes a guiding rib or a guiding groove (for example, the first guiding rib 38*a*, the second guiding rib 38*b*, and the guiding groove 38*c*) that extends in the one direction described above, and the guided portion 24 includes a guided groove or a guided rib (for example, the guided groove 24*a* and the guided rib 24*b*) that extends in the one direction described above and is guided by the guiding rib or the guiding groove.

In addition, the head portion 30 includes a tubular portion (external tubular portion 32) that has the shaft center extending in the one direction described above, and includes the guiding portion 38 at plural portions (for example, two portions) on the outer peripheral surface of the tubular portion.

More specifically, the head portion 30 includes a pair of guiding portions 38 that are each disposed on each of both end portions of the tubular portion in the axial direction of the pivotally supporting portion 91 with the shaft center of the tubular portion (external tubular portion 32) being the reference.

Here, as illustrated in FIG. 3, in the normal state, the shaft portion 164 of the swing portion 160 is pivotally supported by the bearing portion 175, and the acting surface 165*a* is supported by the projection portion 33, whereby the swing portion 160 is maintained to have the posture illustrated in FIG. 3.

Furthermore, as for the operating portion 20, the lower surface 21*a* of the pushing-down portion 21 is supported by the force application portion 161 of the swing portion 160, so that the operating portion 20 is disposed at the position illustrated in FIG. 3. In this state, the position of the bottom end of the cover portion 26 is located lower than the upper surface 30*a* of the head portion 30. With this configuration, in the normal state, the space between the lower surface of the operation receiving portion 25 and the upper surface 30*a* of the head portion 30 is covered with the cover portion 26 from the side and backward directions.

Here, as illustrated in FIG. 9(*a*), the cover portion 26 has the front portion including the guided portion 24, and this front portion extends downward farther than the rear portion of the cover portion 26. In addition, the position (the vertical position of the lower surface 21*a*) of the bottom end of the pushing-down portion 21 is equal to the position of the bottom end of the rear portion of the cover portion 26.

With this configuration, the front portion of the cover portion 26 is inserted into between the second portion 163 of the swing portion 160 and the external tubular portion 32 as illustrated in FIG. 4 to suppress the second portion 163 and the external tubular portion 32 from being brought into contact with each other, and also to suppress the swing portion 160 from wobbling when the swing portion 160 swings.

As the operating portion 20 is pushed down, the force application portion 161 is pushed down with the lower surface 21*a* of the pushing-down portion 21 to cause the swing portion 160 to swing clockwise in FIG. 3 with the pivotally supporting portion 91 being the fulcrum. At this time, the acting surface 165*a* pushes down the projection portion 33, and hence, the head portion 30 is pushed down relatively to the mounting portion 52 and the second mounting portion 170 (FIG. 10).

When the lower surface 21*a* of the pushing-down portion 21 pushes down the force application portion 161, the force application portion 161 first slides in the backward direction with respect to the lower surface 21*a*, and then, slides in the forward direction. Thereby, the forward-backward position of the force application portion 161 with respect to the lower surface 21*a* in the pushed-down state is a position equivalent to that in the normal state (FIG. 3), for example, as illustrated in FIG. 10.

In this way, the pressing portion (pushing-down portion 21) and the force application portion 161 are engaged with each other in a state in which relative movement is possible in a direction having a component in a direction intersecting both an axial direction of the pivotally supporting portion 91 and the one direction described above.

More specifically, the pushing-down portion 21 and the force application portion 161 are engaged with each other in a state where they can make a relative movement in a direction intersecting the axial direction of the pivotally supporting portion 91 and having a component of the horizontal direction.

More specifically, the direction in which the pushing-down portion 21 and the force application portion 161 can make a relative movement extends, for example, in a direction (front-rear direction) horizontal and perpendicular to the axial direction of the pivotally supporting portion 91. In addition, since the lower surface 21*a* of the pushing-down portion 21 is mounted on the force application portion 161, the lower surface 21*a* and the force application portion 161 are brought into contact with each other.

When the pushing-down portion 21 pushes down the force application portion 161, a portion of the acting surface 165*a* that is brought into contact with the projection portion 33 slides with respect to the projection portion 33.

Here, it is preferable that the shape (slope) of acting surface 165*a* is set such that the portion of the acting surface 165*a* that is brought into contact with the projection portion 33 is always maintained so as to be horizontal (see FIGS. 3 and 10). This configuration makes it possible to reduce a loss of force transferred from the swing portion 160 to the head portion 30, and hence, to reduce force necessary to push down the operating portion 20.

It is preferable that the upper surface of the projection portion 33 is chamfered.

Furthermore, there is no specific limitation as to where the acting portion (the acting surface 165*a* and the projection portion 33) is disposed, provided that the acting portion is disposed between the force application portion 161 and the pivotally supporting portion 91. With the acting portion being disposed as described above, it is possible to push down the head portion 30 using the principle of leverage by pushing down the operating portion 20.

For example, in the case where the acting portion is disposed approximately at the middle position between the force application portion 161 and the pivotally supporting portion 91 when viewed from the side, the head portion 30 can be pushed down by pushing down the operating portion 20 with a force approximately half of the force obtained by directly pushing down the head portion 30.

The liquid-agent dispensing cap 50 is formed, for example, so as to be right-and-left symmetry.

The liquid-agent dispensing cap 50, the liquid-agent dispensing container 100, and the liquid-agent dispensing container product 200 are configured in the manner described above.

Here, description has been made that at least a part of the head portion 30 is covered with the operating portion 20 when the liquid-agent dispensing container 100 is viewed in the one direction described above. However, it is only necessary that at least a part of the head portion 30 is located inside of the contour line of the operating portion 20 when the liquid-agent dispensing container 100 is viewed in the one direction described above. For example, it may be possible that the operating portion 20 is formed into a ring shape, and the head portion 30 is located inside of the inner periphery of the operating portion 20 (in a manner such that the head portion 30 can be viewed through the opening of the ring-shaped operating portion 20) when the liquid-agent dispensing container 100 is viewed in the one direction described above.

That is, the liquid-agent dispensing container 100 according to this exemplary embodiment may also be defined in the following manner. That is, the liquid-agent dispensing container 100 according to this exemplary embodiment including the container body 10 that stores the liquid agent 150, includes: the mounting portion 52 that is mounted on the container body 10; the head portion 30 that is held by the mounting portion 52 movably with respect to the mounting portion 52 in one direction and a direction opposite to the one direction described above, and allows the liquid agent 150 to pass through the head portion 30 with the head portion 30 being pressed in the one direction described above relatively to the mounting portion 52; the dispensing outlet 41 that discharges the liquid agent 150 that has passed through the head portion 30; the swing portion 160 that is pivotally supported at the pivotally supporting portion 91 in a swingable manner relatively to the mounting portion 52 in a direction having a component of the one direction descried above and a direction opposite to this direction, and has the force application portion 161 that receives a pressing force; the operating portion 20 that is pressed relatively to the mounting portion 52 with an operation made by a user, and has the pressing portion (for example, the pushing-down portion 21) that presses the force application portion 161 when the operating portion 20 is pressed; the acting portion (for example, comprised of the acting surface 165*a* and the projection portion 33 illustrated in FIG. 3) that is located between the force application portion 161 and the pivotally supporting portion 91, and transfers a pressing force from the swing portion 160 to the head portion 30 when the swing portion 160 swings in the direction having the component of the one direction described above with the force application portion 161 being pressed; and the guide mechanism (for example, comprised of the guiding portion 38 and the guided portion 24) that guides a relative movement of the operating portion 20 with respect to the head portion 30 while maintaining a posture of the operating portion 20 when the operating portion 20 is pressed, in which at least a part of the head portion 30 is located inside of the contour line of the operating portion 20 when the liquid-agent dispensing container 100 is viewed in the one direction described above.

Furthermore, as described above, for example, it may be possible that the operating portion 20 is formed into a ring shape, and the head portion 30 is located inside of the inner periphery of the operating portion 20 when the liquid-agent dispensing container 100 is viewed in the one direction described above. Thus, the liquid-agent dispensing container 100 according to this exemplary embodiment may also be defined in the following manner. That is, the liquid-agent dispensing container 100 according to this exemplary embodiment including the container body 10 that stores the liquid agent 150, includes: the mounting portion 52 that is mounted on the container body 10; the head portion 30 that is held by the mounting portion 52 movably with respect to the mounting portion 52 in one direction and a direction opposite to the one direction described above, and allows the liquid agent 150 to pass through the head portion 30 with the head portion 30 being pressed in the one direction described above relatively to the mounting portion 52; the dispensing outlet 41 that discharges the liquid agent 150 that has passed through the head portion 30; the swing portion 160 that is pivotally supported at the pivotally supporting portion 91 in a swingable manner relatively to the mounting portion 52 in a direction having a component of the one direction descried above and a direction opposite to this direction, and has the force application portion 161 that receives a pressing force; the operating portion 20 that is pressed relatively to the mounting portion 52 with an operation made by a user, and has the pressing portion (for example, the pushing-down portion 21) that presses the force application portion 161 when the operating portion 20 is pressed; the acting portion (for example, comprised of the acting surface 165*a* and the projection portion 33 illustrated in FIG. 3) that is located between the force application portion 161 and the pivotally supporting portion 91, and transfers a pressing force from the swing portion 160 to the head portion 30 when the swing portion 160 swings in the direction having the component of the one direction described above with the force application portion 161 being pressed; and the guide mechanism (for example, comprised of the guiding portion 38 and the guided portion 24) that guides a relative movement of the operating portion 20 with respect to the head portion 30 while maintaining a posture of the operating portion 20 when the operating portion 20 is pressed, in which the operating portion 20 is disposed so as to be spaced apart from the head portion 30 in a direction opposite to the one direction described above.

Furthermore, the liquid-agent dispensing container 100 according to this exemplary embodiment may also be defined in the following manner. That is, the liquid-agent dispensing container 100 according to this exemplary embodiment includes: the container body 10 that stores the liquid agent 150; the mounting portion 52 that is mounted on the container body 10; the head portion 30 that is held by the mounting portion 52 so as to be able to move in a top-bottom direction with respect to the mounting portion 52, and allows the liquid agent 150 to pass through the head portion 30 with the head portion 30 being pushed down relatively to the mounting portion 52; the dispensing outlet 41 that discharges the liquid agent 150 that has passed through the head portion 30; the swing portion 160 that is pivotally supported at the pivotally supporting portion 91 in a manner swingable in a direction having a downward component relatively to the mounting portion 52 and a direction opposite to this direction, and has the force application portion 161 that receives a pushing-down force; the operating portion 20 that is pushed down relatively to the mounting portion 52, and has the pushing-down portion 21 that pushes down the force application portion 161 when the operating portion 20 is pushed down; the acting portion (for example, comprised of the acting surface 165*a* and the projection portion 33 illustrated in FIG. 3) that is located between the force application portion 161 and the pivotally supporting portion 91, and transfers a pushing-down force from the swing portion 160 to the head portion 30 when the swing portion 160 swings in a direction having the downward component with the force application portion 161 being pushed down; and a guide mechanism that guides a relative movement of the operating portion 20 with respect to the head portion 30 while maintaining a posture of the operating portion 20 when the operating portion 20 is pushed down, in which the guide mechanism includes the guiding portion 38 that the head portion 30 has, and the guided portion 24 that the operating portion 20 has, the guided portion 24 being guided by the guiding portion 38.

Furthermore, the liquid-agent dispensing container 100 according to this exemplary embodiment may also be defined in the following manner. That is, the liquid-agent dispensing container 100 according to this exemplary embodiment including the container 10 that stores the liquid agent 150, includes: the mounting portion 52 that is mounted on the container body 10; the head portion 30 that is held by the mounting portion 52 movably with respect to the mounting portion 52 in one direction and a direction opposite to the one direction described above, and allows the liquid agent 150 to pass through the head portion 30 with the head portion 30 being pressed in the one direction described above relatively to the mounting portion 52; the dispensing outlet 41 that discharges the liquid agent 150 that has passed through the head portion 30; the swing portion 160 that is pivotally supported at the pivotally supporting portion 91 in a swingable manner relatively to the mounting portion 52 in a direction having a component of the one direction descried above and a direction opposite to this direction, and has the force application portion 161 that receives a pressing force; the operating portion 20 that is pressed relatively to the mounting portion 52 with an operation made by a user, and has the pressing portion (pushing-down portion 21) that presses the force application portion 161 when the operating portion 20 is pressed; the acting portion (for example, comprised of the acting surface 165*a* and the projection portion 33 illustrated in FIG. 3) that is located between the force application portion 161 and the pivotally supporting portion 91, and transfers a pressing force from the swing portion 160 to the head portion 30 when the swing portion 160 swings in the direction having the component of the one direction described above with the force application portion 161 being pressed; the guide mechanism (for example, comprised of the guiding portion 38 and the guided portion 24) that guides a relative movement of the operating portion 20 with respect to the head portion 30 while maintaining a posture of the operating portion 20 when the operating portion 20 is pressed; and the second mounting portion 170 that is detachably mounted on the mounting portion 52, in which the swing portion 160 is pivotally supported at the pivotally supporting portion 91 by the second mounting portion 170.

Furthermore, the liquid-agent dispensing container 100 according to this exemplary embodiment may also be defined in the following manner. That is, the liquid-agent dispensing container 100 according to this exemplary embodiment including the container body 10 that stores the liquid agent 150, includes: the mounting portion 52 that is mounted on the container body 10; the head portion 30 that is held by the mounting portion 52 movably with respect to the mounting portion 52 in one direction and a direction opposite to the one direction described above, and allows the liquid agent 150 to pass through the head portion 30 with the head portion 30 being pressed in the one direction described above relatively to the mounting portion 52; the dispensing outlet 41 that discharges the liquid agent 150 that has passed through the head portion 30; the swing portion 160 that is pivotally supported at the pivotally supporting portion 91 in a swingable manner relatively to the mounting portion 52 in a direction having a component of the one direction descried above and a direction opposite to this direction, and has the force application portion 161 that receives a pressing force; the operating portion 20 that is pressed relatively to the mounting portion 52 with an operation made by a user, and has the pressing portion (pushing-down portion 21) that presses the force application portion 161 when the operating portion 20 is pressed; the acting portion (for example, comprised of the acting surface 165*a* and the projection portion 33 illustrated in FIG. 3) that is located between the force application portion 161 and the pivotally supporting portion 91, and transfers a pressing force from the swing portion 160 to the head portion 30 when the swing portion 160 swings in the direction having the component of the one direction described above with the force application portion 161 being pressed; and the guide mechanism (for example, comprised of the guiding portion 38 and the guided portion 24) that guides a relative movement of the operating portion 20 with respect to the head portion 30 while maintaining a posture of the operating portion 20 when the operating portion 20 is pressed, in which: the head portion 30 includes a tubular portion (external tubular portion 32) that has a shaft center extending in the one direction described above; the swing portion 160 is formed into an annular shape that surrounds the tubular portion when the liquid-agent dispensing container 100 is viewed in the one direction described above; and the liquid-agent dispensing container 100 includes a pair of acting portions that are spaced apart from each other in the axial direction of the pivotally supporting portion 91.

Furthermore, the liquid-agent dispensing container 100 according to this exemplary embodiment may also be defined in the following manner. That is, the liquid-agent dispensing container 100 according to this exemplary embodiment including the container body 10 that stores the liquid agent 150, includes: the mounting portion 52 that is mounted on the container body 10; the head portion 30 that is held by the mounting portion 52 movably with respect to the mounting portion 52 in one direction and a direction opposite to the one direction described above, and allows the liquid agent 150 to pass through the head portion 30 with the head portion 30 being pressed in the one direction described above relatively to the mounting portion 52; the dispensing outlet 41 that discharges the liquid agent 150 that has passed through the head portion 30; the swing portion 160 that is pivotally supported at the pivotally supporting portion 91 in a swingable manner relatively to the mounting portion 52 in a direction having a component of the one direction descried above and a direction opposite to this direction, and has the force application portion 161 that receives a pressing force; the operating portion 20 that is pressed relatively to the mounting portion 52 with an operation made by a user, and has the pressing portion (pushing-down portion 21) that presses the force application portion 161 when the operating portion 20 is pressed; the acting portion (for example, comprised of the acting surface 165*a* and the projection portion 33 illustrated in FIG. 3) that is located between the force application portion 161 and the pivotally supporting portion 91, and transfers a pressing force from the swing portion 160 to the head portion 30 when the swing portion 160 swings in the direction having the component of the one direction described above with the force application portion 161 being pressed; and the guide mechanism (for example, comprised of the guiding portion 38 and the guided portion 24) that guides the operating portion 20 in the one direction described above and the direction opposite to the one direction described above relatively to the head portion 30, in which the pressing portion (pushing-down portion 21) and the force application portion 161 are engaged with each other in a state in which relative movement is possible in a direction having a component in a direction intersecting both the axial direction of the pivotally supporting portion 91 and the one direction described above.

In addition, the liquid-agent dispensing container 100 according to this exemplary embodiment may also be defined in the following manner. That is, the liquid-agent dispensing container 100 according to this exemplary embodiment includes: the container body 10 that stores the liquid agent 150; the mounting portion 52 that is mounted on the container body 10; the head portion 30 that is held by the mounting portion 52 so as to be able to move in a top-bottom direction with respect to the mounting portion 52, and allows the liquid agent 150 to pass through the head portion 30 with the head portion 30 being pushed down relatively to the mounting portion 52; the dispensing outlet 41 that discharges the liquid agent 150 that has passed through the head portion 30; the swing portion 160 that is pivotally supported at the pivotally supporting portion 91 in a manner swingable in a direction having a downward component relatively to the mounting portion 52 and a direction opposite to this direction, and has the force application portion 161 that receives a pushing-down force; the operating portion 20 that is pushed down relatively to the mounting portion 52, and has the pushing-down portion 21 that pushes down the force application portion 161 when the operating portion 20 is pushed down; the acting portion (for example, comprised of the acting surface 165*a* and the projection portion 33 illustrated in FIG. 3) that is located between the force application portion 161 and the pivotally supporting portion 91, and transfers a pushing-down force from the swing portion 160 to the head portion 30 when the swing portion 160 swings in a direction having the downward component with the force application portion 161 being pushed down; and the guide mechanism (for example, comprised of the guiding portion 38 and the guided portion 24) that guides the operating portion 20 in a top-bottom direction relatively to the head portion 30, in which the pushing-down portion 21 and the force application portion 161 are engaged with each other in a state where they can make a relative movement in a direction intersecting the axial direction of the pivotally supporting portion 91 and having a component of the horizontal direction.

Next, operations will be described.

In order to discharge the foam body from the liquid-agent dispensing container 100, a push-down operation is performed to the operating portion 20. This causes the head portion 30 to be pushed down through the swing portion 160, and the head portion 30 is pushed down against the urging force of the spring body 58. As the head portion 30 is pushed down, the foam body is discharged from the dispensing outlet 41 of the nozzle portion 40.

Here, when the operating portion 20 is pushed down, the operating portion 20 is guided downward by the guide mechanism (the guiding portion 38 and the guided portion 24). Thus, the posture of the operating portion 20 is maintained constant when the operating portion 20 is pushed down. That is, the top/bottom direction of the operating portion 20 is maintained constant, and the operation receiving portion 25 is maintained to be horizontal. Thus, it is possible to achieve the operational feeling equivalent to that of a liquid-agent dispensing container of the type in which the head portion 30 is directly pushed down.

Furthermore, if the force of pushing down the operating portion 20 is released, the head portion 30 ascends to the position of the normal state due to the urging force of the spring body 58. At this time, the projection portion 33 pushes up the acting surface 165*a*, so that the swing portion 160 swings relatively to the mounting portion 52 (swings counterclockwise in FIG. 3) with the pivotally supporting portion 91 being the fulcrum. Thus, the operating portion 20 is lifted up by the force application portion 161. At this time, the operating portion 20 is guided upward by the guide mechanism. Thus, the posture of the operating portion 20 is maintained constant when the operating portion is lifted up, and the operation receiving portion 25 is maintained to be horizontal.

According to the exemplary embodiment described above, the liquid-agent dispensing container 100 including the container body 10 that stores the liquid agent 150, includes: the mounting portion 52 that is mounted on the container body 10; the head portion 30 that is held by the mounting portion 52 movably with respect to the mounting portion 52 in one direction and a direction opposite to the one direction described above, and allows the liquid agent 150 to pass through the head portion 30 with the head portion 30 being pressed in the one direction described above relatively to the mounting portion 52; the dispensing outlet 41 that discharges the liquid agent 150 that has passed through the head portion 30; the swing portion 160 that is pivotally supported at the pivotally supporting portion 91 in a swingable manner relatively to the mounting portion 52 in a direction having a component of the one direction descried above and a direction opposite to this direction, and has the force application portion 161 that receives a pressing force; the operating portion 20 that is pressed relatively to the mounting portion 52 with an operation made by a user, and has the pressing portion (pushing-down portion 21) that presses the force application portion 161 when the operating portion 20 is pressed; and the acting portion that is located between the force application portion 161 and the pivotally supporting portion 91, and transfers a pressing force from the swing portion 160 to the head portion 30 when the swing portion 160 swings in the direction having the component of the one direction described above with the force application portion 161 being pressed.

More specifically, the liquid-agent dispensing container 100 includes: the container body 10 that stores the liquid agent 150; the mounting portion 52 that is mounted on the container body 10; the head portion 30 that is held by the mounting portion 52 so as to be able to move in a top-bottom direction with respect to the mounting portion 52, and allows the liquid agent 150 to pass through the head portion 30 with the head portion 30 being pushed down relatively to the mounting portion 52; the dispensing outlet 41 that discharges the liquid agent 150 that has passed through the head portion 30; the swing portion 160 that is pivotally supported at the pivotally supporting portion 91 in a manner swingable in a direction having a downward component relatively to the mounting portion 52 and a direction opposite to this direction, and has the force application portion 161 that receives a pushing-down force; the operating portion 20 that is pushed down relatively to the mounting portion 52, and has the pushing-down portion 21 that pushes down the force application portion 161 when the operating portion 20 is pushed down; and the acting portion that is located between the force application portion 161 and the pivotally supporting portion 91, and transfers a pushing-down force from the swing portion 160 to the head portion 30 when the swing portion 160 swings in a direction having the downward component with the force application portion 161 being pushed down.

With this configuration, it is possible to press (for example, push down) the head portion using the principle of leverage.

Even in the case of a liquid-agent dispensing container 100 of the type in which a relatively large amount of liquid agent 150 is discharged per one discharging operation, it is possible to press (for example, push down) the operating portion 20 with a sufficiently light force to push in (for example, push down) the head portion 30.

Furthermore, in the case of the liquid-agent dispensing container 100 of the type in which the foam body of the liquid agent 150 is discharged as in this exemplary embodiment, a larger pressure is necessary to press the head portion 30 to discharge the liquid agent 150 as compared with that of a liquid-agent dispensing container of the type in which the liquid agent 150 is discharged directly as it is. However, it is possible to press (for example, push down) the operating portion 20 with a sufficiently light force to push in (for example, push down) the head portion 30.

In addition, even in the case where the viscosity of the liquid agent 150 is higher than that of a standard one, it is possible to press (for example, push down) the operating portion 20 with a sufficiently light force to push in (push down) the head portion 30.

Furthermore, the liquid-agent dispensing container 100 further includes a guide mechanism that guides a relative movement of the operating portion 20 with respect to the head portion 30 while maintaining the posture of the operating portion 20 when the operating portion 20 is pressed.

More specifically, the liquid-agent dispensing container 100 further includes a guide mechanism that guides a relative movement of the operating portion 20 with respect to the head portion 30 while maintaining the posture of the operating portion 20 when the operating portion 20 is pushed down.

With this configuration, it is possible to reduce a change in posture of the operating portion 20 when the operating portion 20 is pressed (for example, is pushed down), whereby it is possible to achieve the operational feeling close to a liquid-agent dispensing container of the type in which the head portion 30 is directly pushed down.

Furthermore, at least a part of the head portion 30 is covered with the operating portion 20 when the liquid-agent dispensing container 100 is viewed in the one direction described above (more specifically, at least a part of the head portion 30 is covered with the operating portion 20 in plan view).

In other words, the head portion 30 is disposed at a position on the pressing direction side of the operation unit 20 by the user with respect to the operation unit 20, and at a position on the pressing direction side of the head portion 30 with respect to the mounting unit 52. Thus, it is possible to efficiently transfer a pressing force, which is applied to the operating portion 20, to the head portion 30 through the swing portion 160, thereby pressing the head portion 30 on the mounting portion 52 side, and to suppress the liquid-agent dispensing container 100 from shaking at the time of pressing operations, whereby it is possible to stably perform the pressing operation.

For example, in the case where the operating portion 20 is pressed (pushed down) in a state where the liquid-agent dispensing container 100 is placed on a horizontal mounting surface, it is possible to suppress the container body 10 from falling over. In addition, it is possible to suppress each portion of the liquid-agent dispensing container 100 from bending, deforming and shaking, regardless of the position (direction) of the liquid-agent dispensing container 100 in use, and hence, it is possible to efficiently transfer a pressing force to the head portion 30.

In addition, since the operating portion 20 and the head portion 30 are arranged alongside each other in the one direction described above, it is possible to configure the liquid-agent dispensing container 100 in a compact manner.

More specifically, since the guide mechanism guides the operating portion 20 in the one direction described above and the direction opposite to the one direction described above relatively to the head portion 30, it is possible to maintain the posture of the operating portion 20 constant when the operating portion 20 is pressed.

Yet more specifically, since the guide mechanism guides the operating portion 20 in the top-bottom direction relatively to the head portion 30, it is possible to maintain the posture of the operating portion 20 constant when the operating portion 20 is pushed down. Thus, it is possible to achieve the operational feeling equivalent to a liquid-agent dispensing container of the type in which the head portion 30 is directly pushed down.

In addition, the operating portion 20 is disposed above the container body 10, and at least a part of the operating portion 20 overlaps with the container body 10 in plan view. This configuration makes it possible to suppress the container body 10 from falling over when the operating portion 20 is pushed down in a state where the liquid-agent dispensing container 100 is placed on a horizontal mounting surface, and hence, it is possible to easily perform the pushing-down operation. More specifically, the operation receiving portion 25 of the operating portion 20 is located and is sized such that the entire operation receiving portion 25 of the operating portion 20 is included in the bottom portion 14 of the container body 10 in plan view. This makes it possible to suppress the container body 10 from falling over even if a pushing-down force is applied to any portion of the operation receiving portion 25.

In addition, the guide mechanism includes the guiding portion 38 that the head portion 30 has, and the guided portion 24 that the operating portion 20 has, the guided portion 24 being guided by the guiding portion 38. This makes it possible to configure the liquid-agent dispensing container 100 in a more compact manner, and to efficiently transfer a pressing force from the operating portion 20 to the head portion 30 through the swing portion 160 while further suppressing each portion of the liquid-agent dispensing container 100 from bending, deforming, and shaking. This makes it possible to suppress the fall of the container body 10 more suitably.

Furthermore, the liquid-agent dispensing container 100 includes the second mounting portion 170 that is mounted detachably on the mounting portion 52, and the swing portion 160 is pivotally supported at the pivotally supporting portion 91 by the second mounting portion 170.

Since the second mounting portion 170 that pivotally supports the swing portion 160 is detachable with respect to the mounting portion 52, the second mounting portion 170 of the liquid-agent dispensing container 100 can be manufactured separately from other elements of the liquid-agent dispensing container 100, and hence, it is possible to improve manufacturability of the liquid-agent dispensing container 100.

Furthermore, the head portion 30 includes the tubular portion (external tubular portion 32) that has the shaft center extending in the one direction described above. The swing portion 160 is formed into an annular shape that surrounds the tubular portion when the liquid-agent dispensing container 100 is viewed in the one direction described above. The liquid-agent dispensing container 100 includes a pair of acting portions that are spaced apart from each other in the axial direction of the pivotally supporting portion 91. Thus, with the pair of acting portions, it is possible to stably transfer the pressing force from the swing portion 160 to the head portion 30 in a well-balanced manner.

Furthermore, when the liquid-agent dispensing container 100 is viewed in the axial direction of the pivotally supporting portion 91, the swing portion 160 includes: the first portion 162 that extends from the pivotally supporting portion 91 toward the force application portion 161 side and in a direction having a component of the direction opposite to the one direction described above; and the second portion 163 that extends from the end portion of the first portion 162 on the force application portion 161 side toward the force application portion 161, and the swing portion 160 is bent at the boundary portion 165 between the first portion 162 and the second portion 163 convexly toward the direction opposite to the one direction described above. With this configuration, when the force that pushes back the swing portion 160 in the one direction described above is transferred from the head portion 30 to the swing portion 160 after the operating portion 20 and the head portion 30 are pressed, this force can be smoothly transferred.

Second Exemplary Embodiment

Next, a second exemplary embodiment will be described with reference to FIGS. 11 to 14.

The liquid-agent dispensing cap 50 according to this exemplary embodiment differs from the liquid-agent dispensing cap 50 according to the first exemplary embodiment described above in the points described below, and in other points, is configured similarly to the liquid-agent dispensing cap 50 according to the first exemplary embodiment.

The states illustrated in the drawings from FIG. 11 to FIG. 14 each show a state (normal state) at the normal time where neither the operating portion 20 nor the head portion 30 is pushed down.

Figure 11:
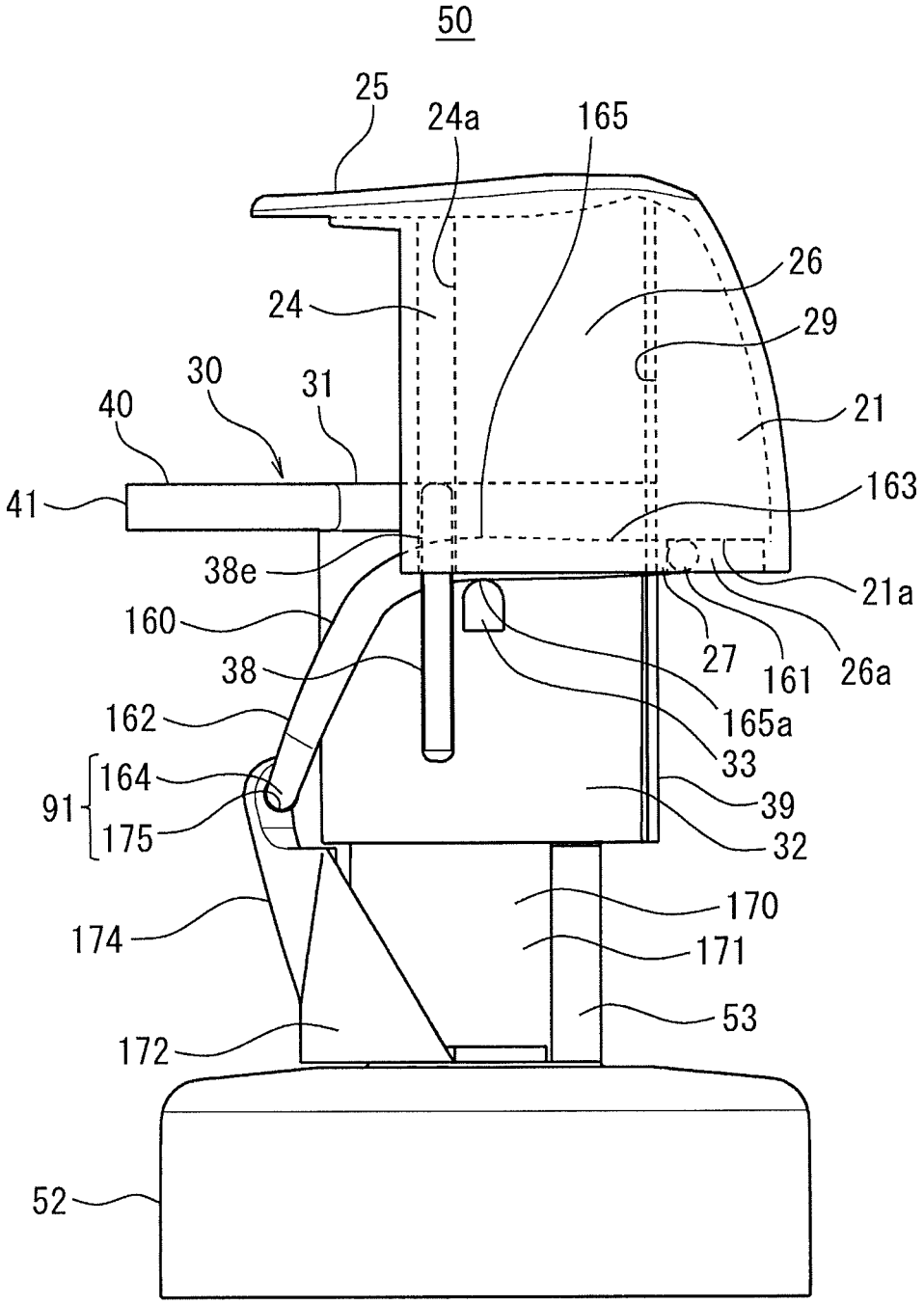
FIG. 11 is a side view illustrating the upper portion of a liquid-agent dispensing cap according to a second exemplary embodiment.
Figure 14:
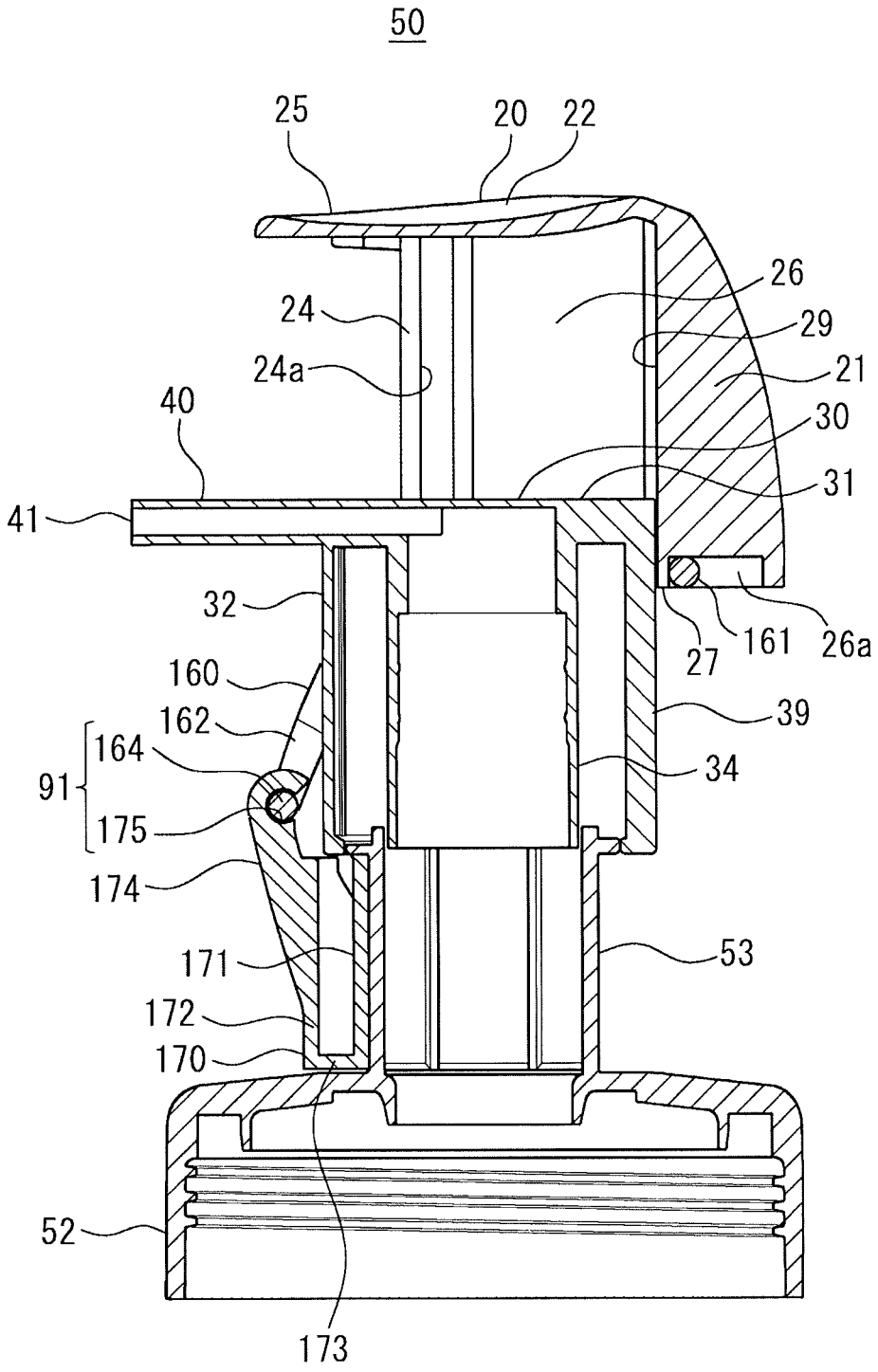
FIG. 14 is a sectional view illustrating the upper portion of the liquid-agent dispensing cap according to the second exemplary embodiment as viewed from the side.

The left direction in FIGS. 11 and 14 is defined as the forward direction, and the right direction in FIGS. 11 and 14 is defined as the backward direction. The back side direction of the paper surface of FIGS. 11 and 14 is defined as the left, and the front side direction of the paper surface of FIGS. 11 and 14 is defined as the right.

In the case of this exemplary embodiment, the pushing-down portion 21 is erected from the front surface of the rear wall of the cover portion 26 toward the front, and the pushing-down portion 21 is disposed inside of the cover portion 26. In addition, the lower surface 21*a* of the pushing-down portion 21 and the force application portion 161 are disposed inside of the bottom end portion 26*a* of the cover portion 26, and the force application portion 161 and the lower surface 21*a* are covered with the bottom end portion 26*a* of the cover portion 26 when viewed from the side.

That is, the operating portion 20 includes a point-of-force-application covering portion (the bottom end portion 26*a* of the cover portion 26) that covers the force application portion 161 from the side direction.

In other words, the operating portion 20 includes the point-of-force-application covering portion (the bottom end portion 26*a* of the cover portion 26) that covers the force application portion 161 when the liquid-agent dispensing container 100 is viewed in the axial direction of the pivotally supporting portion 91.

Thereby, it is suppressed that a finger is caught between the pushing-down portion 21 and the force application portion 161 and the like.

Furthermore, the second portion 163 of the swing portion 160 is disposed inside of the bottom end portion 26*a* of the cover portion 26.

In addition, the cover portion 26 is formed, for example, into a bottom-widened shape in which the inner space area thereof widens toward the bottom. This enables the force application portion 161 and the second portion 163 to be easily covered with the bottom end portion 26*a* of the cover portion 26.

Furthermore, in the case of this exemplary embodiment, the projection portion 33 projects in the side direction from the tubular outer peripheral surface of the external tubular portion 32.

Figure 12:
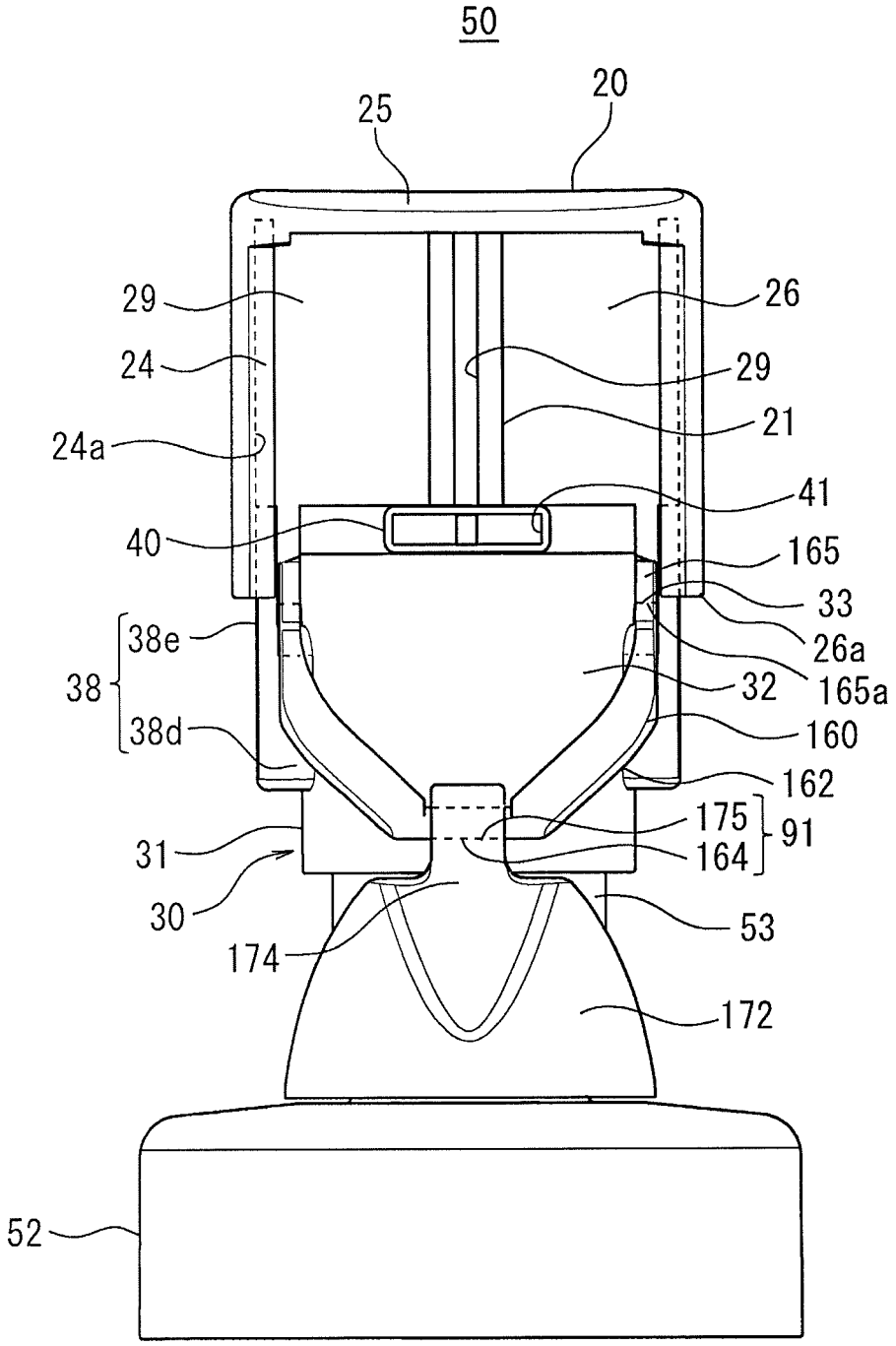
FIG. 12 is a front view illustrating the upper portion of the liquid-agent dispensing cap according to the second exemplary embodiment.
Figure 13:
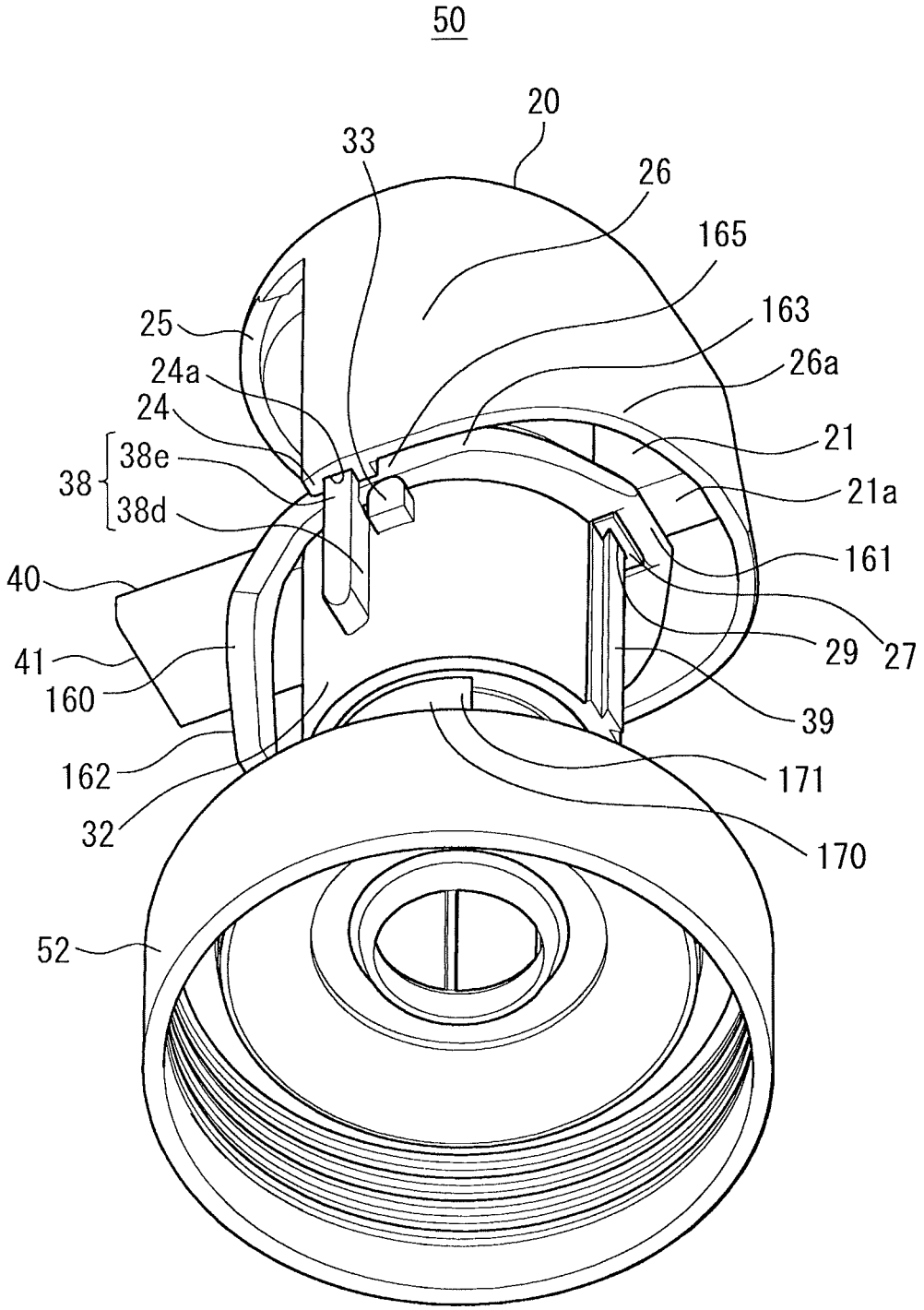
FIG. 13 is a perspective view illustrating the upper portion of the liquid-agent dispensing cap according to the second exemplary embodiment as viewed obliquely from a rear lower side.

In addition, the guiding portion 38 is disposed on the frontward side of the projection portion 33. In the case of this exemplary embodiment, as illustrated in FIGS. 12 and 13, the guiding portion 38 is configured to include: a guiding pillar 38*e* that extends linearly in the top-bottom direction at the side of the external tubular portion 32; and a supporting portion 38*d* that supports the guiding pillar 38*e* formed on the side surface of the external tubular portion 32. The supporting portion 38*d* supports the lower portion of the guiding pillar 38*e*, and the guiding pillar 38*e* projects higher than the upper end of the supporting portion 38*d*. The vertical position of the bottom end of the guiding pillar 38*e* is, for example, equal to that of the bottom end of the supporting portion 38*d*.

The supporting portion 38*d* also functions as a spacer that provides a certain space between the upper portion of the guiding pillar 38*e* and the side surface of the external tubular portion 32, and as illustrated in FIG. 12, through this space between the upper portion of the guiding pillar 38*e* and the side surface of the external tubular portion 32, both of the left and right side portions of the swing portion 160 are inserted from the frontward side to the backward side.

In addition, in the case of this exemplary embodiment, the guided portion 24 is comprised of one guided groove 24*a* that extends linearly in the top-bottom direction. The bottom end of the guided groove 24*a* reaches the bottom end of the cover portion 26.

The guiding pillar 38*e* is inserted into the guided groove 24*a* to cause the guided portion 24 to engage with the guiding portion 38, so that the guided portion 24 can slide in the top-bottom direction along the guiding pillar 38*e* of the guiding portion 38.

In addition, in the case of this exemplary embodiment as well, the liquid-agent dispensing cap 50 includes a pair of left and right guiding portions 38 and a pair of left and right guided portions 24.

Furthermore, a second guiding portion 39 is formed on the rear face of the external tubular portion 32 of the head portion 30, and a second guided portion 29 that is guided by the second guiding portion 39 in the top-bottom direction is formed on the front face of the pushing-down portion 21.

More specifically, the second guided portion 29 is formed in a dovetail-mortise shape extending linearly in the top-bottom direction (a groove shape having a wider width in the deeper portion of the groove). The second guiding portion 39 is a rib (rib with a dovetail-tenon shape) that is formed into a shape that is fitted into the second guided portion 29 and extends linearly in the top-bottom direction.

The second guiding portion 39 is fitted to the second guided portion 29, and the second guided portion 29 can slide along the second guiding portion 39 in the top-bottom direction.

In addition, on the frontward side of the lower surface 21*a* of the pushing-down portion 21, a forward-movement restricting portion 27 extending below the lower surface 21*a* is formed integrally with the pushing-down portion 21. This forward-movement restricting portion 27 restricts the movement of the force application portion 161 in the forward direction. Moreover, the second guided portion 29 reaches the bottom end of the forward-movement restricting portion 27.

The liquid-agent dispensing container according to this exemplary embodiment is configured to include the liquid-agent dispensing cap 50 according to this exemplary embodiment, and the container body 10 (see FIG. 1) similar to that in the first exemplary embodiment described above, although entire illustration thereof is not given.

Furthermore, the liquid-agent dispensing container product according to this exemplary embodiment is configured to include the liquid-agent dispensing container according to this exemplary embodiment and the liquid agent filled in the container body 10, although entire illustration thereof is not given.

In the case of this exemplary embodiment, not only the pair of left and right guided portions 24 being guided in the top-bottom direction by the pair of left and right guiding portions 38, respectively, but also the second guided portion 29 is guided in the top-bottom direction by the second guiding portion 39. Thus, it is possible to more stably guide the operating portion 20 in the top-bottom direction.

According to this exemplary embodiment, it is possible to obtain effects similar to those in the first exemplary embodiment.

Third Exemplary Embodiment

Next, a third exemplary embodiment will be described with reference to FIG. 15. The liquid-agent dispensing cap 50 according to this exemplary embodiment differs from the liquid-agent dispensing cap 50 according to the first exemplary embodiment in the points described below. In addition, explanation will not be repeated of a configuration of the liquid-agent dispensing cap 50 according to this exemplary embodiment similar to that of the liquid-agent dispensing cap 50 according to the first exemplary embodiment described above, as appropriate.

In the case of this exemplary embodiment, the liquid-agent dispensing cap 50 does not include the second mounting portion 170. Instead, the liquid-agent dispensing cap 50 includes a pair of left and right pillar-shaped supporting portions 54 (the supporting portion 54 on the right side is not illustrated) that stand upright from the upper surface of the front portion of the mounting portion 52.

Furthermore, the liquid-agent dispensing cap 50 does not include the swing portion 160 (FIG. 3). Instead, the liquid-agent dispensing cap 50 includes a pair of left and right swing portions 60 (the swing portion 60 on the right side is not illustrated).

The one end portion of the swing portion 60 on the left side is pivotally supported at the pivotally supporting portion 91 by the supporting portion 54 on the left side. Similarly, the one end portion of the swing portion 60 on the right side is pivotally supported at the pivotally supporting portion 91 (the pivotally supporting portion 91 on the right side is not illustrated) by the supporting portion 54 on the right side. The left and right pivotally supporting portions 91 are disposed coaxially with each other.

There is no specific limitation as to the detailed structure of the pivotally supporting portion 91. However, for example, a pivotally supporting pin is inserted into a round hole formed in each of the supporting portion 54 and the swing portion 60, whereby the swing portions 60 are pivotally supported by the supporting portions 54.

Furthermore, in the case of this exemplary embodiment, the operating portion 20 includes the flat plate-like operation receiving portion 25, and a pair of left and right supporting pillar portions 70 that are fixed at the left and right end portions of the operation receiving portion 25, respectively, and each extend downward from the operation receiving portion 25 (the supporting pillar portion 70 on the right side is not illustrated).

The other end portion of the swing portion 60 on the left side is pivotally supported at a second pivotally supporting portion 92 by the one end portion of the supporting pillar portion 70 on the left side. Here, the second pivotally supporting portion 92 includes, for example, a pivotally supporting pin 76 formed on a first portion 71, which will be described later, of the supporting pillar portion 70, and a pivotally supporting hole 161*a* that is formed in a second portion 62, which will be described later, of the swing portion 60. The pivotally supporting pin 76 is inserted into the pivotally supporting hole 161*a*, whereby the swing portion 60 is pivotally supported by the supporting pillar portion 70.

Similarly, the other end portion of the swing portion 60 on the right side is pivotally supported at the second pivotally supporting portion 92 by the one end portion of the supporting pillar portion 70 on the right side (the second pivotally supporting portion 92 on the right side is not illustrated).

The left and right second pivotally supporting portions 92 are disposed coaxially with each other. In addition, the pivotally supporting portion 91 and the second pivotally supporting portion 92 are disposed so as to be parallel to each other.

The pivotally supporting portion 91 and the second pivotally supporting portion 92 are each disposed, for example, horizontally in a state where the liquid-agent dispensing cap 50 is mounted on the container body 10 and the container body 10 is placed on a horizontal mounting surface.

Here, the swing portion 60 is formed, for example, into a rod shape. More specifically, for example, the swing portion 60 is configured to include the first portion 61 and the second portion 62, each of which is formed into a rod shape.

The one end portion of the first portion 61 is pivotally supported at the pivotally supporting portion 91 by the supporting portion 54, and the other end portion of the first portion 61 is connected to the one end portion of the second portion 62. The other end portion of the second portion 62 is pivotally supported at the second pivotally supporting portion 92 by the supporting pillar portion 70.

In the case of this exemplary embodiment, the force application portion 161 is comprised of the other end portion of the second portion 62, and the pivotally supporting hole 161*a* is formed in the force application portion 161. In addition, the pushing-down portion of the operating portion 20 is comprised of the pivotally supporting pin 76 formed at the bottom end portion of the first portion 71. That is, the force application portion 161 is pivotally supported by the pressing portion (pushing-down portion) (pivotally supporting pin 76) in a manner such that the swing portion 60 can swing relatively to the operating portion 20.

Each of the first portion 61 and the second portion 62 extends in a plane perpendicular to the pivotally supporting portion 91 and the second pivotally supporting portion 92.

In the normal state, the swing portion 60 has a posture in which it extends backward and obliquely upward toward the second pivotally supporting portion 92 with the pivotally supporting portion 91 being the starting point.

On the other hand, in the pushed-down state, the second pivotally supporting portion 92 is pushed down, and for example, the swing portion 60 has a posture in which it extends backward with the pivotally supporting portion 91 being the starting point.

In the case of this exemplary embodiment, the acting portion is configured to include an acting surface 63 that is formed on the lower surface of the swing portion 60 between the pivotally supporting portion 91 and the second pivotally supporting portion 92, and the projection portion 33 that projects in the side direction from the side surface of the external tubular portion 32. The liquid-agent dispensing cap 50 includes a pair of left and right acting portions.

Each of the acting surfaces 63 is placed on the corresponding projection portion 33, and pushes down the projection portion 33 as the swing portion 60 swings in a direction in which the second pivotally supporting portion 92 descends with the pivotally supporting portion 91 being the fulcrum. At this time, the acting surface 63 slides with respect to the projection portion 33.

The acting surface 63 is formed into a curved shape such that a portion of the acting surface 63 that is in contact with the projection portion 33 is perpendicular (for example, horizontal) to a direction (for example, downward) in which the head portion 30 moves with respect to the mounting portion 52 at the time when the swing angle of the swing portion 60 falls in a first angle (for example, the normal state) and at the time when the swing angle falls in a second angle that is different from the first angle (a state of being closer to the pushed-down state than the normal state and being closer to the normal state closer than the pushed-down state (not illustrated)).

With this configuration, it is possible to reduce a loss of force that is transferred from the swing portion 60 to the head portion 30, and hence, it is possible to reduce a force necessary to push down the operating portion 20.

More preferably, the acting surface 63 is always brought into contact with the projection portion 33 with the horizontal plane.

Furthermore, the supporting pillar portion 70 is configured to include, for example, a first portion 71 having a rod shape, and a second portion 72 that extends in a direction intersecting the first portion 71. Each of the first portion 71 and the second portion 72 extends in a plane perpendicular to the second pivotally supporting portion 92. The first portion 71 and the second portion 72 intersect in a V shape when viewed from the side.

The other end portion of the second portion 62 of each of the swing portions 60 is pivotally supported at the second pivotally supporting portion 92 by the one end portion (for example, the bottom end portion) of the first portion 71, which is the one end portion (for example, the bottom end portion) of each of the supporting pillar portions 70.

The first portion 71 and the second portion 72 share the one end portion with each other.

In addition, the other end portion of the second portion 72 is disposed at a position deviating from the line in which the first portion 71 extends. More specifically, the other end portion of the second portion 72 is disposed on the lower side of the straight line passing through both ends of the first portion 71.

Furthermore, the other end portion of the first portion 71, which is the other end portion of each of the supporting pillar portions 70, is fixed at the fixing portion 95 to the side portion of the operation receiving portion 25. Thus, the operation receiving portion 25 is provided integrally with the supporting pillar portion 70.

For example, a protrusion having a not-circular shape in cross section (for example, D-cut shape) projects in the side direction from each of the left and right side portions of the operating portion 20. These protrusions are each fitted into an insertion hole having a not-circular shape in cross section (for example, D-cut shape) and formed in the other end portion of the first portion 71, whereby the operating portion 20 and the first portion 71 are fixed to each other.

In the case of this exemplary embodiment, the guide mechanism is configured to include: a guiding groove (guiding portion) 111 that is formed in the side surface of the head portion 30; and a guided projection (guided portion) 73 that is formed on the other end portion of the second portion 72 of the supporting pillar portion 70.

More specifically, the liquid-agent dispensing cap 50 includes a pair of left and right guide mechanisms (the guide mechanism on the right side is not illustrated) corresponding to each of the supporting pillar portions 70.

The guide mechanism on the left side is configured to include: the guiding groove 111 that is formed in the left side surface of the head main body portion 31; and the guided projection 73 that projects toward the right direction from the other end portion of the second portion 72 of the supporting pillar portion 70 on the left side.

Similarly, the guide mechanism on the right side is configured to include: the guiding groove 111 that is formed in the right side surface of the head main body portion 31; and the guided projection 73 that projects toward the left direction from the other end portion of the second portion 72 of the supporting pillar portion 70 on the right side.

Each of the guiding grooves 111 is sloped downward toward the backward direction, and is formed into an arc shape (for example, spiral arc shape) convexly toward the backward and obliquely upward direction. In addition, each of the guiding grooves 111 extends within a plane perpendicular to the pivotally supporting portion 91 and the second pivotally supporting portion 92.

A corresponding guided projection 73 is fitted into each of the guiding grooves 111. Each of the guided projections 73 is guided by the corresponding guiding groove 111 when the operating portion 20 is pushed down, and slides along this guiding groove 111. Thus, in the case of this exemplary embodiment, the guide mechanism guides the operating portion 20 in a path having an arc shape.

In addition, contrary to the example described here, it may be possible that the guiding groove 111 is formed in the supporting pillar portion 70 and the guided projection 73 is formed on the head main body portion 31.

Here, in the normal state, the one end portion of the swing portion 60 is supported by the pivotally supporting portion 91 and the swing portion 60 is supported by the protruding portion 33 on the acting surface 63, whereby the posture of the swing portion 60 is maintained constant (posture in which it extends in the backward and obliquely upward direction toward the second pivotally supporting portion 92 with the pivotally supporting portion 91 being the starting point).

In addition, in the normal state, the one end portion of the supporting pillar portion 70 is supported at the second pivotally supporting portion 92 by the swing portion 60, and the guided projection 73 is supported by the guiding groove 111, whereby the posture of the supporting pillar portion 70 is maintained constant. More specifically, the first portion 71 has a posture in which it extends in the forward and obliquely upward direction toward the fixing portion 95 with the second pivotally supporting portion 92 being the starting point. In addition, the second portion 72 has a posture in which it is closer to the horizontal posture than the posture of the first portion 71, and extends in the forward and obliquely upward direction with the second pivotally supporting portion 92 being the starting point.

As the operating portion 20 is pushed down, the supporting pillar portion 70 moves downward integrally with the operating portion 20. At this time, the second pivotally supporting portion 92 moves downward in an arc manner with the pivotally supporting portion 91 being the center thereof, and the guided projection 73 is guided downward in an arc manner (in the spiral arc shape) along the guiding groove 111.

Figure 15:
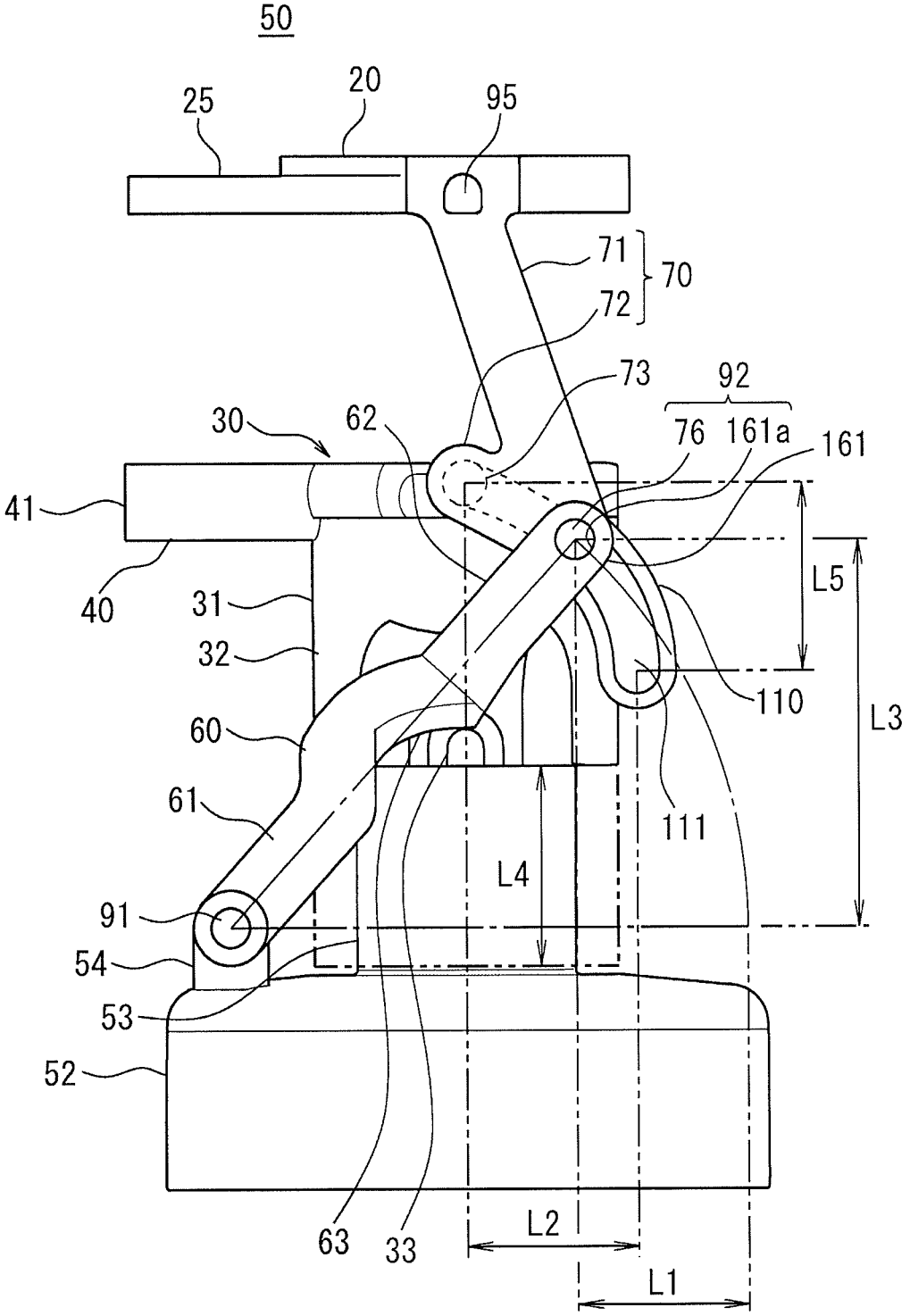
FIG. 15 is a side view illustrating the upper portion of a liquid-agent dispensing cap according to a third exemplary embodiment.

Thus, when the operating portion 20 is pushed down, the swing portion 60 swings relatively to the mounting portion 52 with the pivotally supporting portion 91 being the fulcrum (swings clockwise in FIG. 15).

Here, the shape of the guiding portion (guiding groove 111) is set such that the inclination angle of the supporting pillar portion 70 is maintained so as to be constant when the operating portion 20 is pushed down.

More specifically, for example, the axis of the pivotally supporting portion 91 and the axis of the second pivotally supporting portion 92 are disposed so as to be horizontal and parallel to each other as described above; and the shape of the guiding portion (guiding groove 111) is set, such that: when the operating portion 20 is pushed down, the travel distance L1 (FIG. 15) of the second pivotally supporting portion 92 in the horizontal direction is equal to the travel distance L2 (FIG. 15) of the guided portion (guided projection 73) in the horizontal direction; and the travel distance L3 (FIG. 15) of the second pivotally supporting portion 92 in the downward direction is equal to the sum of the travel distance L4 (FIG. 15) of the head portion 30 in the downward direction and the travel distance L5 (FIG. 15) of the guided portion in the downward direction relative to the guiding portion.

When the operating portion 20 is pushed down, the swing portion 60 swings clockwise relatively to the mounting portion 52 with the pivotally supporting portion 91 being the fulcrum, whereas the supporting pillar portion 70 swings counterclockwise relatively to the swing portion 60 with the second pivotally supporting portion 92 being the fulcrum.

In other words, when the operating portion 20 is pushed down, the guide mechanism restricts the direction of the supporting pillar portion 70 swinging relatively to the swing portion 60, to the direction in which a change in posture of the operating portion 20 due to the swing portion 60 swinging with respect to the mounting portion 52 is canceled out.

However, when the operating portion 20 is pushed down, the supporting pillar portion 70 moves relatively downward without swinging with respect to the mounting portion 52.

The guiding groove 111 may be formed on the side portion of the external tubular portion 32. In the case of this exemplary embodiment, however, the head main body portion 31 has a guide forming portion 110 integrally formed with the external tubular portion 32, the guide forming portion 110 having a shape protruding to the left and right sides from the external tubular portion 32 and protruding rearward from the external tubular portion 32, and the guiding groove 111 is formed in the side surface of the guide formation portion 110.

The guide formation portion 110 is formed into the arc shape (spiral arc shape) when viewed from the side. The guiding groove 111 extends along the direction in which the guide formation portion 110 extends, when viewed from the side.

In the case of this exemplary embodiment, the liquid-agent dispensing cap 50 is also formed, for example, so as to be right-and-left symmetry.

The liquid-agent dispensing container according to this exemplary embodiment is configured to include the liquid-agent dispensing cap 50 according to this exemplary embodiment and the container body 10 (see FIG. 1) similar to that in the first exemplary embodiment, although entire illustration thereof is not given.

In addition, the liquid-agent dispensing container product according to this exemplary embodiment is configured to include the liquid-agent dispensing container according to this exemplary embodiment and a liquid agent filled in the container body 10, although entire illustration thereof is not given.

Here, the liquid-agent dispensing container 100 according to this exemplary embodiment may also be defined in the following manner. That is, the liquid-agent dispensing container 100 including the container body 10 that stores the liquid agent 150, includes: the mounting portion 52 that is mounted on the container body 10; the head portion 30 that is held by the mounting portion 52 movably with respect to the mounting portion 52 in one direction and a direction opposite to the one direction described above, and allows the liquid agent 150 to pass through the head portion 30 with the head portion 30 being pressed in the one direction described above relatively to the mounting portion 52; the dispensing outlet 41 that discharges the liquid agent 150 that has passed through the head portion 30; the swing portion 60 that is pivotally supported at the pivotally supporting portion 91 in a swingable manner relatively to the mounting portion 52 in a direction having the component of the one direction described above and the direction opposite to this direction, and has the force application portion 161 that receives a pressing force; the operating portion 20 that is pressed relatively to the mounting portion 52 with an operation made by a user, and has the pressing portion (pivotally supporting pin 76) that presses the force application portion 161 when the operating portion 20 is pressed; the acting portion (the acting surface 63 and the projection portion 33) that is located between the force application portion 161 and the pivotally supporting portion 91, and transfers a pressing force from the swing portion 60 to the head portion 30 when the swing portion 60 swings in the direction having the component of the one direction described above with the force application portion 161 being pressed; and the guide mechanism (the guiding groove 111 and the guided projection 73) that guides the operating portion 20 in a path having an arc shape, in which the force application portion 161 is pivotally supported by the pressing portion (pivotally supporting pin 76) in a manner such that the swing portion 60 can swing relatively to the operating portion 20.

In addition, the liquid-agent dispensing container 100 according to this exemplary embodiment may also be defined in the following manner. That is, the liquid-agent dispensing container 100 includes: the container body 10 that stores the liquid agent 150; the mounting portion 52 that is mounted on the container body 10; the head portion 30 that is held by the mounting portion 52 so as to be able to move in a top-bottom direction with respect to the mounting portion 52, and allows the liquid agent 150 to pass through the head portion 30 with the head portion 30 being pushed down relatively to the mounting portion 52; the dispensing outlet 41 that discharges the liquid agent 150 that has passed through the head portion 30; the swing portion 60 that is pivotally supported at the pivotally supporting portion 91 in a manner swingable in a direction having a downward component relatively to the mounting portion 52 and a direction opposite to this direction, and has the force application portion 161 that receives a pushing-down force; the operating portion 20 that is pushed down relatively to the mounting portion 52, and has the pushing-down portion (pivotally supporting pin 76) that pushes down the force application portion 161 when the operating portion 20 is pushed down; the acting portion (the acting surface 63 and the projection portion 33) that is located between the force application portion 161 and the pivotally supporting portion 91, and transfers a pushing-down force from the swing portion 60 to the head portion 30 when the swing portion 60 swings in a direction having the downward component with the force application portion 161 being pushed down; and the guide mechanism (the guiding groove 111 and the guided projection 73) that guides the operating portion 20 in a path having an arc shape, in which the force application portion 161 is pivotally supported by the pushing-down portion (pivotally supporting pin 76) in a manner such that the swing portion 60 can swing relatively to the operating portion 20.

Next, operations will be described.

In order to discharge the foam body from the liquid-agent dispensing container 100, a push-down operation is performed to the operating portion 20. With this operation, the head portion 30 is pushed down through the swing portion 60. Then, the head portion 30 is pushed down against the urging force of the spring body 58. With the head portion 30 being pushed down, the foam body is discharged from the dispensing outlet 41 of the nozzle portion 40.

Here, when the operating portion 20 is pushed down, the guided projection 73 is guided downward in a spiral arc manner along the guiding groove 111, and the second pivotally supporting portion 92 moves downward in an arc manner with the pivotally supporting portion 91 being the center. Thus, the swing portion 60 swings relatively to the mounting portion 52 (swings clockwise in FIG. 3) with the pivotally supporting portion 91 being the fulcrum. At this time, the projection portion 33 is pushed down with the acting surface 63 of the swing portion 60, and hence, the head portion 30 descends.

At this time, the guiding groove 111 restricts the moving direction of the guided projection 73, whereby the posture of the operating portion 20 is maintained. More specifically, the swinging direction of the supporting pillar portion 70 with respect to the swing portion 60 is restricted in the direction canceling the change in the posture of the operating portion 20 due to the swing of the swing portion 60 with respect to the mounting portion 52. As a result, the inclination angle of the supporting pillar portion 70 is maintained constant, and the operating portion 20 is maintained to be horizontal.

That is, in the case of this exemplary embodiment, the guide mechanism guides the relative movement of the operating portion 20 with respect to the head portion 30 while maintaining the posture of the operating portion 20 when the operating portion 20 is pushed down.

In the case of this exemplary embodiment, it is also possible to use the principle of leverage to push down the head portion, and to achieve the operational feeling close to a liquid-agent dispensing container of the type in which the head portion 30 is directly pushed down.

Furthermore, when the force of pushing down the operating portion 20 is released, the head portion 30 ascends to the position of the normal state due to the urging force of the spring body 58. At this time, the projection portion 33 pushes up the acting surface 63, so that the swing portion 60 swings relatively to the mounting portion 52 (swings counterclockwise in FIG. 3) with the pivotally supporting portion 91 being the fulcrum, and the second pivotally supporting portion 92 moves upward in the arc manner with the pivotally supporting portion 91 being the center. Thus, the operating portion 20 is lifted up. At this time, the guided projection 73 is guided by the guiding groove 111, so that the inclination angle of the supporting pillar portion 70 is maintained constant. Thus, the operating portion 20 returns (moves up) to the position of the normal state while being maintained to be horizontal.

Fourth Exemplary Embodiment

Next, a fourth exemplary embodiment will be described with reference to FIGS. 16(*a*) and 16(*b*).

In this exemplary embodiment, an attachment for a liquid-agent dispenser will be described.

The attachment for a liquid-agent dispenser according to this exemplary embodiment differs from the liquid-agent dispensing cap 50 according to the first exemplary embodiment in the points described below, and in other points, is configured similarly to the liquid-agent dispensing cap 50 according to the first exemplary embodiment.

Figure 16B:
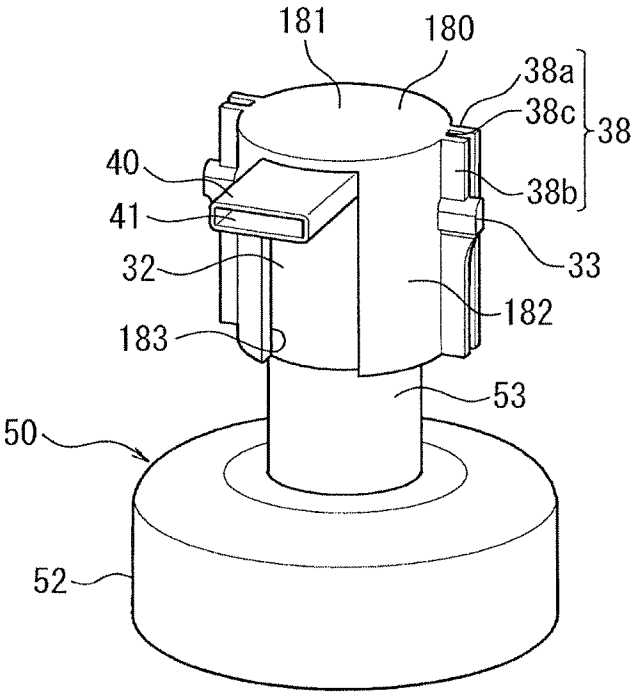
FIGS. 16(*a*) and 16(*b*) are explanatory views each illustrating a head cover portion of an attachment for a liquid-agent dispenser according to a fourth exemplary embodiment.
Figure 16A:
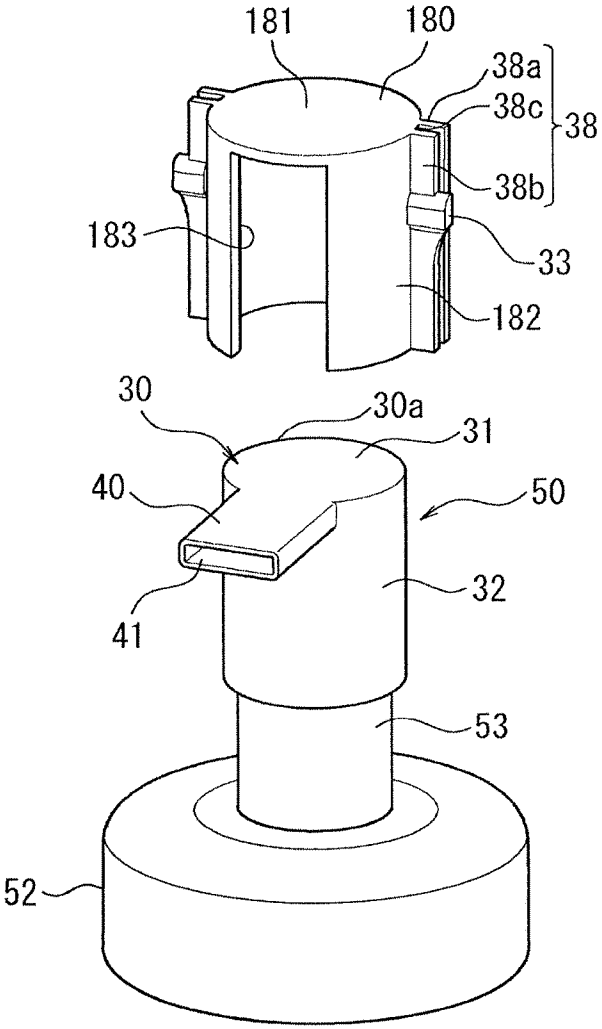

The attachment for a liquid-agent dispenser is configured to include: a head cover portion 180 illustrated in FIGS. 16(*a*) and 16(*b*); the second mounting portion 170 described above (FIG. 7(*a*), FIG. 7(*b*)); the swing portion 160 described above (see FIG. 3); and the operating portion 20 (FIG. 9(*a*), FIG. 9(*b*)).

Here, in the case of this exemplary embodiment, neither the guiding portion 38 nor the projection portion 33 is provided in the head portion 30 of the liquid-agent dispensing cap 50, which is a difference from the head portion 30 of the liquid-agent dispensing cap 50 according to the first exemplary embodiment. The external tubular portion 32 of the head portion 30 is formed into a tubular shape.

The head cover portion 180 is formed into a tubular shape having the inner diameter substantially equal to the outer diameter of the external tubular portion 32 (the outer diameter of the head main body portion 31), and can be mounted on the head portion 30 by putting it over the surrounding of the external tubular portion 32 as illustrated in FIG. 16(*a*).

More specifically, the head cover portion 180 includes: a tubular outer peripheral surface portion 182; and a top surface portion 181 having a disk shape and closing the upper end of the outer peripheral surface portion 182.

A slit 183 is formed in the front portion of the outer peripheral surface portion 182 in order to suppress the outer peripheral surface portion 182 and the nozzle portion 40 from interfering with each other when the head cover portion 180 is mounted on the head portion 30, and to allow the nozzle portion 40 to project in the frontward direction in a state where the head cover portion 180 is mounted. The width size of the slit 183 in the left-right direction is set so as to be equivalent to that of the nozzle portion 40. The axial rotation of the head cover portion 180 relatively to the head portion 30 is restricted by left and right edge portions of the slit 183 of the head cover portion 180.

In addition, in a state where the head cover portion 180 is mounted on the head portion 30, for example, the lower surface of the top surface portion 181 is brought into contact with the upper surface 30*a* of the head portion 30, and the head cover portion 180 is restricted from moving downward relative to the head portion 30.

Furthermore, the projection portion 33 and the guiding portion 38 having the shape equivalent to the guiding portion 38 described in the first exemplary embodiment are formed on each of left and right side surfaces of the outer peripheral surface portion 182 of the head cover portion 180. The guiding portion 38 (the first guiding rib 38*a*, the second guiding rib 38*b*, and the guiding groove 38*c*) extends, for example, in the top-bottom direction from the upper end to the bottom end of the head cover portion 180.

A function similar to that of the liquid-agent dispensing cap 50 according to the first exemplary embodiment can be achieved by: mounting the head cover portion 180 on the external tubular portion 32 as illustrated in FIG. 16(*b*); mounting the second mounting portion 170 on the erected tube 53 as in FIG. 3; causing the bearing portion 175 to pivotally support the shaft portion 164 of the swing portion 160; placing the acting surface 165*a* on the projection portion 33 of the head cover portion 180; and causing the guided portion 24 to be fitted into the guiding portion 38 to cause the lower surface 21*a* of the pushing-down portion 21 of the operating portion 20 to be supported by the force application portion 161 of the swing portion 160.

As described above, the attachment for a liquid-agent dispenser according to this exemplary embodiment provides an attachment for a liquid-agent dispenser used by being mounted on the liquid-agent dispensing cap 50 including: the mounting portion 52 that is mounted on the container body 10 that stores the liquid agent 150; the head portion 30 that is held by the mounting portion 52 movably with respect to the mounting portion 52 in the one direction described above and the direction opposite to the one direction described above, and allows the liquid agent 150 to pass through the head portion 30 with the head portion 30 being pressed in the one direction described above relatively to the mounting portion 52; and the dispensing outlet 41 that discharges the liquid agent 150 that has passed through the head portion 30. In addition, the attachment for a liquid-agent dispenser includes: the second mounting portion 170 that is mounted on the mounting portion 52; the swing portion 160 that is pivotally supported at the pivotally supporting portion 91 in a swingable manner relatively to the second mounting portion 170 in a direction having a component of the one direction described above and the direction opposite to this direction, and has the force application portion 161 that receives a pressing force; the operating portion 20 that is pressed relatively to the second mounting portion 170 with an operation made by a user, and has the pressing portion (pushing-down portion 21) that presses the force application portion 161 when the operating portion 20 is pressed; the head cover portion 180 that is mounted on the head portion 30 in a state where a movement thereof to the one direction described above relatively to the head portion 30 is restricted; the acting portion that is located between the force application portion 161 and the pivotally supporting portion 91, and transfers a pressing force from the swing portion 160 to the head cover portion 180 when the swing portion 160 swings in the direction having the component of the one direction described above with the force application portion 161 being pressed; and the guide mechanism that guides a relative movement of the operating portion 20 with respect to the head cover portion 180 while maintaining a posture of the operating portion 20 when the operating portion 20 is pressed, in which at least a part of the head portion 30 is covered with the operating portion 20 when the attachment for a liquid-agent dispenser is viewed in the one direction described above.

More specifically, the attachment for a liquid-agent dispenser according to this exemplary embodiment provides an attachment for a liquid-agent dispenser used by being mounted on the liquid-agent dispensing cap 50 including: the mounting portion 52 that is mounted on the container body 10 that stores the liquid agent 150; the head portion 30 that is held by the mounting portion 52 so as to be able to move in a top-bottom direction with respect to the mounting portion 52, and allows the liquid agent 150 to pass through the head portion 30 with the head portion 30 being pushed down relatively to the mounting portion 52; and the dispensing outlet 41 that discharges the liquid agent 150 that has passed through the head portion 30, and the attachment for a liquid-agent dispenser includes: the second mounting portion 170 that is mounted on the mounting portion 52; the swing portion 160 that is pivotally supported at the pivotally supporting portion 91 in a manner swingable in a direction having a downward component relatively to the second mounting portion 170 and a direction opposite to this direction, and has the force application portion 161 that receives a pushing-down force; the operating portion 20 that is pushed down relatively to the second mounting portion 170, and has the pushing-down portion 21 that pushes down the force application portion 161 when the operating portion 20 is pushed down; the head cover portion 180 that is mounted on the head portion 30 in a state where a downward movement thereof relatively to the head portion 30 is restricted; the acting portion that is located between the force application portion 161 and the pivotally supporting portion 91, and transfers a pushing-down force from the swing portion 160 to the head portion 30 when the swing portion 160 swings in the direction having the downward component with the force application portion 161 being pushed down; and the guide mechanism that guides a relative movement of the operating portion 20 with respect to the head portion 30 while maintaining a posture of the operating portion 20 when the operating portion 20 is pushed down, in which, in plan view, at least a part of the head portion 30 is covered with the operating portion 20.

The head cover portion 180 may be detachable with respect to the external tubular portion 32, or may be mounted to the external tubular portion 32 in a fixed manner.

According to the fourth exemplary embodiment, it is possible to retrofit, as an attachment, the attachment for a liquid-agent dispenser (the head cover portion 180, the second mounting portion 170, the swing portion 160, and the operating portion 20), into a liquid-agent dispensing cap 50 that has a general structure and does not have the guiding portion 38, the projection portion 33, the second mounting portion 170, the swing portion 160, the operating portion 20 and the like. In addition, by retrofitting the attachment for a liquid dispenser into the liquid-agent dispensing cap 50 having a general structure, it is possible to obtain an effect similar to that in the first exemplary embodiment described above.

Fifth Exemplary Embodiment

Next, a fifth exemplary embodiment will be described with reference to FIGS. 17 to 24.

The liquid-agent dispensing cap 50 according to this exemplary embodiment differs from the liquid-agent dispensing cap 50 according to the first exemplary embodiment described above in the points described below, and in other points, is configured similarly to the liquid-agent dispensing cap 50 according to the first exemplary embodiment described above.

Figure 20:
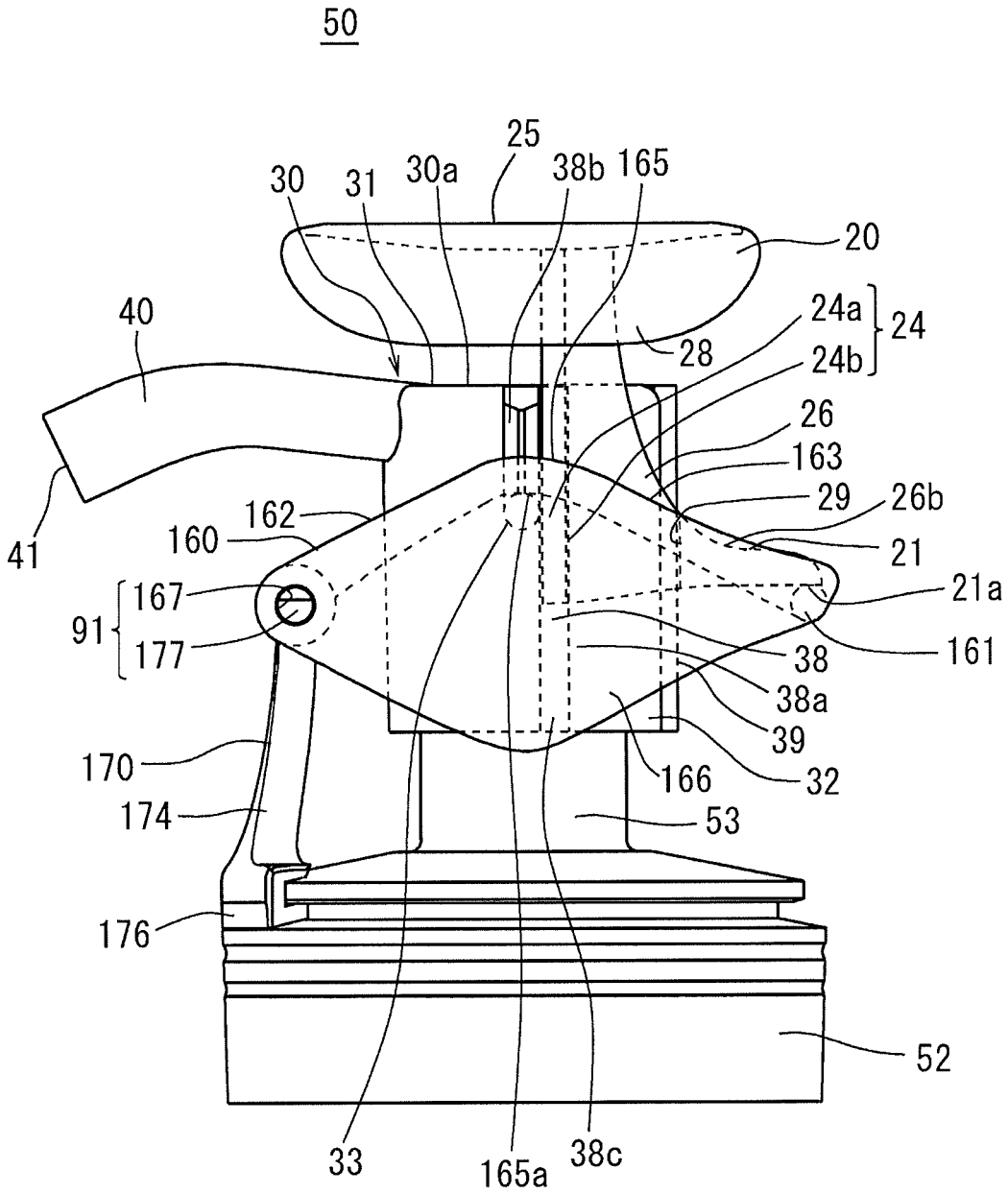
FIG. 20 is a side view illustrating the upper portion of the liquid-agent dispensing cap according to the fifth exemplary embodiment in a state where the operating portion and the head portion are each located between the top dead point and the bottom dead point.
Figure 21:
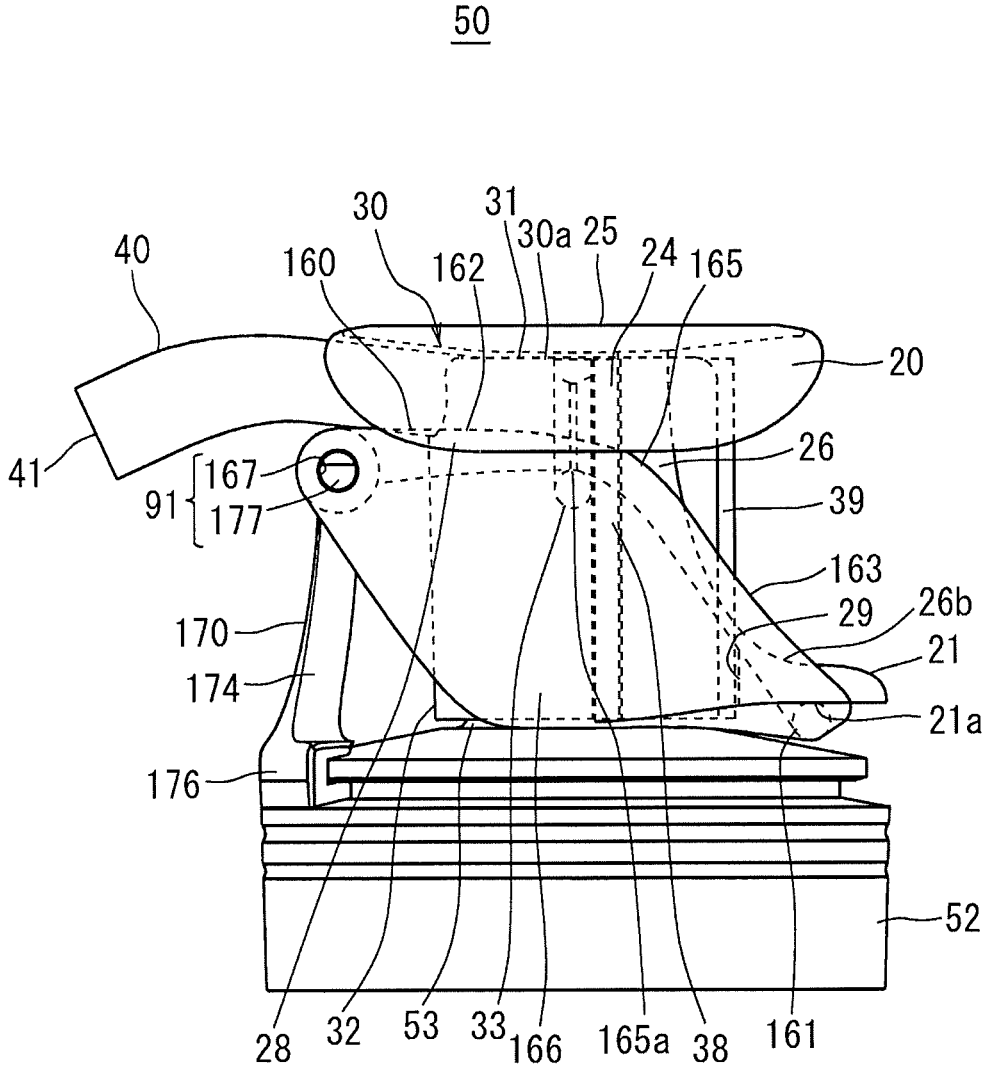
FIG. 21 is a side view illustrating the upper portion of the liquid-agent dispensing cap according to the fifth exemplary embodiment in a state where the operating portion and the head portion are each located at the bottom dead point.
Figure 22:
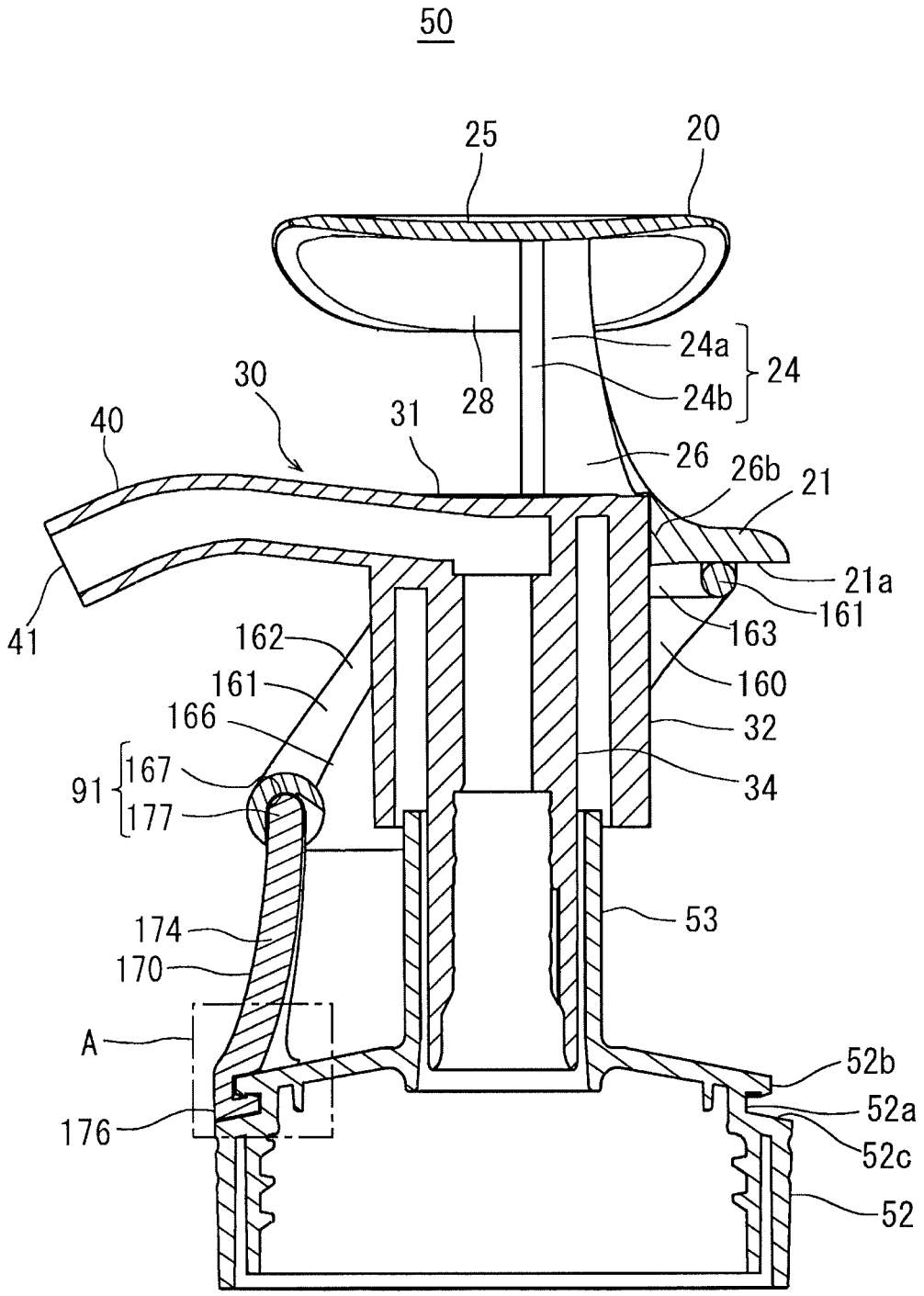
FIG. 22 is a sectional view, as viewed from the side, illustrating the upper portion of the liquid-agent dispensing cap according to the fifth exemplary embodiment in a state where the operating portion and the head portion are each located at the top dead point.

The states illustrated in the drawings of FIGS. 11 to 19, FIG. 22, and FIG. 24 each show the state of normal time (normal state) where neither the operating portion 20 nor the head portion 30 is pushed down, that is, a state where the operating portion 20 and the head portion 30 are each located at the top dead point. Furthermore, the state illustrated in FIG. 21 shows a state where the operating portion 20 and the head portion 30 are pushed down to the lower limit position, that is, a state where the operating portion 20 and the head portion 30 are each located at the bottom dead point. In addition, the state illustrated in FIG. 20 shows a state where the operating portion 20 and the head portion 30 are each located between the top dead point and the bottom dead point.

The left direction in FIGS. 18 to 23 is defined as the forward direction, and the right direction in FIGS. 18 to 23 is defined as the backward direction. The upward direction in FIG. 18 and the back side direction of the paper surface of FIGS. 19 to 23 are defined as the left, and the downward direction in FIG. 18 and the front side direction of the paper surface of FIGS. 19 to 23 are defined as the right.

Figure 18:
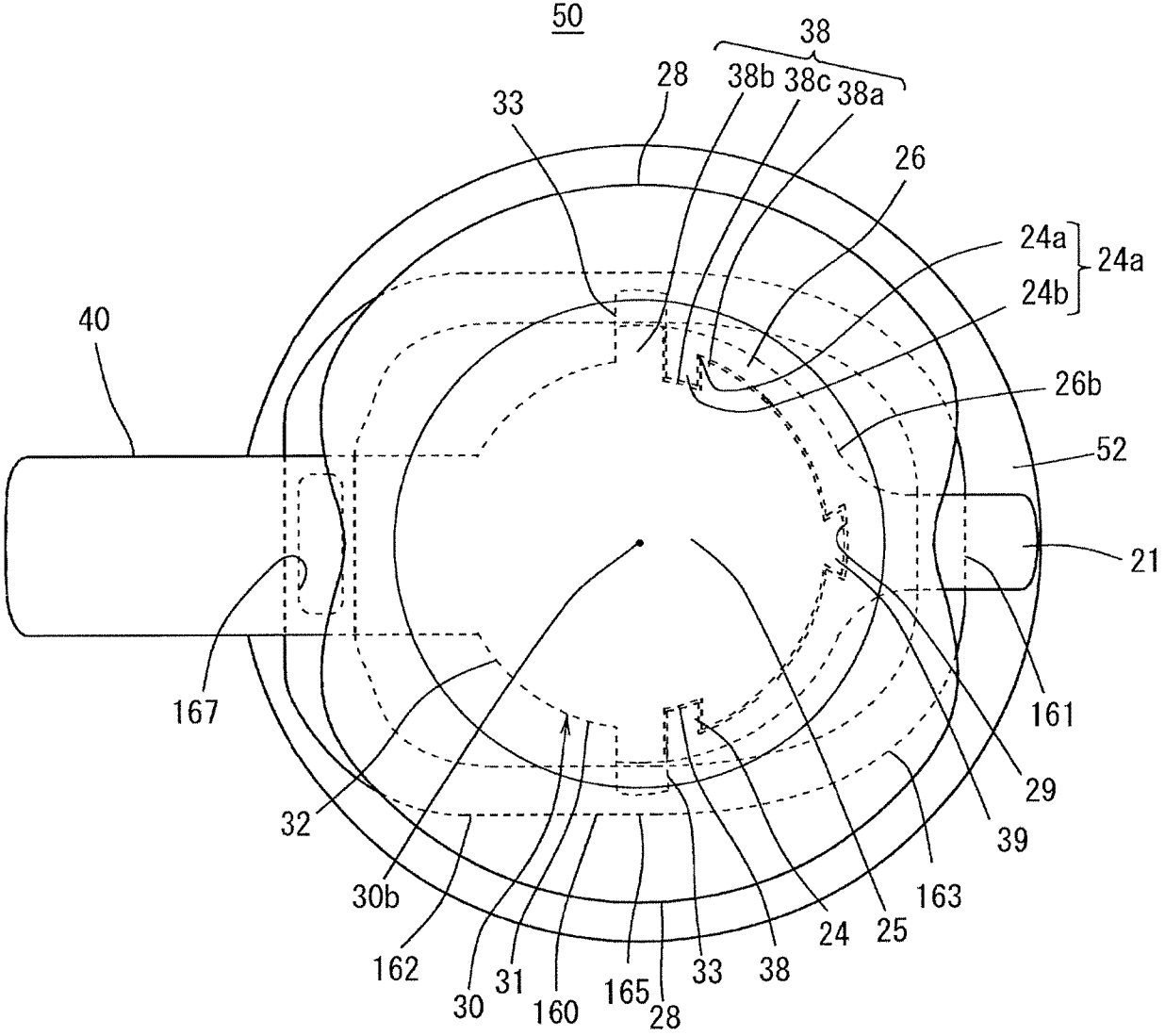
FIG. 18 is a plan view illustrating the liquid-agent dispensing cap according to the fifth exemplary embodiment.

As illustrated in FIG. 18, also in the case of this exemplary embodiment, at least a part of the head portion 30 is covered with the operating portion 20 when the liquid-agent dispensing container 100 is viewed in the one direction described above (in other words, in plan view).

More specifically, the entire tubular portion (external tubular portion 32) is covered with the operating portion 20

(for example, the operation receiving portion 25) when the liquid-agent dispensing container 100 is viewed in the one direction described above.

Furthermore, the entire acting portion is covered with the operating portion 20 when the liquid-agent dispensing container 100 is viewed in the one direction described above.

Furthermore, when the liquid-agent dispensing container 100 is viewed in the one direction described above, the front portion of the force application portion 161 is covered with the operating portion 20, and the rear portion of the force application portion 161 is located outside (on the backward side) of the contour line of the operating portion 20.

Furthermore, also in the case of this exemplary embodiment, the head portion 30 includes the tubular portion (external tubular portion 32) having the shaft center extending in the one direction described above. In addition, the operating portion 20 is disposed on the extension of the shaft center 30*b* of the tubular portion (external tubular portion 32). More specifically, the operation receiving portion 25 is disposed on the extension of the shaft center 30*b* of the tubular portion (external tubular portion 32).

Furthermore, when the liquid-agent dispensing container 100 is viewed in the one direction described above, the entire guide mechanism (the guiding portion 38 and the guided portion 24) is covered with the operating portion 20 (for example, the operation receiving portion 25).

Also in the case of this exemplary embodiment, the second mounting portion 170 is detachably mounted on the mounting portion 52. However, in the case of this exemplary embodiment, the second mounting portion 170 is detachably mounted directly on the mounting portion 52 (rather than indirectly through the erected tube 53).

Furthermore, the swing portion 160 is pivotally supported at the pivotally supporting portion 91 by the second mounting portion 170.

Also in the case of this exemplary embodiment, since the second mounting portion 170 that pivotally supports the swing portion 160 is detachable with respect to the mounting portion 52, the second mounting portion 170 of the liquid-agent dispensing container 100 can be manufactured separately from other elements of the liquid-agent dispensing container 100, and hence, it is possible to improve the manufacturability of the liquid-agent dispensing container 100.

In the case of this exemplary embodiment, the mounting portion 52 includes the tubular portion having a thread ridge formed on the inner peripheral surface thereof, and the top surface portion that closes the upper end of the tubular portion except for the central portion of this upper end. Here, the tubular portion of the mounting portion 52 has the shaft center extending in the one direction described above. That is, the mounting portion 52 includes a mounting tubular portion having the shaft center extending in the one direction described above. Also in this exemplary embodiment, the one direction described above is the downward direction, as in the first exemplary embodiment.

In the case of this exemplary embodiment, the second mounting portion 170 is mounted on the tubular portion (mounting tubular portion) of the mounting portion 52 so as to be able to move in the circumferential direction of this tubular portion.

Here, the head portion 30 can rotate around the axis of the tubular portion of the mounting portion 52 relatively to the mounting portion 52 and the erected tube 53. Furthermore, the swing portion 160 is supported at the pivotally supporting portion 91 by the second mounting portion 170, and the boundary portion 165 is supported by the projection portion 33 of the head portion 30. In addition, the operating portion 20 is configured such that the guided portion 24 engages with the guiding portion 38 of the head portion 30, and the pushing-down portion 21 is supported by the force application portion 161 of the swing portion 160. Moreover, the second mounting portion 170, the swing portion 160, the head portion 30, the nozzle portion 40 including the dispensing outlet 41, and the operating portion 20 rotate integrally around the axis of the tubular portion of the mounting portion 52 when the second mounting portion 170 moves in the circumferential direction of the tubular portion of the mounting portion 52.

That is, the swing portion 160, the head portion 30, the dispensing outlet 41, and the operating portion 20 rotate integrally around the axis of the mounting tubular portion in association with movement of the second mounting portion 170 in the circumferential direction of the mounting tubular portion.

Thus, a user can move (rotate) the second mounting portion 170, the swing portion 160, the head portion 30, the dispensing outlet 41, and the operating portion 20 to a preferable position to use the liquid-agent dispensing container 100.

Also in the first exemplary embodiment, it may also be possible to employ a configuration in which the second mounting portion 170 can rotate around the axis of the erected tube 53, and the swing portion 160, the head portion 30, the dispensing outlet 41, and the operating portion 20 rotates integrally around the axis of the tubular portion of the mounting portion 52 in association with movement of the second mounting portion 170 in the circumferential direction of the erected tube 53 and the tubular portion of the mounting portion 52.

Figure 19:
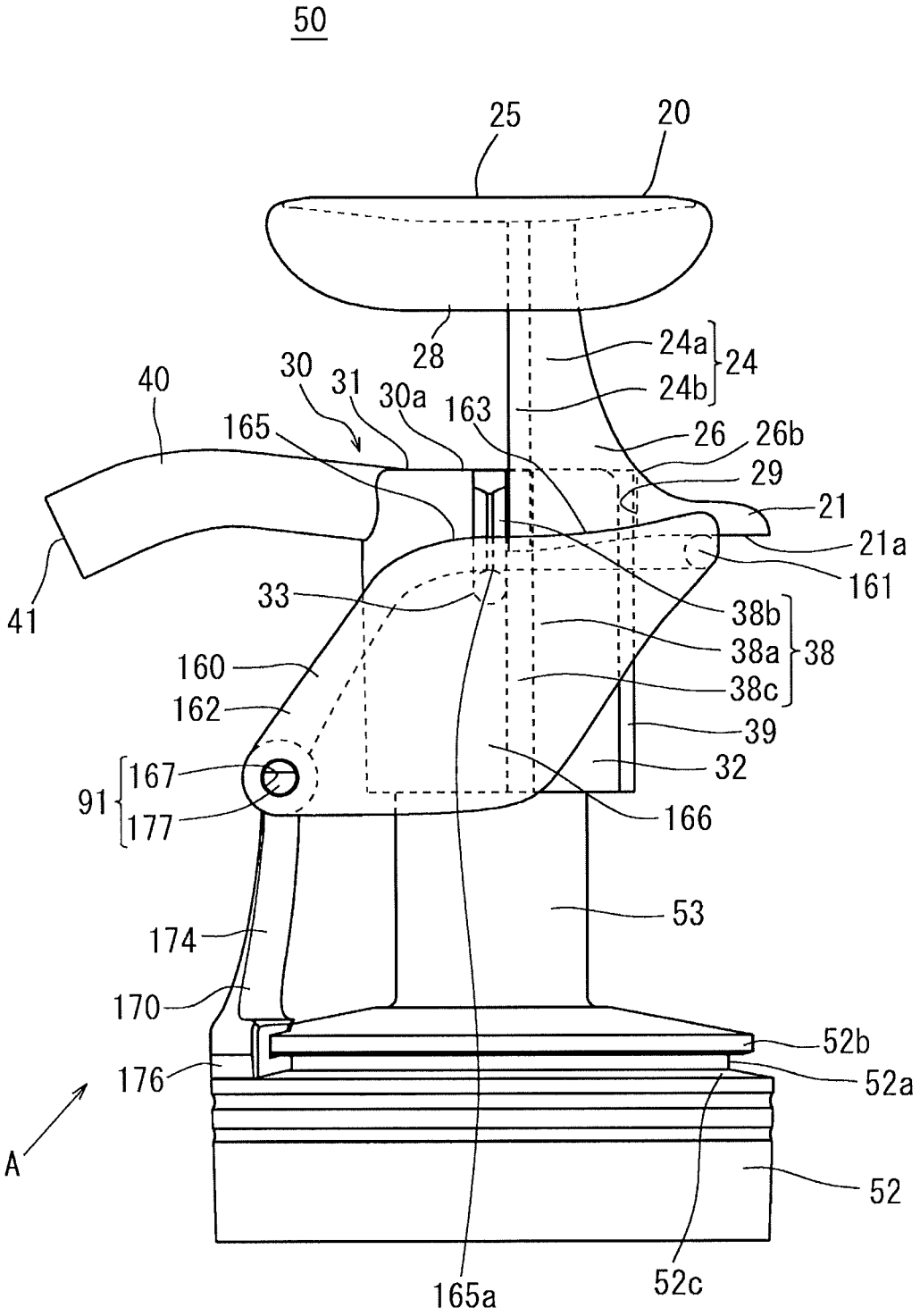
FIG. 19 is a side view illustrating the upper portion of the liquid-agent dispensing cap according to the fifth exemplary embodiment in a state where the operating portion and the head portion are each located at the top dead point.
Figure 23:
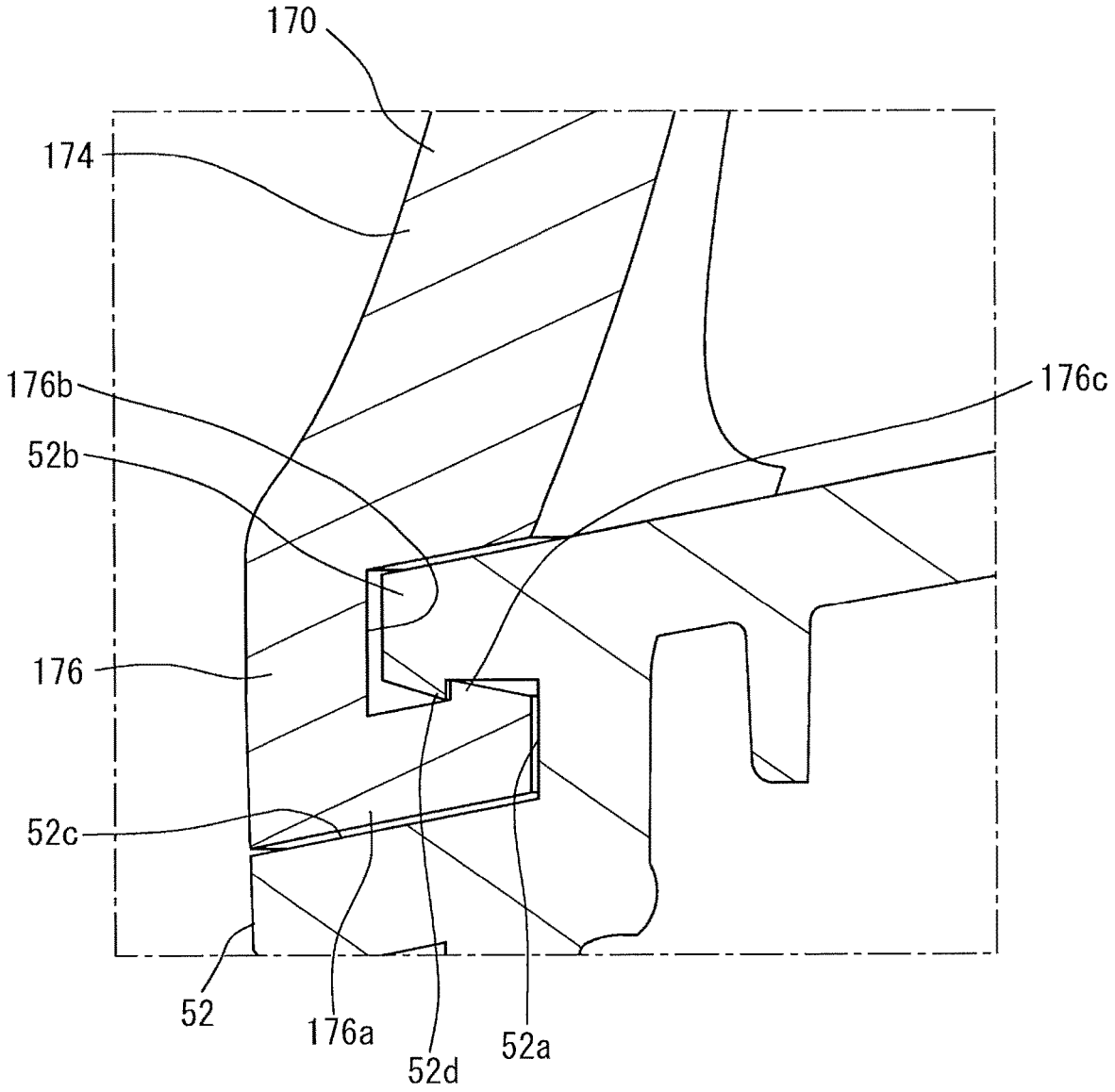
FIG. 23 is an enlarged view of the portion A in FIG. 22.

More specifically, as illustrated in FIGS. 19 and 23, an encircled groove portion 52*a* that extends around the tubular portion of the mounting portion 52 is formed on the outer peripheral surface of this tubular portion. The encircled groove portion 52*a* is opened toward the side direction. The upper end of the encircled groove portion 52*a* is defined by an encircled eaves portion 52*b* that projects outward in the radial direction of the tubular portion of the mounting portion 52. An encircled locking claw portion 52*d* is formed on the lower surface of the tip end portion of the encircled eaves portion 52*b* in the projecting direction. The bottom surface (encircled sloped bottom surface 52*c*) of the encircled groove portion 52*a* is sloped downward toward the outside in the radial direction of the tubular portion of the mounting portion 52.

Figure 17:
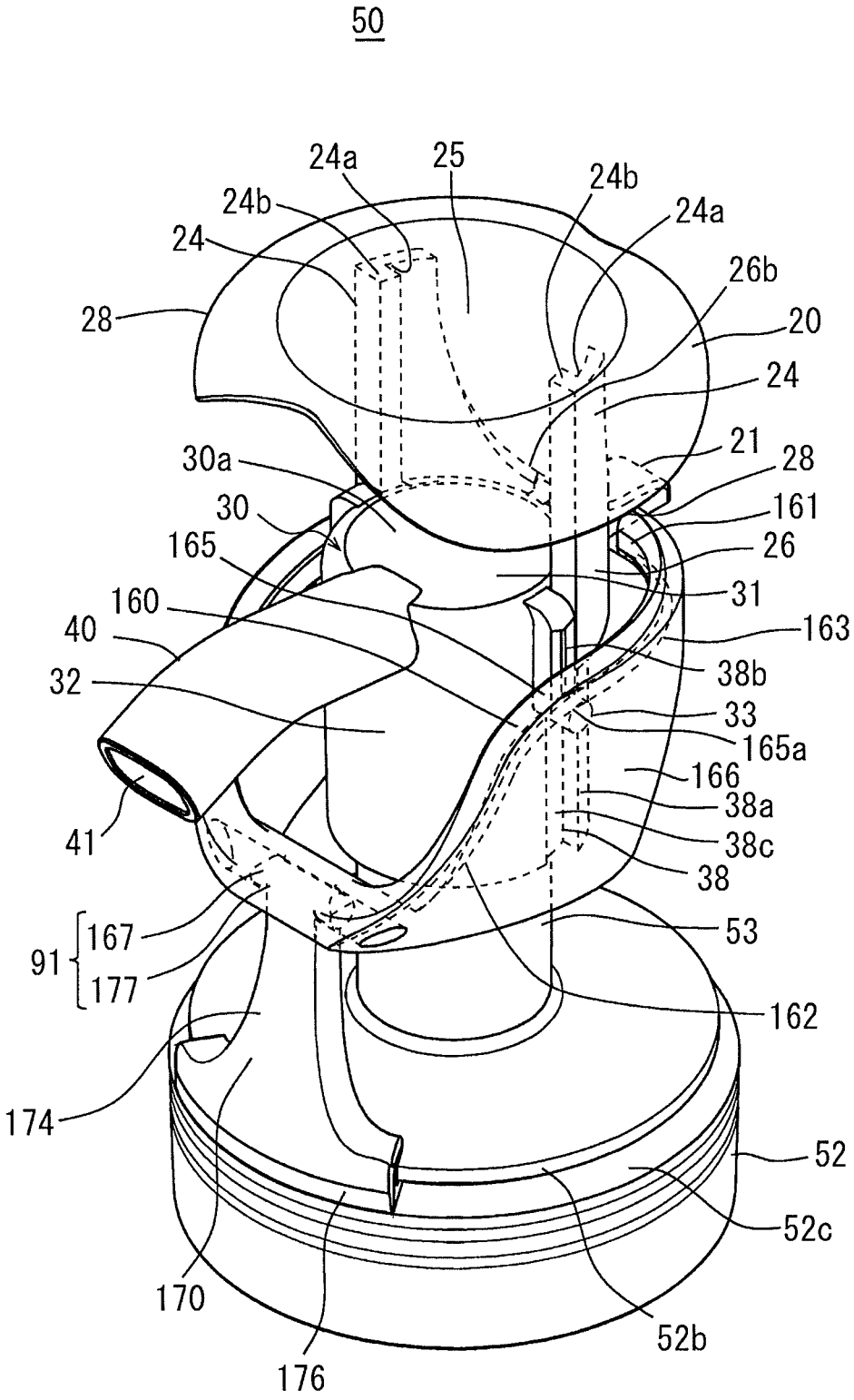
FIG. 17 is a perspective view illustrating an upper portion of a liquid-agent dispensing cap according to a fifth exemplary embodiment as viewed obliquely from a front upper side.

Furthermore, the second mounting portion 170 includes a connecting portion 176 that is fitted into the encircled groove portion 52*a*, thereby being connected (mounted) detachably to the mounting portion 52, and a pillar-shaped supporting portion 174 that stands upward from the connecting portion 176. It is preferable that the size of the connecting portion 176 in the circumferential direction of the tubular portion of the mounting portion 52 is larger than the size of the supporting portion 174 in the circumferential direction of the tubular portion of the mounting portion 52, as illustrated in FIG. 17.

As illustrated in FIG. 23, the connecting portion 176 includes a bottom portion 176*a* that is fitted into the encircled groove portion 52*a*, and a recessed portion 176*b* that is disposed adjacently on the upper side of the bottom portion 176*a* and into which the encircled eaves portion 52*b* is inserted.

A locking portion 176*c* is formed on the upper surface of the bottom portion 176*a*, and is engaged with the encircled locking claw portion 52*d* of the encircled eaves portion 52*b*.

As described above, the one direction described above is the downward direction, and the second mounting portion 170 is fitted into the groove (encircled groove portion 52*a*) formed in the outer peripheral surface of the mounting tubular portion (the tubular portion of the mounting portion 52), thereby being detachably mounted on the mounting tubular portion.

Here, since the groove (encircled groove portion 52*a*) of the mounting portion 52 is formed in the outer peripheral surface of the mounting tubular portion, that is, since the encircled groove portion 52*a* is opened to the side direction, it is possible to suppress the accumulation of water and the like in the encircled groove portion 52*a*.

Furthermore, the bottom surface (encircled sloped bottom surface 52*c*) of the groove (encircled groove portion 52*a*) of the mounting tubular portion (the tubular portion of the mounting portion 52) is sloped downward toward the outside in the radial direction of the mounting tubular portion. Thus, it is possible to more favorably suppress the accumulation of water and the like in the encircled groove portion 52*a*.

In the case of this exemplary embodiment, the encircled groove portion 52*a* makes one turn around the tubular portion of the mounting portion 52 (turns by 360 degrees), and the second mounting portion 170, the swing portion 160, the head portion 30, the dispensing outlet 41, and the operating portion 20 can rotate by 360 degrees around the axis of the mounting tubular portion of the mounting portion 52.

However, the present invention is not limited to this example, and it may be possible that the second mounting portion 170, the swing portion 160, the head portion 30, the dispensing outlet 41, and the operating portion 20 can rotate in a range of angle less than 360 degrees around the axis of the mounting portion 52. That is, the encircled groove portion 52*a* may extend within a range of angle less than 360 degrees around the tubular portion of the mounting portion 52.

Furthermore, as illustrated, for example, in FIG. 17, a rod-shaped shaft portion 177 that horizontally extends is formed on the upper end portion of the supporting portion 174.

On the other hand, the swing portion 160 is formed with a bearing portion 167 for bearing the shaft portion 177. A space into which the shaft portion 177 is fitted is formed inside the bearing portion 167.

Figure 24:
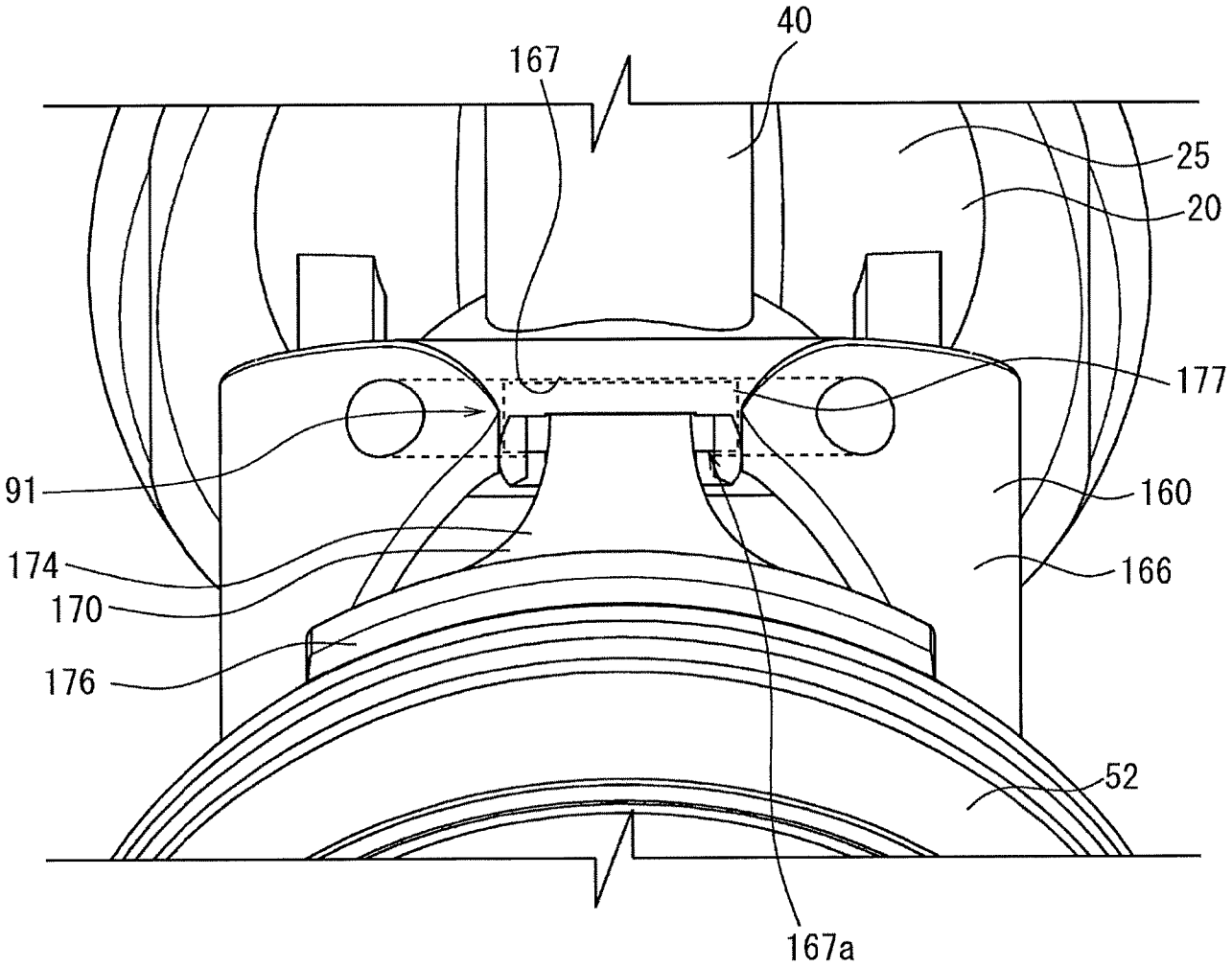
FIG. 24 is a diagram illustrating a pivotally supporting portion of the liquid-agent dispensing cap and its surroundings according to the fifth exemplary embodiment as viewed in the direction of the arrow A in FIG. 19.

As illustrated in FIG. 24, the swing portion 160 has an opening 167*a* that allows the shaft portion 177 to be press into the space formed inside the bearing portion 167. By inserting the shaft portion 177 into the inside of the bearing portion 167 through the opening 167*a*, the swing portion 160 is pivotally supported by the second mounting portion 170.

In the case of this exemplary embodiment, the pivotally supporting portion 91 is comprised of the bearing portion 167 and the shaft portion 177. The shaft portion 177 extends in the axial direction of the pivotally supporting portion 91.

As described above, the pivotally supporting portion 91 is configured to include the rod-shaped shaft portion 177 that is formed on the second mounting portion 170 and extends in the axial direction of the pivotally supporting portion 91, and the bearing portion 167 that is formed in the swing portion 160 and supports the shaft portion 177.

Since the shaft portion 177 is covered with the bearing portion 167, it is possible to suppress the shaft portion 177 from being broken, and also to improve the appearance of the liquid-agent dispensing container 100.

In the case of this exemplary embodiment, the swing portion 160 has the bearing portion 167, the left and right first portions 162, the left and right second portions 163, and the force application portion 161, each of which is formed into a rod shape, and the entire body comprised of the bearing portion 167, the left and right first portion 162, the left and right second portion 163, and the force application portion 161 has an annular and rod shape.

However, as illustrated, for example, in FIG. 19, the swing portion 160 includes a cover portion 166 that extends downward from the first portion 162 and the second portion 163.

This cover portion 166 covers the projection portion 33 when the liquid-agent dispensing container 100 is viewed in the axial direction of the pivotally supporting portion 91.

As described above, the head portion 30 includes the tubular portion (external tubular portion 32) that has the shaft center extending in the one direction described above.

Furthermore, as illustrated in FIGS. 19 to 22, the cover portion 166 covers the end edge (the bottom end edge of the external tubular portion 32) of the tubular portion (external tubular portion 32) on the side of the one direction described above when the liquid-agent dispensing container 100 is viewed in the axial direction of the pivotally supporting portion 91. This configuration suppresses a finger or the like from being caught at the end edge of the tubular portion on the side of the one direction described above.

Here, the "cover portion 166 covers the end edge of the tubular portion of the head portion 30 on the side of the one direction described above" means that the cover portion 166 covers at least a part of the end edge of this tubular portion on the side of the one direction described above.

Furthermore, as illustrated in FIG. 19 to FIG. 22, the cover portion 166 covers the end edge of the tubular portion (external tubular portion 32) on the side of the one direction described above when the liquid-agent dispensing container 100 is viewed in the axial direction of the pivotally supporting portion 91, regardless of the amount of the head portion 30 being pressed with respect to the mounting portion 52. In other words, the cover portion 166 always covers the end edge of the tubular portion (external tubular portion 32) on the side of the one direction described above when the liquid-agent dispensing container 100 is viewed in the axial direction of the pivotally supporting portion 91.

Furthermore, in the case of this exemplary embodiment, the operating portion 20 includes: the operation receiving portion 25 that is formed into a plate shape (in other words, horizontal plate) perpendicular to the one direction described above and receives a pressing operation; and a skirt portion 28 that extends in one direction (downward) from each of both end portions in the axial direction of the pivotally supporting portion 91 (in other words, each of left and right end portions) of the operation receiving portion 25.

When the operating portion 20 is pressed (for example, pressed to the bottom dead point) as illustrated in FIG. 21, the skirt portion 28 covers the end portion (in other words, the upper end portion) of the head portion 30 on the side of the direction opposite to the one direction described above when the liquid-agent dispensing container 100 is viewed in the axial direction of the pivotally supporting portion 91.

This configuration suppresses a finger or the like from being caught between the operating portion 20 and the head portion 30 when the operating portion 20 is pressed.

Also in the case of this exemplary embodiment, the shape (angle) of the acting surface 165*a* is set such that a portion of the acting surface 165*a* that is in contact with the projection portion 33 is always maintained to be horizontal (see FIGS. 19 to 21).

Furthermore, also in the case of this exemplary embodiment, the head portion 30 includes the tubular portion (external tubular portion 32) that has the shaft center extending in the one direction described above. The swing portion 160 is formed into an annular shape that surrounds the tubular portion when the liquid-agent dispensing container 100 is viewed in the one direction described above. The liquid-agent dispensing container 100 includes the pair of acting portions that are spaced apart from each other in the axial direction of the pivotally supporting portion 91. Thus, with the pair of acting portions, it is possible to stably transfer the pressing force from the swing portion 160 to the head portion 30 in a well-balanced manner.

Furthermore, the pivotally supporting portion 91 and the force application portion 161 are disposed on the opposite side to each other with the tubular portion (external tubular portion 32) being disposed therebetween in a direction (in other words, in the front-rear direction) perpendicular to both of the one direction described above and the axial direction of the pivotally supporting portion 91.

In addition, when the liquid-agent dispensing container 100 is viewed in the axial direction of the pivotally supporting portion 91, the swing portion 160 includes: the first portion 162 that extends from the pivotally supporting portion 91 in a direction having a component of the direction opposite to the one direction described above and toward the force application portion 161 side; and the second portion 163 that extends from the end portion of the first portion 162 on the force application portion 161 side toward the force application portion 161.

Moreover, the swing portion 160 is bent at the boundary portion 165 between the first portion 162 and the second portion 163 convexly toward the direction opposite to the one direction described above, and the acting portion is comprised of the boundary portion 165 of the swing portion 160, and the projection portion 33 that protrudes from the outer peripheral surface of the tubular portion (external tubular portion 32).

Thus, when the force that pushes back the swing portion 160 in the one direction described above is transferred from the head portion 30 to the swing portion 160 after the operating portion 20 and the head portion 30 are pressed, this force can be smoothly transferred.

In the case of this exemplary embodiment, the cover portion 26 is a pillar-shaped portion that is suspended from each of both of the left and right end portions of the operation receiving portion 25. The lower portion 26*b* of the cover portion 26 is disposed horizontally, and circulates around the range of about 180 degrees along the rear half portion at the upper end portion of the external tubular portion 32. Thus, the left and right cover portions 26 are connected to each other at the lower portion 26*b*. In addition, unlike the first exemplary embodiment, the rear portion of the cover portion 26 is opened toward the backward direction at the upper portion of the lower portion 26*b*. Moreover, the pushing-down portion 21 extends backward from the backward end portion of the lower portion 26*b*.

The guided portion 24 extends in the top-bottom direction in the front edge portion of each of the left and right cover portions 26.

In the case of this exemplary embodiment, the guided portion 24 is configured to include the guided rib 24*b* that extends in the top-bottom direction in the front edge of each of the cover portions 26, and the guided groove 24*a* that is disposed on the backward side of the guided rib 24*b* and extends in the top-bottom direction.

Also in this exemplary embodiment, the guiding portion 38 is formed at both of the left and right end portions of the external tubular portion 32, and extends in the top-bottom direction.

As illustrated in FIG. 18, in the case of this exemplary embodiment, the guiding portion 38 is configured to include: the first guiding rib 38*a* that is fitted into the guided groove 24*a*; the guiding groove 38*c* into which the guided rib 24*b* is fitted; and the second guiding rib 38*b* that guides the front face of the guided groove 24*a*.

The amount of projection of the second guiding rib 38*b* laterally from the outer circumferential surface of the external tubular portion 32 is relatively large at the upper portion of the second guiding rib 38*b* and relatively small at the lower portion of the second guiding rib 38*b*.

Furthermore, the projection portion 33 projects in the side direction from the bottom end portion in the upper portion of the second guiding rib 38*b*.

Furthermore, the operating portion 20 may be configured so as to suppress it from going away in the upward direction with respect to the head portion 30. For example, a protrusion (not illustrated) is formed on each of the bottom end portion of the guided rib 24*b* and the upper end portion of the guiding groove 38*c*, thereby suppressing the operating portion 20 from going away in the upward direction with respect to the head portion 30.

Furthermore, the second guiding portion 39 is formed on the rear face of the external tubular portion 32 of the head portion 30, and the second guided portion 29 that is guided by the second guiding portion 39 in the top-bottom direction is formed on the front face of the pushing-down portion 21.

The liquid-agent dispensing container according to this exemplary embodiment is configured to include the liquid-agent dispensing cap 50 according to this exemplary embodiment, and the container body 10 (see FIG. 1) similar to that in the first exemplary embodiment described above, although entire illustration thereof is not given.

In addition, the liquid-agent dispensing container product according to this exemplary embodiment is configured to include the liquid-agent dispensing container according to this exemplary embodiment, and the liquid agent filled in the container body 10, although entire illustration thereof is not given.

In addition to the effects described in this exemplary embodiment, according to this exemplary embodiment, it is possible to achieve effects similar to those in the first exemplary embodiment.

Sixth Exemplary Embodiment

Next, a sixth exemplary embodiment will be described with reference to FIGS. 25 to 28(*b*).

The liquid-agent dispensing cap 50 according to this exemplary embodiment differs from the liquid-agent dispensing cap 50 according to the first exemplary embodiment in the points described below, and in other points, is configured similarly to the liquid-agent dispensing cap 50 according to the first exemplary embodiment described above.

Figure 25:
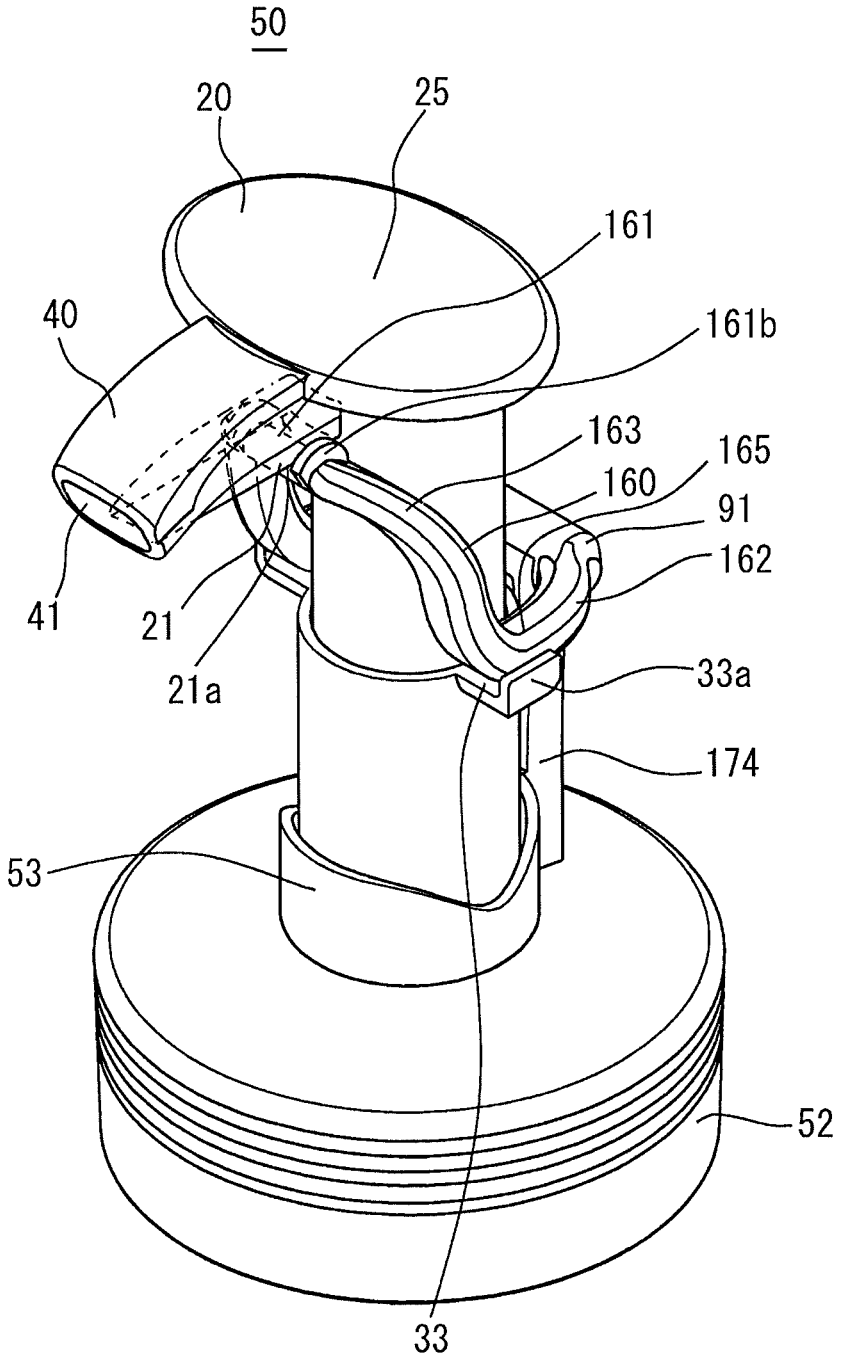
FIG. 25 is a perspective view illustrating an upper portion of a liquid-agent dispensing cap according to a sixth exemplary embodiment as viewed obliquely from a front upper side.
Figure 26B:
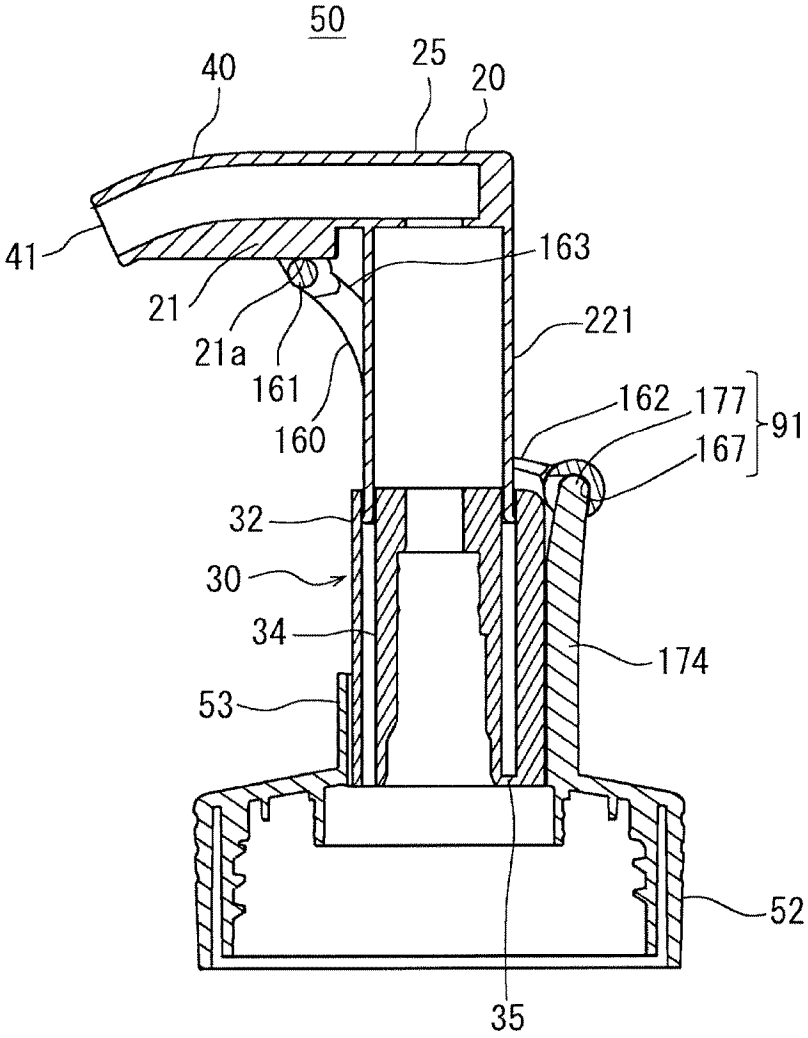
FIGS. 26(*a*) and 26(*b*) are diagrams each illustrating the upper portion of the liquid-agent dispensing cap according to the sixth exemplary embodiment in a state where the operating portion and the head portion are each located at the top dead point.
Figure 26A:
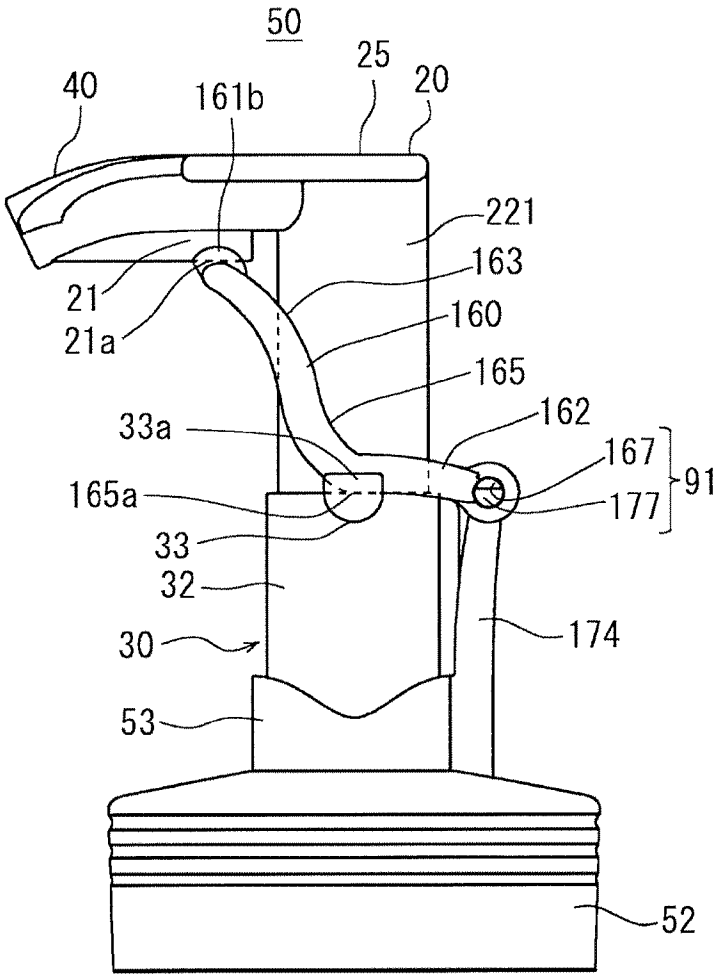

The states illustrated in the drawings of FIGS. 25 to 26(*b*) each show a state (normal state) at the normal time where neither the operating portion 20 nor the head portion 30 is pushed down, that is, a state where the operating portion 20 and the head portion 30 are each located at the top dead point. Furthermore, the states illustrated in FIGS. 28(*a*) and 28(*b*) each show a state where the operating portion 20 and the head portion 30 are pushed down to the lower limit position, that is, a state where the operating portion 20 and the head portion 30 are each located at the bottom dead point. In addition, the states illustrated in FIGS. 27(*a*) and 27(*b*) each show a state where the operating portion 20 and the head portion 30 are each located between the top dead point and the bottom dead point.

In FIGS. 26(*a*) to 28(*b*), the left direction is defined as the forward direction; the right direction is defined as the backward direction; the back side direction of the paper surface is defined as the left; and the front side direction of the paper surface is defined as the right.

As illustrated in FIGS. 25 to 26(*b*), in the case of this exemplary embodiment, the operating portion 20 includes a tube portion 221 that is suspended from the operation receiving portion 25. The tube portion 221 has the shaft center extending in the top-bottom direction.

In the case of this exemplary embodiment, the nozzle portion 40 including the dispensing outlet 41 is not provided in the head portion 30, but projects in the forward direction from the upper end portion of the operating portion 20.

The internal space of the tube portion 221 communicates with the dispensing outlet 41 provided at the tip end of the nozzle portion 40.

The operating portion 20 does not have the cover portion 26 or guided portion 24. In addition, the head portion 30 does not have the guiding portion 38.

Furthermore, as illustrated in FIG. 26(*b*), the external tubular portion 32 and the internal tubular portion 34 communicate with each other at the connecting portion 35 provided at the bottom end portion of the head portion 30, and are spaced apart from each other in the upper end portion of the head portion 30.

In addition, the outer diameter of the external tubular portion 32 is smaller than the inner diameter of the erected tube 53, and the head portion 30 is inserted into the erected tube 53.

The tube portion 221 is inserted into the space between the external tubular portion 32 and the internal tubular portion 34 from the lower portion of this tube portion 221. In the case of this exemplary embodiment, the guide mechanism that guides a relative movement of the operating portion 20 with respect to the head portion 30 while maintaining the posture of the operating portion 20 when the operating portion 20 is pressed is comprised of the external tubular portion 32, the internal tubular portion 34, and the tube portion 221. That is, the outer peripheral surface and the inner peripheral surface of the tube portion 221 are guided by the inner peripheral surface of the external tubular portion 32 and the outer peripheral surface of the internal tubular portion 34, and the outer peripheral portion of the bottom end of the tube portion 221 slides in the top-bottom direction with respect to the inner peripheral surface of the external tubular portion 32.

Furthermore, the direction in which the operating portion 20 is pressed is the same as the direction in which the operating portion 20 is guided by the guide mechanism. The guide mechanism includes the guiding portion (the external tubular portion 32 and the internal tubular portion 34) that the head portion 30 has, and the guided portion (the tube portion 221) that the operating portion 20 has and that is guided by the guiding portion. The guiding portion guides, in the one direction described above and in the direction opposite to the one direction described above, at least two portions of the guided portion that are spaced apart from each other in the one direction described above.

The tube portion 221 may be configured so as to suppress it from going away in the upward direction with respect to the head portion 30.

Furthermore, the pushing-down portion 21 is formed on the lower surface of the nozzle portion 40. The pushing-down portion 21 extends in the forward-backward direction. The lower surface 21*a* of the pushing-down portion 21 is disposed so as to be horizontal.

An erected wall 161*b* for suppressing the pushing-down portion 21 from moving in the left-right direction with respect to the force application portion 161 stands on both of left and right end portions of the force application portion 161.

As illustrated in FIG. 26(*a*), the projection portion 33 is disposed on the upper end portion of the outer peripheral surface of the external tubular portion 32. An erected wall 33*a* for suppress the swing portion 160 from going away from the upper surface of the projection portion 33 is formed on the upper surface of the tip end portion of the projection portion 33 in the projecting direction.

Furthermore, in the case of this exemplary embodiment, the supporting portion 174 is provided integrally with the mounting portion 52. The supporting portion 174 is a pillar-shaped portion that stands upward from the upper surface of the top surface portion of the mounting portion 52. The shaft portion 177 is formed in the upper end portion of the supporting portion 174.

In addition, the supporting portion 174 that includes the shaft portion 177 is disposed behind the head portion 30, and the pivotally supporting portion 91 that includes the shaft portion 177 is also disposed behind the head portion 30.

Moreover, as illustrated in FIG. 26(*b*), the force application portion 161 is disposed more forward than the head portion 30.

That is, when the liquid-agent dispensing container 100 is viewed in the one direction described above, the pivotally supporting portion 91 and the force application portion 161 are disposed on the opposite side to each other with the tubular portion (external tubular portion 32) being disposed therebetween in a direction (in other words, in the front-rear direction) perpendicular to both of the one direction described above and the axial direction of the pivotally supporting portion 91.

Furthermore, when the liquid-agent dispensing container 100 is viewed in the axial direction of the pivotally supporting portion 91, the swing portion 160 includes the first portion 162 that extends toward the force application portion 161 side from the pivotally supporting portion 91, and the second portion 163 that extends from the end portion of the first portion 162 on the force application portion 161 side toward the force application portion 161 and in a direction having a component of the direction opposite to the one direction described above. In addition, the swing portion 160 is bent at the boundary portion 165 between the first portion 162 and the second portion 163 so as to be convex toward the one direction described above. In other words, in the case of this exemplary embodiment, the direction in which the swing portion 160 is bent when viewed from the side is opposite to that in the first exemplary embodiment, the second exemplary embodiment, and the fifth exemplary embodiment.

Moreover, the acting portion is comprised of the boundary portion 165 of the swing portion 160, and the projection portion 33 that projects from the outer peripheral surface of the tubular portion (external tubular portion 32).

Figure 27B:
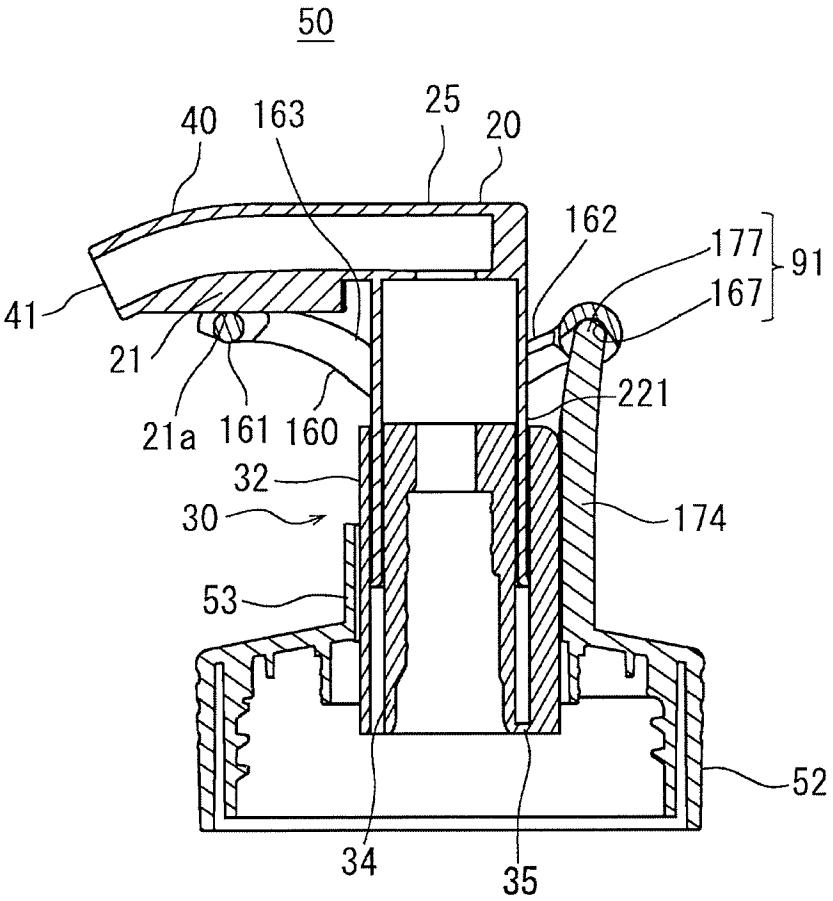
FIGS. 27(*a*) and 27(*b*) are diagrams each illustrating the upper portion of the liquid-agent dispensing cap according to the sixth exemplary embodiment in a state where the operating portion and the head portion are located between the top dead point and the bottom dead point.
Figure 27A:
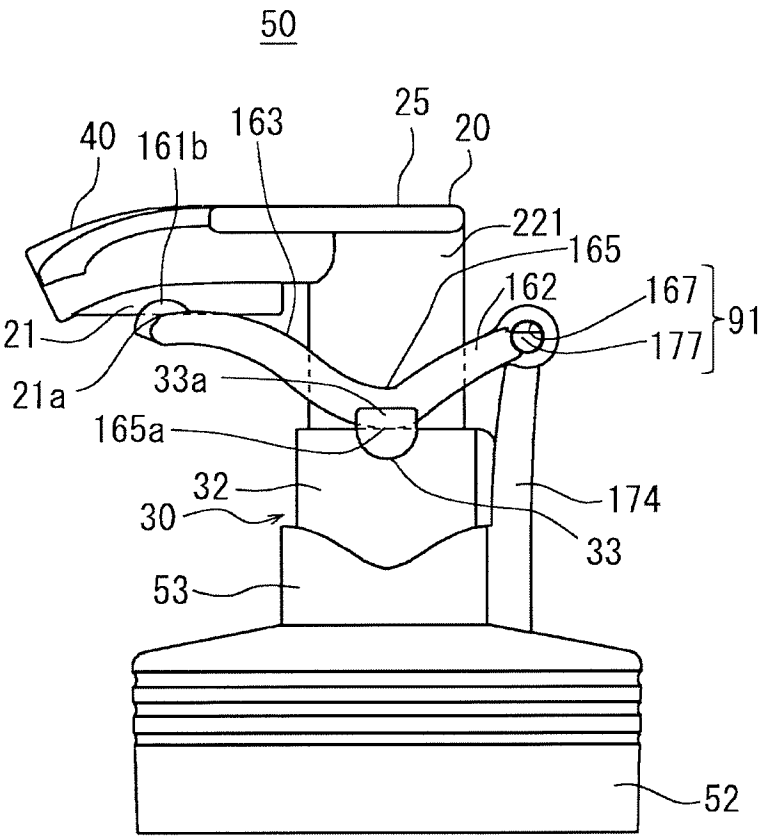
Figure 28B:
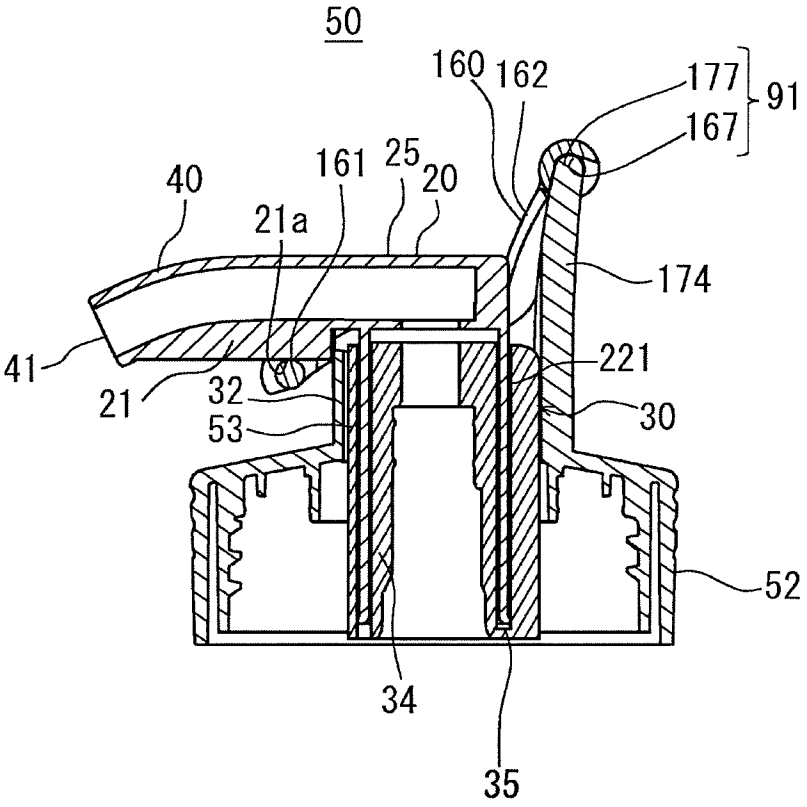
FIGS. 28(*a*) and 28(*b*) are diagrams each illustrating the upper portion of the liquid-agent dispensing cap according to the sixth exemplary embodiment in a state where the operating portion and the head portion are located at the bottom dead point.
Figure 28A:
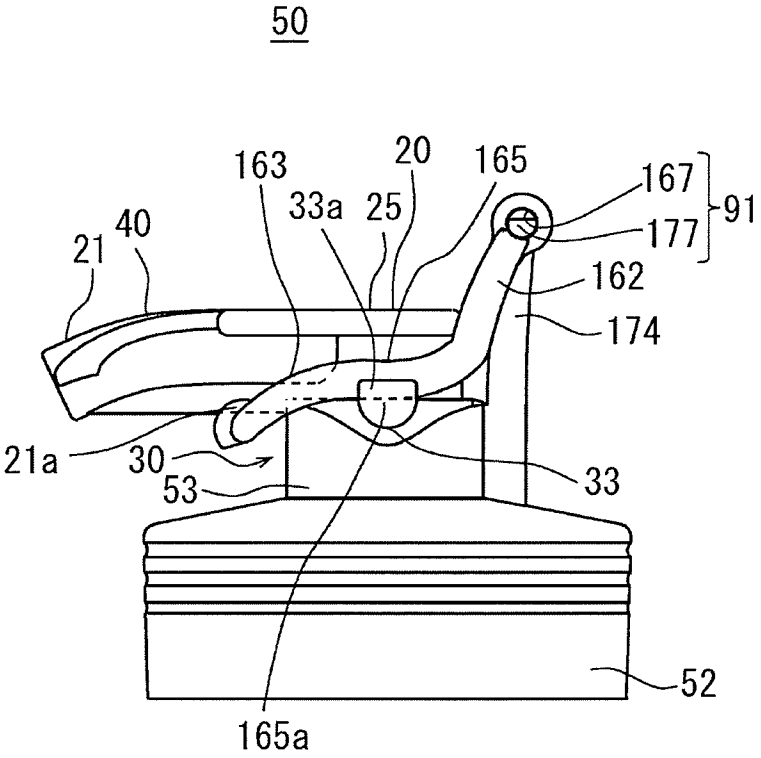

In the case of this exemplary embodiment, as the operating portion 20 is pushed down, the operating portion 20 descends relatively to the head portion 30; the tube portion 221 is entered deeper into the space between the external tubular portion 32 and the internal tubular portion 34; and the head portion 30 descends relatively to the erected tube 53, as illustrated in FIGS. 27(*a*), 27(*b*), 28(*a*), and 28(*b*).

The liquid-agent dispensing container according to this exemplary embodiment is configured to include the liquid-agent dispensing cap 50 according to this exemplary embodiment, and the container body 10 (see FIG. 1) similar to that in the first exemplary embodiment described above, although entire illustration thereof is not given.

In addition, the liquid-agent dispensing container product according to this exemplary embodiment is configured to include the liquid-agent dispensing container according to this exemplary embodiment and the liquid agent filled in the container body 10, although entire illustration thereof is not given.

Seventh Exemplary Embodiment

Next, a seventh exemplary embodiment will be described with reference to FIGS. 29 to 31.

The liquid-agent dispensing cap 50 according to this exemplary embodiment differs from the liquid-agent dispensing cap 50 according to the fifth exemplary embodiment in the points described below, and in other points, is configured similarly to the liquid-agent dispensing cap 50 according to the fifth exemplary embodiment.

Figure 29:
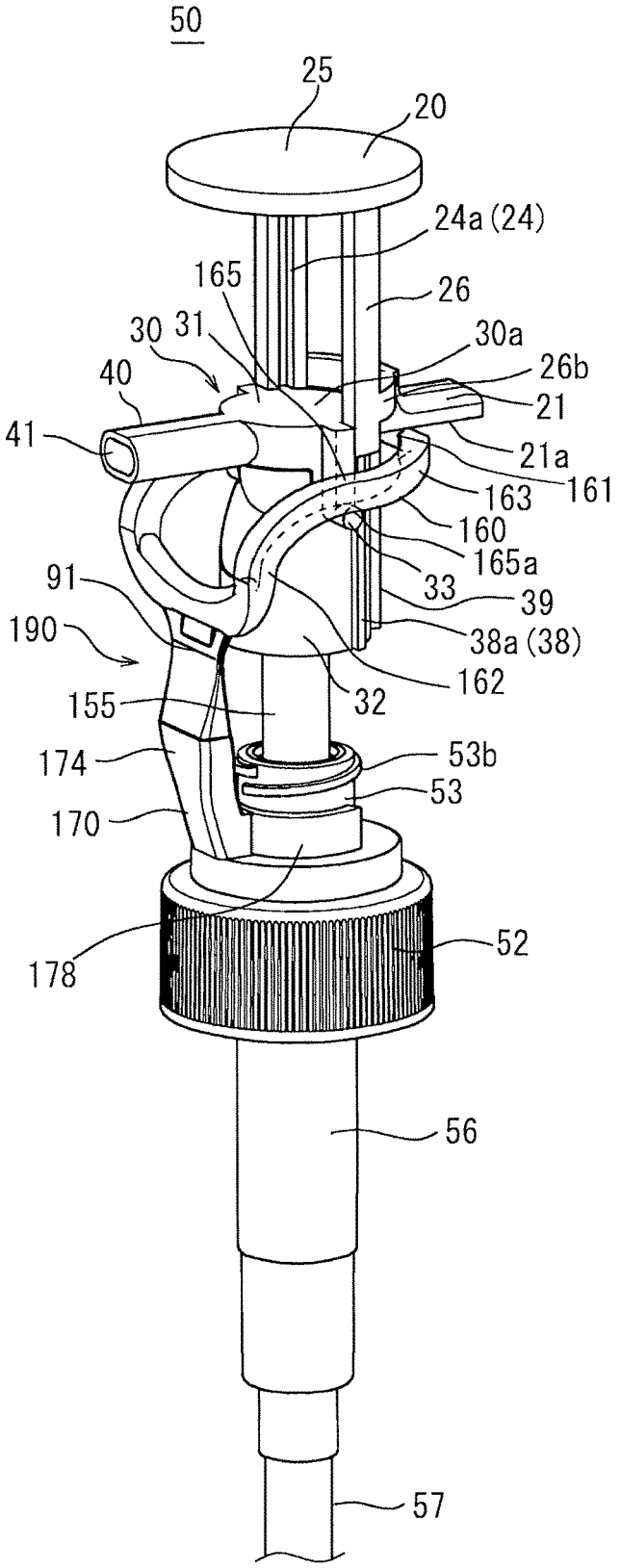
FIG. 29 is a perspective view, as viewed from the obliquely front and upper side, illustrating the liquid-agent dispensing cap according to the seventh exemplary embodiment in a state where the operating portion and the head portion are each located at the top dead point.

The state illustrated in FIG. 29 shows a state at the normal time where neither the operating portion 20 nor the head portion 30 is pushed down, that is, a state where the operating portion 20 and the head portion 30 are each located at the top dead point. In addition, the state illustrated in FIG. 30 shows a state where the operating portion 20 and the head portion 30 are pushed down to the lower limit position, that is, a state where the operating portion 20 and the head portion 30 are each located at the bottom dead point. Moreover, the state illustrated in FIG. 31 shows a state before the liquid-agent dispensing cap 50 is used (the state at the time of distribution).

Figure 31:
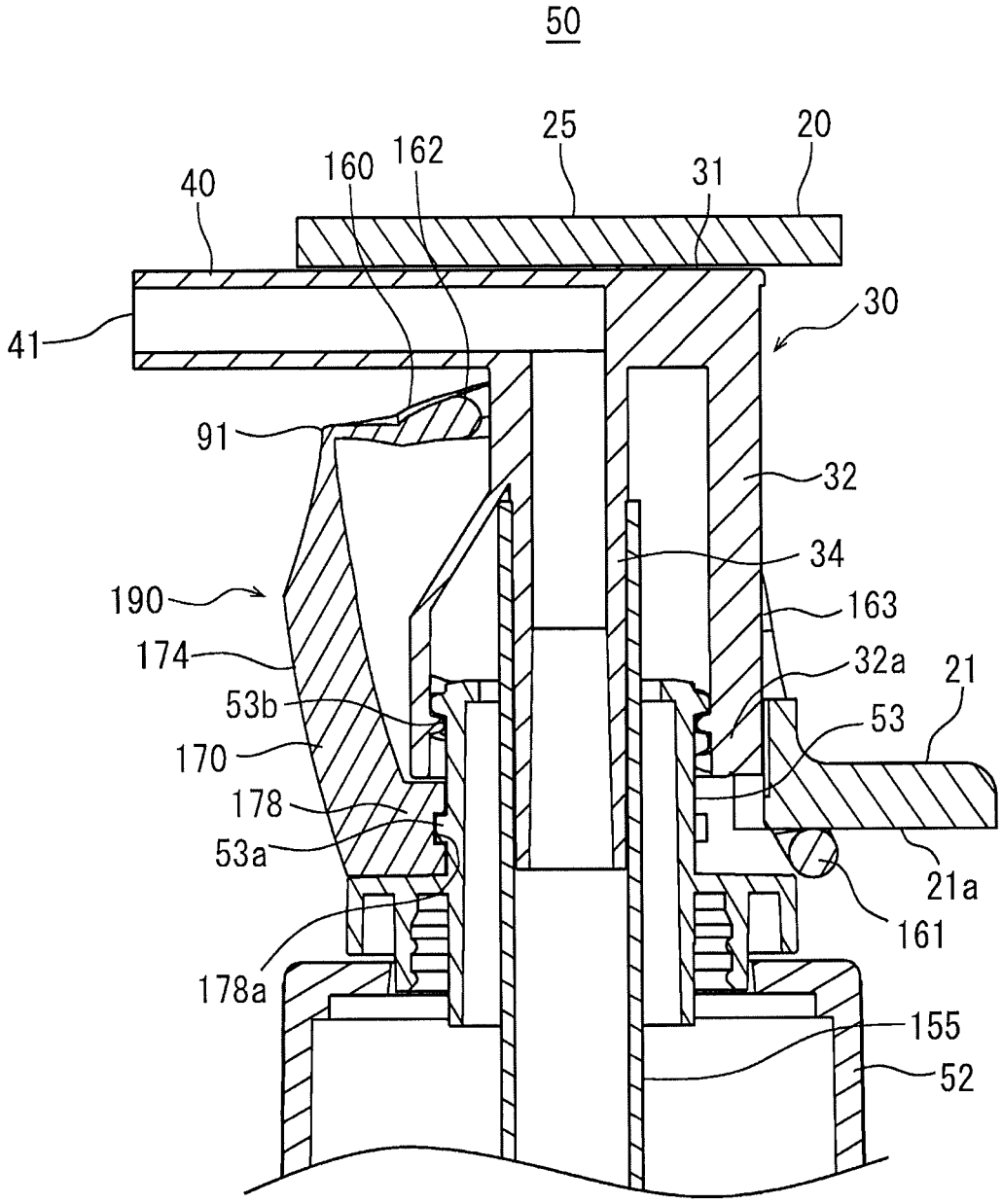
FIG. 31 is a sectional view, as viewed from the side, illustrating the liquid-agent dispensing cap according to the seventh exemplary embodiment in a state where the head portion and the erected tube are screwed together, so that the head portion is fixed to the mounting portion.

In FIG. 31, the left direction is defined as the forward direction; the right direction is defined as the backward direction; the back side direction of the paper surface is defined as the left; and the front side direction of the paper surface is defined as the right.

In the case of this exemplary embodiment, the liquid-agent dispensing cap 50 discharges the liquid agent in a liquid state, rather than in a foam shape.

In the case of this exemplary embodiment, the second mounting portion 170 and the swing portion 160 are formed integrally with each other, and the pivotally supporting portion 91 is made out of a thin-thickness hinge formed at the boundary portion between the second mounting portion 170 and the swing portion 160.

The member that has the second mounting portion 170 and the swing portion 160 in an integral manner is referred to as a swing portion unit 190.

Figure 30:
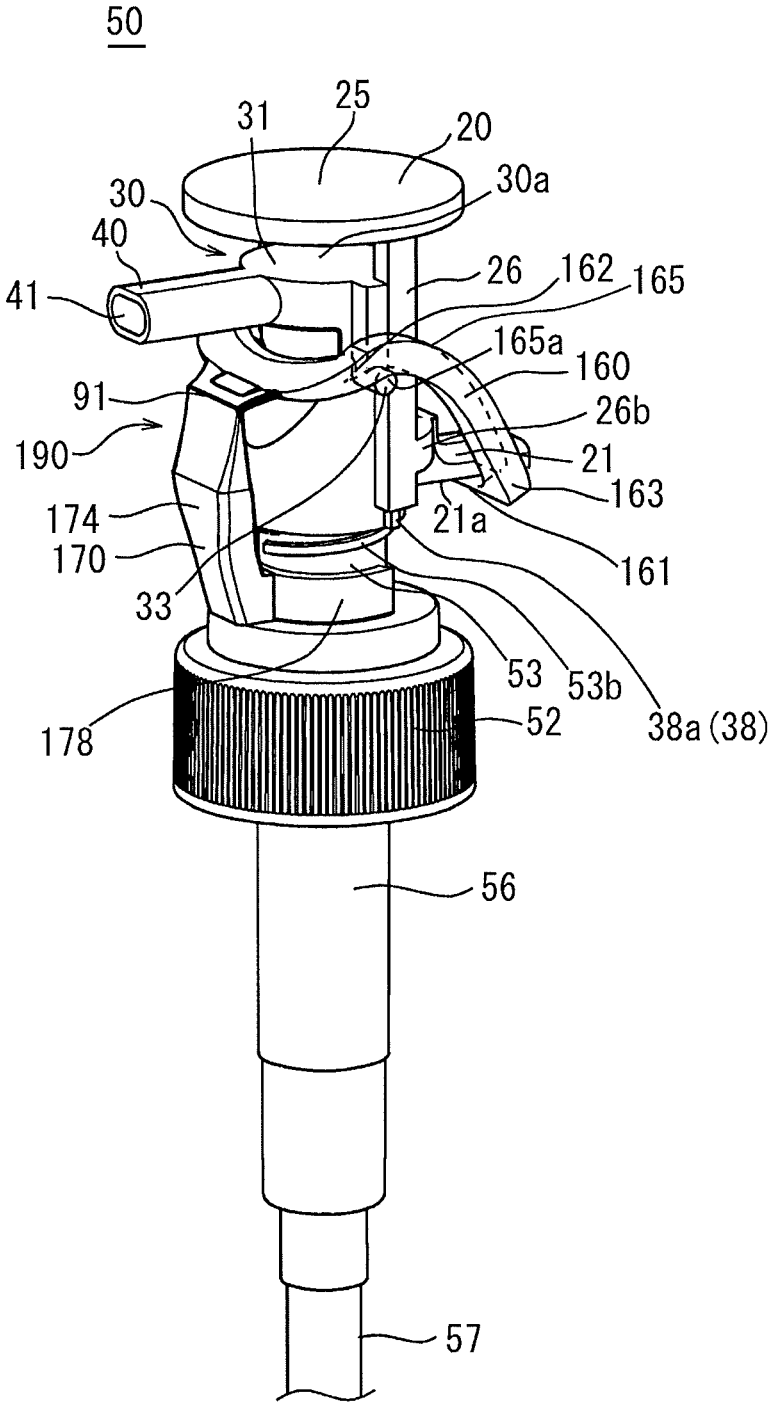
FIG. 30 is a perspective view, as viewed from the obliquely front and upper side, illustrating the liquid-agent dispensing cap according to the seventh exemplary embodiment in a state where the operating portion and the head portion are each located at the bottom dead point.

As illustrated in FIGS. 29 and 30, the second mounting portion 170 has the bottom end portion provided with an annular C-shaped mounting portion 178 having an annular C shape in plan view, and the supporting portion 174 stands upward from the upper surface of the annular C-shaped mounting portion 178. The pivotally supporting portion 91 is formed in the upper end portion of the supporting portion 174.

As illustrated in FIG. 31, the annular C-shaped mounting portion 178 has a groove 178*a* formed in the inner peripheral surface thereof, and the groove 178*a* extends horizontally and has an annular C shape in plan view.

Furthermore, the erected tube 53 has the outer peripheral surface having a circular rib 53*a* formed thereon so as to encircle the erected tube 53 itself. The erected tube 53 is fitted into the annular C-shaped mounting portion 178, and the groove 178*a* and the circular rib 53*a* are fitted with each other, whereby the second mounting portion 170, by extension, the swing portion unit 190 is mounted on the erected tube 53.

In a state of being mounted on the erected tube 53, the annular C-shaped mounting portion 178 can rotate around the axis of the erected tube 53 relatively to the erected tube 53. When the annular C-shaped mounting portion 178 rotates around the axis of the erected tube 53, the groove 178*a* slides with respect to the circular rib 53*a*.

In the erected tube 53, a portion above the C-shaped mounting portion 178 in a state in which the C-shaped mounting portion 178 is attached to the erected tube 53 is an external thread portion 53*b* having thread ridge formed on the outer peripheral surface thereof.

On the other hand, the lower end portion of the outer tubular portion 32 is an internal thread portion 32*a* in which a thread ridge is formed on the inner circumferential surface.

The internal thread portion 32*a* can be screwed with the external thread portion 53*b*.

Before the liquid-agent dispensing cap 50 is used (at the time of distribution), the head portion 30 and the operating portion 20 are pressed and the internal thread portion 32*a* and the external thread portion 53*b* are screwed with each other as illustrated in FIG. 31, so that the upward movement of the head portion 30 and the operating portion 20 is restricted.

That is, the liquid-agent dispensing container according to this exemplary embodiment includes a holding mechanism (the external thread portion 53*b* and the internal thread portion 32*a*) that restricts the movement of the head portion 30 and the operating portion 20 in a direction opposite to the one direction described above relative to the mounting portion 52 to hold the head portion 30 and the operating portion 20 in a pressed state.

This configuration enables the height size of the liquid-agent dispensing container to be reduced at the time of distribution.

In the case of this exemplary embodiment, the guided portion 24 is comprised of the guided groove 24*a* formed in the cover portion 26, and the guiding portion 38 is comprised of the first guiding rib 38*a* that is formed in the external tubular portion 32 and guides the guided groove 24*a*.

As illustrated in FIG. 31, the liquid-agent dispensing cap 50 includes a connecting tube portion 155 that is connected to the internal tubular portion 34 coaxially with the internal tubular portion 34 and extends downward farther than the internal tubular portion 34. The connecting tube portion 155 is inserted into the erected tube 53 and the mounting portion 52, and the lower portion of the connecting tube portion 155 is connected to the housing 56 (FIG. 29).

The liquid-agent dispensing container according to this exemplary embodiment is configured to include the liquid-agent dispensing cap 50 according to this exemplary embodiment, and the container body 10 (see FIG. 1) similar to that in the first exemplary embodiment described above, although entire illustration thereof is not given.

In addition, the liquid-agent dispensing container product according to this exemplary embodiment is configured to include the liquid-agent dispensing container according to this exemplary embodiment, and the liquid agent filled in the container body 10, although entire illustration thereof is not given.

When the liquid-agent dispensing container is used, the swing portion unit 190, the head portion 30, and the operating portion 20 are rotated around the axis thereof relatively to the erected tube 53, whereby the screwed state between the internal thread portion 32*a* and the external thread portion 53*b* is released. Then, the head portion 30 ascends due to the urging force of the spring body 58, so that the head portion 30 and the operating portion 20 are located at the top dead point as illustrated in FIG. 29.

After this, by pushing down the operating portion 20 (FIG. 30), the liquid agent is discharged from the dispensing outlet 41 in the liquid state.

Eighth Exemplary Embodiment

Next, an eighth exemplary embodiment will be described with reference to FIGS. 32 to 35.

The liquid-agent dispensing cap 50 according to this exemplary embodiment differs from the liquid-agent dispensing cap 50 according to the fifth exemplary embodiment described above in the points described below, and in other points, is configured similarly to the liquid-agent dispensing cap 50 according to the fifth exemplary embodiment.

Figure 32:
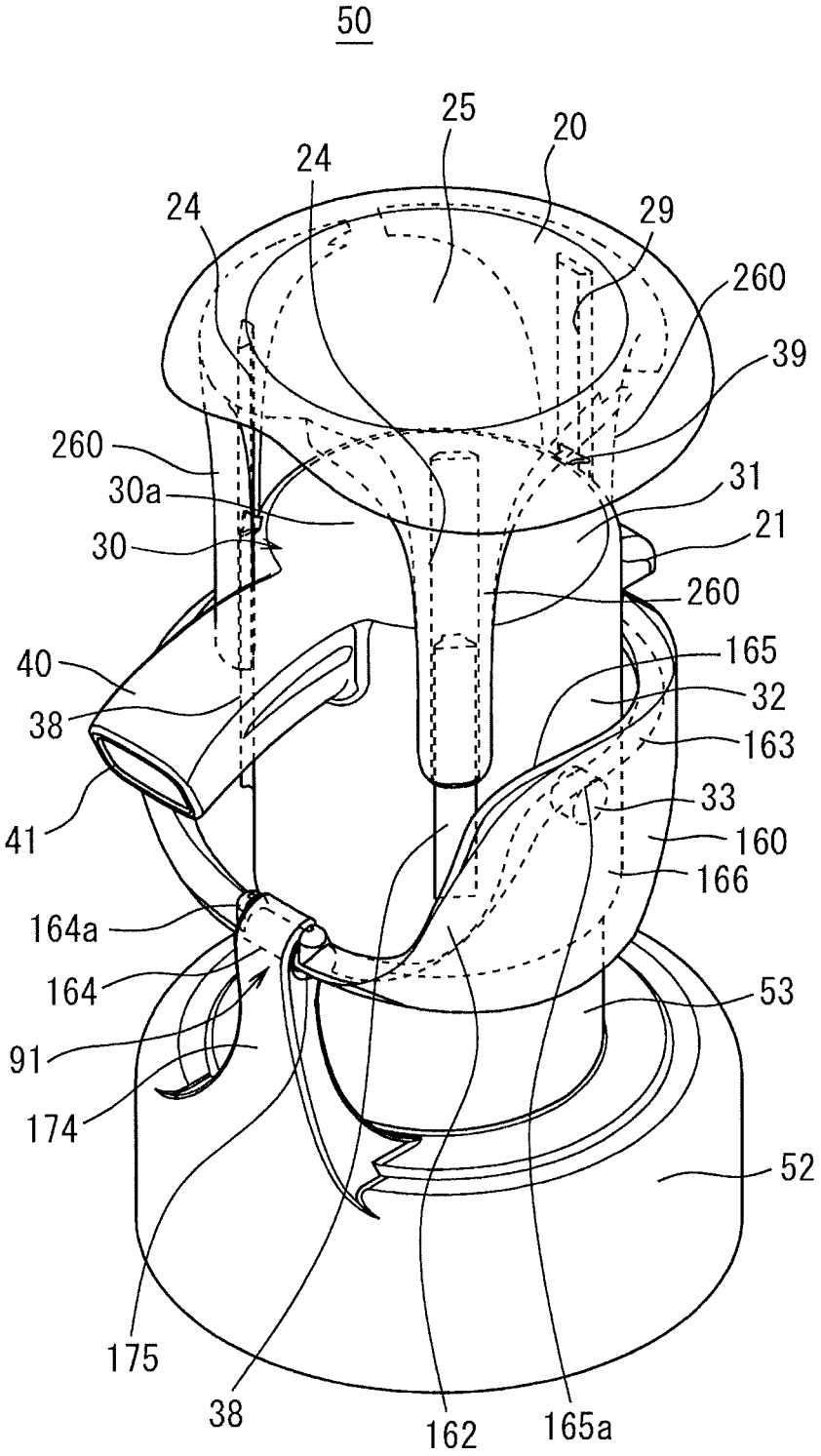
FIG. 32 is a perspective view illustrating the upper portion of a liquid-agent dispensing cap according to an eighth exemplary embodiment as viewed obliquely from a front upper side.
Figure 34:
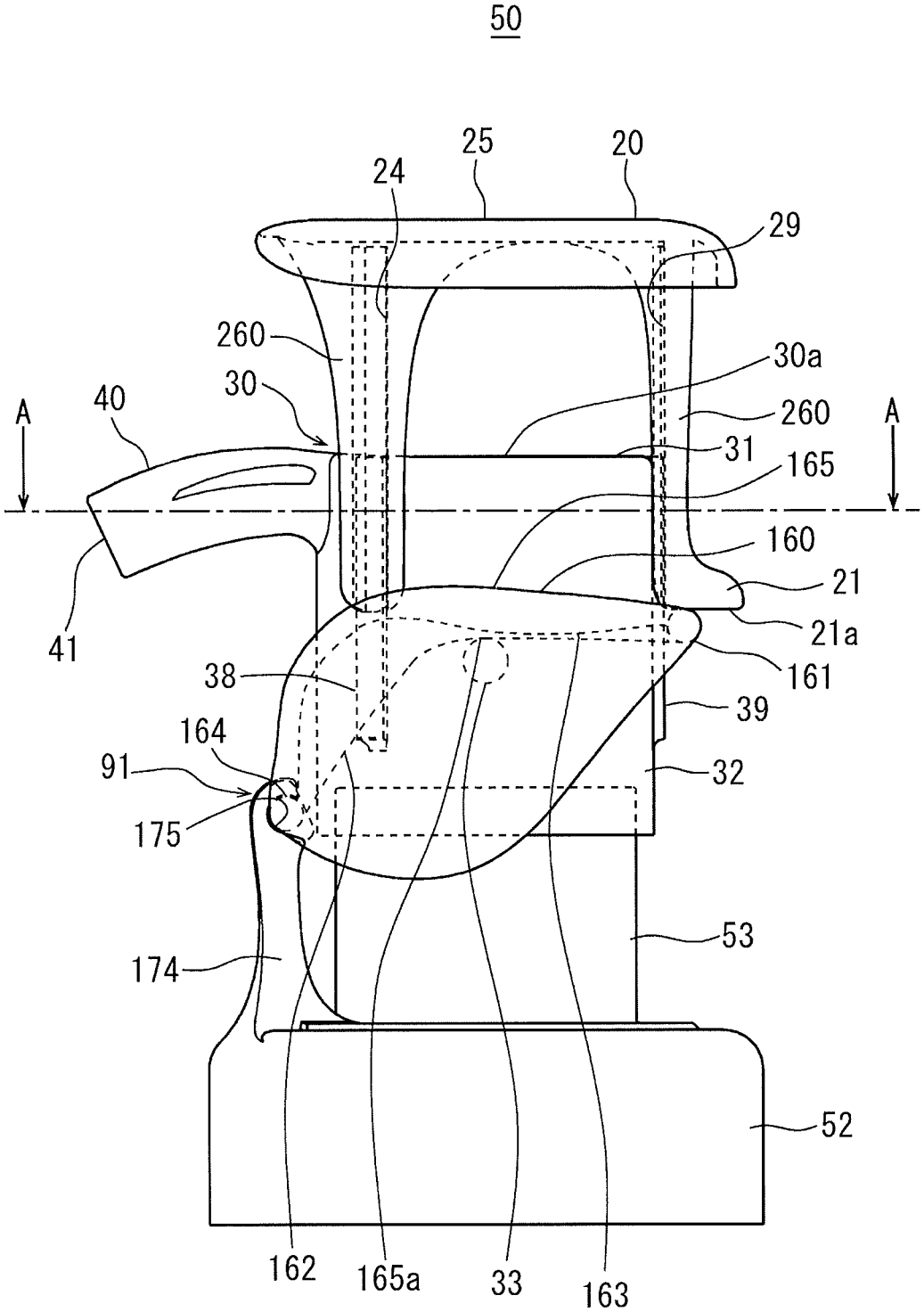
FIG. 34 is a side view illustrating the liquid-agent dispensing cap according to the eighth exemplary embodiment in a state where the operating portion and the head portion are each located at the top dead point.

The states illustrated in FIGS. 32 and 34 each show a state at the normal time where neither the operating portion 20 nor the head portion 30 is pushed down, that is, a state where the operating portion 20 and the head portion 30 are each located at the top dead point. In addition, the state illustrated in FIG. 35 shows a state where the operating portion 20 and the head portion 30 are pushed down to the lower limit position, that is, a state where the operating portion 20 and the head portion 30 are each located at the bottom dead point.

Figure 35:
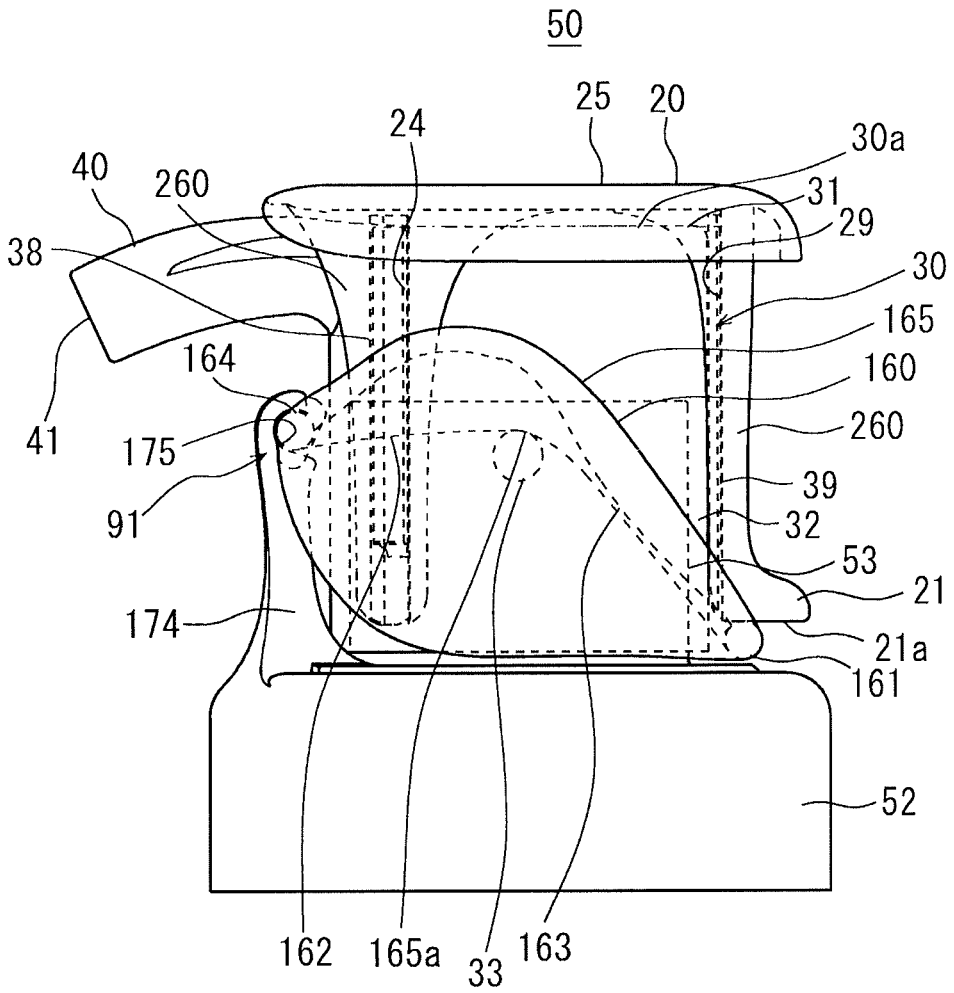
FIG. 35 is a side view illustrating the liquid-agent dispensing cap according to the eighth exemplary embodiment in a state where the operating portion and the head portion are each located at the bottom dead point.

In FIGS. 34 and 35, the left direction is defined as the forward direction; the right direction is defined as the backward direction; the back side direction of the paper surface is defined as the left; and the front side direction of the paper surface is defined as the right.

As illustrated in FIG. 32, in the case of this exemplary embodiment, the supporting portion 174 is formed integrally with the mounting portion 52. That is, the supporting portion 174 is a pillar shaped portion that stands upward from the upper surface of the top surface portion of the mounting portion 52.

The bearing portion 175 is formed at the upper end of the supporting portion 174, and the shaft portion 164 of the swing portion 160 is supported by this bearing portion 175.

In addition, an erected wall 164*a* is formed on the upper surface of each of left and right end portions of the shaft portion 164 of the swing portion 160. These erected walls 164*a* enables the shaft portion 164 to be positioned in the left-right direction with respect to the bearing portion 175.

In the case of this exemplary embodiment, the operating portion 20 includes three pillars 260 that are each suspended downward from the peripheral edge portion of the operation receiving portion 25.

Figure 33:
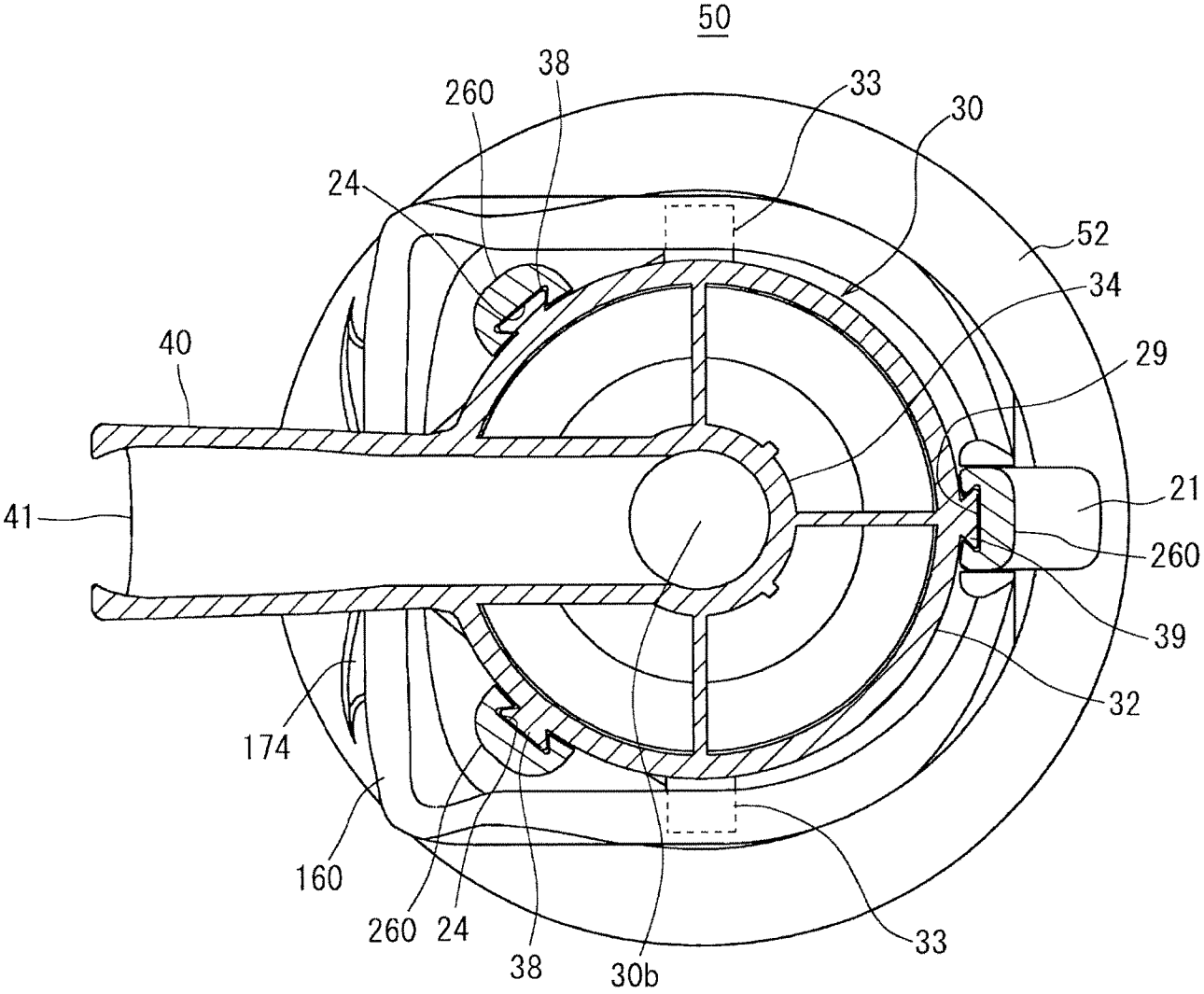
FIG. 33 is a sectional plan view illustrating the upper portion of the liquid-agent dispensing cap according to the eighth exemplary embodiment (sectional view taken along the line A-A in FIG. 34).

As illustrated in FIG. 33, these three pillars 260 are disposed at positions substantially equiangularly spaced apart (at intervals of approximately 120 degrees) with the shaft center 30*b* of the external tubular portion 32 being the center in plan view.

Of these pillars, two pillars 260 are disposed at both ends with the nozzle portion 40 being disposed therebetween in plan view. In addition, the remaining one pillar 260 is disposed along the backward end of the external tubular portion 32.

The two pillars 260 disposed at both ends of the nozzle portion 40 each have the guided portion 24 in a form of groove that has a dovetail-mortise shape and extends in the top-bottom direction.

Similarly, the pillar 260 disposed along the backward end of the external tubular portion 32 has the second guided portion 29 in a form of groove that has a dovetail-mortise shape and extends in the top-bottom direction.

In addition, two guiding portions 38 that guide each of the guided portions 24, and one second guiding portion 39 that guides the second guided portion 29 are formed on the outer peripheral surface of the external tubular portion 32. The guiding portions 38 and the second guiding portion 39 are each comprised of a rib that has a dovetail-tenon shape and extends in the top-bottom direction.

As described above, the head portion 30 has a guiding portion at three or more positions (for example, two guiding portions 38 and one second guiding portion 39) on the outer peripheral surface of the tubular portion (external tubular portion 32).

Thus, the head portion 30 guides the operating portion 20 at three or more positions, and hence, it is possible to more stably guide the operating portion 20 in a well-balanced manner.

More specifically, the liquid-agent dispensing container includes the nozzle portion 40 that projects outward in the radial direction of the tubular portion from the outer peripheral surface of the tubular portion (external tubular portion 32) and has the dispensing outlet 41 provided at the tip end portion thereof. In addition, the head portion 30 includes the two guiding portions 38 disposed such that the nozzle portion 40 is disposed therebetween, and the one guiding portion (second guiding portion 39) that is disposed at a position opposite to the nozzle portion 40 on the tubular portion. This configuration enables the operating portion 20 to be more stably guided by the head portion 30 in a well-balanced manner.

More specifically, in plan view, the two guiding portions 38 are disposed more forward than the shaft center 30*b* of the external tubular portion 32, and the second guiding portion 39 is disposed more backward than the shaft center 30*b*. This configuration enables the operating portion 20 to be more stably guided by the head portion 30 in a well-balanced manner.

As illustrated in FIGS. 34 and 35, in the case of this exemplary embodiment, the pushing-down portion 21 is formed at the bottom end portion of the pillar 260 disposed along the backward end of the external tubular portion 32.

The liquid-agent dispensing container according to this exemplary embodiment is configured to include the liquid-agent dispensing cap 50 according to this exemplary embodiment, and the container body 10 (see FIG. 1) similar to that in the first exemplary embodiment described above, although entire illustration thereof is not given.

In addition, the liquid-agent dispensing container product according to this exemplary embodiment is configured to include the liquid-agent dispensing container according to this exemplary embodiment, and the liquid agent filled in the container body 10, although entire illustration thereof is not given.

The present invention is not limited to the exemplary embodiments described above, and includes various modes of modifications, improvements, and the like, provided that the objects of the present invention are achieved. The matters described in each of the exemplary embodiments may be combined as appropriate.

For example, in the fourth exemplary embodiment described above, description has been made of the attachment for a liquid-agent dispenser having the configuration based on the liquid-agent dispensing cap 50 according to the first exemplary embodiment described above. However, the attachment for a liquid-agent dispenser may have a configuration based on the liquid-agent dispensing cap 50 according to the second, third, fifth, sixth, seventh, or eighth exemplary embodiment. Here, the head cover of the attachment for a liquid-agent dispenser having a configuration based on the liquid-agent dispensing cap 50 according to the second exemplary embodiment includes a guiding portion 38, a projection portion 33, and a second guiding portion 39 similar to those in the liquid-agent dispensing cap 50 according to the second exemplary embodiment, and also includes a second mounting portion 170, a swing portion 160, and an operating portion 20 similar to those in the liquid-agent dispensing cap 50 according to the second exemplary embodiment.

Furthermore, in the third exemplary embodiment, description has been made of an example in which the configuration of the swing portion 60, the operating portion 20, and the like is combined in advance as a part of the configuration of the liquid-agent dispensing cap 50. However, the present invention is not limited to this example, and it may be possible that the configuration of the swing portion 60, the operating portion 20, and the like having the structure described in the third exemplary embodiment is retrofitted, as an attachment (attachment for a liquid dispenser), into and mounted on a liquid-agent dispensing cap having a general structure that does not include the swing portion 60, the operating portion 20, or the like. In this way, by mounting the attachment for a liquid dispenser to the liquid-agent dispensing cap of a general structure in a retrofitted manner, the same effect as in the above third embodiment can be obtained. In this case, the head cover of the attachment for a liquid dispenser is provided with the projection portion 33 and the guiding groove 111, and the second mounting portion is provided with a pair of left and right pillar-shaped supporting portions 54, so that the swing portion 60 is pivotally supported at the pivotally supporting portion 91 by the supporting portion 54.

Furthermore, in the third exemplary embodiment, the operating portion 20 may be provided with the space covering portion and the point-of-force-application covering portion as in the first exemplary embodiment.

Each of the constituent elements of the liquid-agent dispensing container 100 and the liquid-agent dispensing cap 50 does not need to exist separately from each other. Allowable configurations include, for example, a case where plural constituent elements are formed as one member; a case where one constituent element is comprised of plural members; a case where a certain constituent element form part of the other constituent element; and a case where part of a certain constituent element overlaps with part of the other constituent element.

The exemplary embodiments described above include the following technical ideas.

<1> A liquid-agent dispensing container including:

a container body that stores a liquid agent;

a mounting portion that is mounted on the container body;

a head portion that is held by the mounting portion so as to be able to move in a top-bottom direction with respect to the mounting portion, and allows the liquid agent to pass through the head portion with the head portion being pushed down relatively to the mounting portion;

a dispensing outlet that discharges the liquid agent that has passed through the head portion;

a swing portion that is pivotally supported at a pivotally supporting portion in a manner swingable in a direction having a downward component relatively to the mounting portion and a direction opposite to this direction, and has a force application portion that receives a pushing-down force;

an operating portion that is pushed down relatively to the mounting portion, and has a pushing-down portion that pushes down the force application portion when the operating portion is pushed down;

an acting portion that is located between the force application portion and the pivotally supporting portion, and transfers a pushing-down force from the swing portion to the head portion when the swing portion swings in the direction having the downward component with the force application portion being pushed down; and a guide mechanism that guides a relative movement of the operating portion with respect to the head portion while maintaining a posture of the operating portion when the operating portion is pushed down.

<2> The liquid-agent dispensing container according to <1>, in which the guide mechanism guides the operating portion in a top-bottom direction relatively to the head portion.

<3> The liquid-agent dispensing container according to <2>, in which a direction in which the operating portion is pushed down is the same as the direction in which the operating portion is guided by the guide mechanism, the guide mechanism includes a guiding portion that the head portion has, and a guided portion that the operating portion has, the guided portion being guided by the guiding portion, and the guiding portion guides, in the top-bottom direction, at least two portions of the guided portion that are vertically spaced apart from each other.

<4> The liquid-agent dispensing container according to <3>, in which the pushing-down portion and the force application portion are engaged with each other in a state where they can make a relative movement in a direction intersecting an axial direction of the pivotally supporting portion and having a component of a horizontal direction.

<5> The liquid-agent dispensing container according to any one of <1> to <4>, in which the operating portion includes a point-of-force-application covering portion that covers the force application portion from a side direction.

<6> The liquid-agent dispensing container according to <1>, in which the force application portion is pivotally supported by the pushing-down portion in a manner such that the swing portion can swing relatively to the operating portion, and the guide mechanism guides the operating portion in a path having an arc shape.

<7> The liquid-agent dispensing container according to any one of <1> to <6>, in which the operating portion includes:

an operation receiving portion that is located above the head portion and receives a pushing-down operation; and a space covering portion that covers, from a side direction, a space between a lower surface of the operation receiving portion and an upper surface of the head portion.

<8> A liquid-agent dispensing cap, including:

a mounting portion that is mounted on a container body that stores a liquid agent;

a head portion that is held by the mounting portion so as to be able to move in a top-bottom direction with respect to the mounting portion, and allows the liquid agent to pass through the head portion with the head portion being pushed down relatively to the mounting portion;

a dispensing outlet that discharges the liquid agent that has passed through the head portion;

a swing portion that is pivotally supported at a pivotally supporting portion in a manner swingable in a direction having a downward component relatively to the mounting portion and a direction opposite to this direction, and has a force application portion that receives a pushing-down force;

an operating portion that is pushed down relatively to the mounting portion, and has a pushing-down portion that pushes down the force application portion when the operating portion is pushed down;

an acting portion that is located between the force application portion and the pivotally supporting portion, and transfers a pushing-down force from the swing portion to the head portion when the swing portion swings in the direction having the downward component with the force application portion being pushed down; and a guide mechanism that guides a relative movement of the operating portion with respect to the head portion while maintaining a posture of the operating portion when the operating portion is pushed down.

<9> An attachment for a liquid-agent dispenser used by being mounted on a liquid-agent dispensing cap including: a mounting portion that is mounted on a container body that stores a liquid agent; a head portion that is held by the mounting portion so as to be able to move in a top-bottom direction with respect to the mounting portion, and allows the liquid agent to pass through the head portion with the head portion being pushed down relatively to the mounting portion; and a dispensing outlet that discharges the liquid agent that has passed through the head portion, the attachment including:

a second mounting portion that is mounted on the mounting portion;

a swing portion that is pivotally supported at a pivotally supporting portion in a manner swingable in a direction having a downward component relatively to the second mounting portion and a direction opposite to this direction, and has a force application portion that receives a pushing-down force;

an operating portion that is pushed down relatively to the second mounting portion, and has a pushing-down portion that pushes down the force application portion when the operating portion is pushed down;

a head cover portion that is mounted on the head portion in a state where a downward movement thereof relatively to the head portion is restricted;

an acting portion that is located between the force application portion and the pivotally supporting portion, and transfers a pushing-down force from the swing portion to the head cover portion when the swing portion swings in the direction having the downward component with the force application portion being pushed down; and a guide mechanism that guides a relative movement of the operating portion with respect to the head cover portion while maintaining a posture of the operating portion when the operating portion is pushed down.

<10> A liquid-agent dispensing container product, including:

the liquid-agent dispensing container according to any one of <1> to <7>; and the liquid agent filled in the container body.

<11> A liquid-agent dispensing container including:

a container body that stores a liquid agent;

a mounting portion that is mounted on the container body;

a head portion that is held by the mounting portion so as to be able to move in a top-bottom direction with respect to the mounting portion, and allows the liquid agent to pass through the head portion with the head portion being pushed down relatively to the mounting portion;

a dispensing outlet that discharges the liquid agent that has passed through the head portion;

a swing portion that is pivotally supported at a pivotally supporting portion in a manner swingable in a direction having a downward component relatively to the mounting portion and a direction opposite to this direction, and has a force application portion that receives a pushing-down force;

an operating portion that is pushed down relatively to the mounting portion, and has a pushing-down portion that pushes down the force application portion when the operating portion is pushed down;

an acting portion that is located between the force application portion and the pivotally supporting portion, and transfers a pushing-down force from the swing portion to the head portion when the swing portion swings in the direction having the downward component with the force application portion being pushed down; and a guide mechanism that guides the operating portion in a top-bottom direction relatively to the head portion, in which the pushing-down portion and the force application portion are engaged with each other in a state where they can make a relative movement in a direction intersecting an axial direction of the pivotally supporting portion and having a component of a horizontal direction.

<12> A liquid-agent dispensing container including:

a container body that stores a liquid agent;

a mounting portion that is mounted on the container body;

a head portion that is held by the mounting portion so as to be able to move in a top-bottom direction with respect to the mounting portion, and allows the liquid agent to pass through the head portion with the head portion being pushed down relatively to the mounting portion;

a dispensing outlet that discharges the liquid agent that has passed through the head portion;

a swing portion that is pivotally supported at a pivotally supporting portion in a manner swingable in a direction having a downward component relatively to the mounting portion and a direction opposite to this direction, and has a force application portion that receives a pushing-down force;

an operating portion that is pushed down relatively to the mounting portion, and has a pushing-down portion that pushes down the force application portion when the operating portion is pushed down;

an acting portion that is located between the force application portion and the pivotally supporting portion, and transfers a pushing-down force from the swing portion to the head portion when the swing portion swings in the direction having the downward component with the force application portion being pushed down; and a guide mechanism that guides the operating portion in a path having an arc shape, in which the force application portion is pivotally supported by the pushing-down portion in a manner such that the swing portion can swing relatively to the operating portion.

<13> The liquid-agent dispensing container according to any one of the items described above, in which the pushing-down portion has a horizontal lower surface, and the force application portion is pushed down with this lower surface.

<14> The liquid-agent dispensing container according to any one of the items described above, including:

a second mounting portion that is mounted on the mounting portion, in which the swing portion is pivotally supported at the pivotally supporting portion with respect to the second mounting portion.

<15> The liquid-agent dispensing container according to any one of the items described above, further including:

an erected tube that stands upward from the mounting portion, in which the second mounting portion includes:

an inner-peripheral wall portion into which the erected tube is fitted, so that the inner-peripheral wall portion is mounted on the mounting portion, the inner-peripheral wall portion having an arc shape in plan view; and an outer-peripheral wall portion that is disposed coaxially with the inner-peripheral wall portion and has an arc shape in plan view, the head portion includes a tubular portion, and with the head portion being pushed down, a portion of a peripheral wall of the tubular portion is entered into a space between the inner-peripheral wall portion and the outer-peripheral wall portion.

<16> The liquid-agent dispensing container according to any one of the items described above, in which the pivotally supporting portion is disposed on a frontward side of the head portion, the swing portion includes:

a first portion that extends obliquely upward and backward from the pivotally supporting portion in a normal state where the operating portion is not pushed down; and a second portion that extends backward from a backward end of the first portion at a sloped angle less than that of the first portion in the normal state, the acting portion is configured to include:

a forward end portion of the second portion; and a projection portion that projects in a side direction from a side surface of the head portion.

<17> The liquid-agent dispensing container according to any one of the items described above, in which the guide mechanism is configured to include:

a guiding portion that is formed on the head portion; and a guided portion that is formed on the space covering portion and is guided by the guiding portion.

[1] A liquid-agent dispensing container that includes a container body that stores a liquid agent, including:

a mounting portion that is mounted on the container body;

a head portion that is held by the mounting portion movably with respect to the mounting portion in one direction and a direction opposite to the one direction, and allows the liquid agent to pass through the head portion with the head portion being pressed in the one direction relatively to the mounting portion;

a dispensing outlet that discharges the liquid agent that has passed through the head portion;

a swing portion that is pivotally supported at a pivotally supporting portion in a swingable manner relatively to the mounting portion in a direction having a component of the one direction and a direction opposite to this direction, and has a force application portion that receives a pressing force;

an operating portion that is pressed relatively to the mounting portion with an operation made by a user, and has a pressing portion that presses the force application portion when the operating portion is pressed;

an acting portion that is located between the force application portion and the pivotally supporting portion, and transfers a pressing force from the swing portion to the head portion when the swing portion swings in the direction having the component of the one direction with the force application portion being pressed; and a guide mechanism that guides a relative movement of the operating portion with respect to the head portion while maintaining a posture of the operating portion when the operating portion is pressed, in which at least a part of the head portion is covered with the operating portion when the liquid-agent dispensing container is viewed in the one direction.

[2] The liquid-agent dispensing container according to [1], in which the guide mechanism guides the operating portion in the one direction and the direction opposite to the one direction relatively to the head portion.

[3] The liquid-agent dispensing container according to [2], in which a direction in which the operating portion is pushed is the same as the direction in which the operating portion is guided by the guide mechanism, the guide mechanism includes a guiding portion that the head portion has, and a guided portion that the operating portion has, the guided portion being guided by the guiding portion, and the guiding portion guides, in the one direction and in the direction opposite to this one direction, at least two portions of the guided portion that are spaced apart from each other in the one direction.

[4] The liquid-agent dispensing container according to [3], in which the pressing portion and the force application portion are engaged with each other in a state in which relative movement is possible in a direction having a component in a direction intersecting both an axial direction of the pivotally supporting portion and the one direction.

[5] The liquid-agent dispensing container according to any one of [1] to [4], in which the operating portion includes a point-of-force-application covering portion that covers the force application portion when the liquid-agent dispensing container is viewed in an axial direction of the pivotally supporting portion.

[6] The liquid-agent dispensing container according to [1], in which the force application portion is pivotally supported by the pressing portion in a manner such that the swing portion can swing relatively to the operating portion, and the guide mechanism guides the operating portion in a path having an arc shape.

[7] The liquid-agent dispensing container according to any one of [1] to [6], in which the operating portion includes:

an operation receiving portion that is disposed at a position in a direction opposite to the one direction with the head portion being the reference, and receives a pressing operation; and a space covering portion that, when the liquid-agent dispensing container is viewed in an axial direction of the pivotally supporting portion, covers a space between a plane of the operation receiving portion on a side of the head portion and a plane of the head portion on a side of the operation receiving portion.

[8] The liquid-agent dispensing container according to any one of [1] to [7], including:

a second mounting portion that is detachably mounted on the mounting portion, in which the swing portion is pivotally supported at the pivotally supporting portion by the second mounting portion.

[9] The liquid-agent dispensing container according to [8], in which the mounting portion includes a mounting tubular portion that has a shaft center extending in the one direction, the second mounting portion is mounted on the mounting tubular portion so as to be able to move in a circumferential direction of the mounting tubular portion, and the swing portion, the head portion, the dispensing outlet, and the operating portion rotate integrally around an axis of the mounting tubular portion in association with movement of the second mounting portion in the circumferential direction of the mounting tubular portion.

[10] The liquid-agent dispensing container according to [9], in which the one direction is the downward direction, and the second mounting portion is fitted into a groove formed in an outer peripheral surface of the mounting tubular portion, thereby being detachably mounted on the mounting tubular portion.

[11] The liquid-agent dispensing container according to [10], in which the bottom surface of the groove of the mounting tubular portion is sloped downward toward the outside in a radial direction of the mounting tubular portion.

[12] The liquid-agent dispensing container according to any one of [8] to [11], in which the pivotally supporting portion is configured to include:

a rod-shaped shaft portion that is formed on the second mounting portion and extends in an axial direction of the pivotally supporting portion; and a bearing portion that is formed in the swing portion and supports the shaft portion.

[13] The liquid-agent dispensing container according to any one of [1] to [12], in which the head portion includes a tubular portion that has a shaft center extending in the one direction, the swing portion is formed into an annular shape that surrounds the tubular portion when the liquid-agent dispensing container is viewed in the one direction, and the liquid-agent dispensing container includes a pair of acting portions that are spaced apart from each other in an axial direction of the pivotally supporting portion.

[14] The liquid-agent dispensing container according to [13], in which the pivotally supporting portion and the force application portion are disposed on the opposite sides to each other with the tubular portion being disposed therebetween in a direction perpendicular to both of the one direction and the axial direction of the pivotally supporting portion, when the liquid-agent dispensing container is viewed in the axial direction of the pivotally supporting portion, the swing portion includes:

a first portion that extends from the pivotally supporting portion in a direction having a component of the direction opposite to the one direction and on a side of the force application portion; and a second portion that extends toward the force application portion from an end portion of the first portion on the side of the force application portion, the swing portion is bent at a boundary portion between the first portion and the second portion convexly toward the direction opposite to the one direction, and the acting portion is configured to include the boundary portion of the swing portion and a projection portion that projects from an outer peripheral surface of the tubular portion.

[15] A liquid-agent dispensing container including:

a container body that stores a liquid agent;

a mounting portion that is mounted on the container body;

a head portion that is held by the mounting portion so as to be able to move in a top-bottom direction with respect to the mounting portion, and allows the liquid agent to pass through the head portion with the head portion being pushed down relatively to the mounting portion;

a dispensing outlet that discharges the liquid agent that has passed through the head portion;

a swing portion that is pivotally supported at a pivotally supporting portion in a manner swingable in a direction having a downward component relatively to the mounting portion and a direction opposite to this direction, and has a force application portion that receives a pushing-down force;

an operating portion that is pushed down relatively to the mounting portion, and has a pushing-down portion that pushes down the force application portion when the operating portion is pushed down;

an acting portion that is located between the force application portion and the pivotally supporting portion, and transfers a pushing-down force from the swing portion to the head portion when the swing portion swings in the direction having the downward component with the force application portion being pushed down; and a guide mechanism that guides a relative movement of the operating portion with respect to the head portion while maintaining a posture of the operating portion when the operating portion is pushed down, in which the guide mechanism includes a guiding portion that the head portion has, and a guided portion that the operating portion has, the guided portion being guided by the guiding portion.

[16] A liquid-agent dispensing cap including a mounting portion that is mounted on a container body that stores a liquid agent, the liquid-agent dispensing cap including:

a head portion that is held by the mounting portion movably with respect to the mounting portion in one direction and a direction opposite to the one direction, and allows the liquid agent to pass through the head portion with the head portion being pressed in the one direction relatively to the mounting portion;

a dispensing outlet that discharges the liquid agent that has passed through the head portion;

a swing portion that is pivotally supported at a pivotally supporting portion in a swingable manner relatively to the mounting portion in a direction having a component of the one direction and a direction opposite to this direction, and has a force application portion that receives a pressing force;

an operating portion that is pressed relatively to the mounting portion with an operation made by a user, and has a pressing portion that presses the force application portion when the operating portion is pressed;

an acting portion that is located between the force application portion and the pivotally supporting portion, and transfers a pressing force from the swing portion to the head portion when the swing portion swings in the direction having the component of the one direction with the force application portion being pressed; and a guide mechanism that guides a relative movement of the operating portion with respect to the head portion while maintaining a posture of the operating portion when the operating portion is pressed, in which at least a part of the head portion is covered with the operating portion when the liquid-agent dispensing cap is viewed in the one direction.

[17] An attachment for a liquid-agent dispenser used by being mounted on a liquid-agent dispensing cap including: a mounting portion that is mounted on a container body that stores a liquid agent; a head portion that is held by the mounting portion movably with respect to the mounting portion in one direction and a direction opposite to the one direction, and allows the liquid agent to pass through the head portion with the head portion being pressed in the one direction relatively to the mounting portion; and a dispensing outlet that discharges the liquid agent that has passed through the head portion, the attachment for a liquid-agent dispenser including:

a second mounting portion that is mounted on the mounting portion;

a swing portion that is pivotally supported at a pivotally supporting portion in a swingable manner relatively to the second mounting portion in a direction having a component of the one direction and a direction opposite to this direction, and has a force application portion that receives a pressing force;

an operating portion that is pressed relatively to the second mounting portion with an operation made by a user, and has a pressing portion that presses the force application portion when the operating portion is pressed;

a head cover portion that is mounted on the head portion in a state where a movement thereof to the one direction relatively to the head portion is restricted;

an acting portion that is located between the force application portion and the pivotally supporting portion, and transfers a pressing force from the swing portion to the head cover portion when the swing portion swings in the direction having the component of the one direction with the force application portion being pressed;

a guide mechanism that guides a relative movement of the operating portion with respect to the head cover portion while maintaining a posture of the operating portion when the operating portion is pressed, in which at least a part of the head portion is covered with the operating portion when the attachment for a liquid-agent dispenser is viewed in the one direction.

[18] A liquid-agent dispensing container product, including:

the liquid-agent dispensing container according to any one of [1] to [15]; and the liquid agent filled in the container body.

[19] A liquid-agent dispensing container that includes a container body that stores a liquid agent, including:

a mounting portion that is mounted on the container body;

a head portion that is held by the mounting portion movably with respect to the mounting portion in one direction and a direction opposite to the one direction, and allows the liquid agent to pass through the head portion with the head portion being pressed in the one direction relatively to the mounting portion;

a dispensing outlet that discharges the liquid agent that has passed through the head portion;

a swing portion that is pivotally supported at a pivotally supporting portion in a swingable manner relatively to the mounting portion in a direction having a component of the one direction and a direction opposite to this direction, and has a force application portion that receives a pressing force;

an operating portion that is pressed relatively to the mounting portion with an operation made by a user, and has a pressing portion that presses the force application portion when the operating portion is pressed;

an acting portion that is located between the force application portion and the pivotally supporting portion, and transfers a pressing force from the swing portion to the head portion when the swing portion swings in the direction having the component of the one direction with the force application portion being pressed; and a guide mechanism that guides a relative movement of the operating portion with respect to the head portion while maintaining a posture of the operating portion when the operating portion is pressed, and a second mounting portion that is mounted detachably on the mounting portion, in which the swing portion is pivotally supported at the pivotally supporting portion by the second mounting portion.

[20] A liquid-agent dispensing container that includes a container body that stores a liquid agent, including:

a mounting portion that is mounted on the container body;

a head portion that is held by the mounting portion movably with respect to the mounting portion in one direction and a direction opposite to the one direction, and allows the liquid agent to pass through the head portion with the head portion being pressed in the one direction relatively to the mounting portion;

a dispensing outlet that discharges the liquid agent that has passed through the head portion;

a swing portion that is pivotally supported at a pivotally supporting portion in a swingable manner relatively to the mounting portion in a direction having a component of the one direction and a direction opposite to this direction, and has a force application portion that receives a pressing force;

an operating portion that is pressed relatively to the mounting portion with an operation made by a user, and has a pressing portion that presses the force application portion when the operating portion is pressed;

an acting portion that is located between the force application portion and the pivotally supporting portion, and transfers a pressing force from the swing portion to the head portion when the swing portion swings in the direction having the component of the one direction with the force application portion being pressed; and a guide mechanism that guides a relative movement of the operating portion with respect to the head portion while maintaining a posture of the operating portion when the operating portion is pressed, in which the head portion includes a tubular portion that has a shaft center extending in the one direction, the swing portion is formed into an annular shape that surrounds the tubular portion when the liquid-agent dispensing container is viewed in the one direction, and the liquid-agent dispensing container includes a pair of acting portions that are spaced apart from each other in an axial direction of the pivotally supporting portion.

[21] The liquid-agent dispensing container according to any one of the items described above, in which, when the liquid-agent dispensing container is viewed in the one direction, at least a part of the acting portion is covered with the operating portion.

[22] The liquid-agent dispensing container according to any one of the items described above, in which, when the liquid-agent dispensing container is viewed in the one direction, at least a part of the force application portion is covered with the operating portion.

[23] The liquid-agent dispensing container according to any one of the items described above, in which, when the liquid-agent dispensing container is viewed in the one direction, the force application portion is partially located outside of a contour line of the operating portion.

[24] The liquid-agent dispensing container according to any one of the items described above, in which the operating portion includes an operation receiving portion that is formed into a plate-like shape perpendicular to the one direction and receives a pressing operation, and at least a part of the head portion is covered with the operation receiving portion when the liquid-agent dispensing container is viewed in the one direction.

[25] The liquid-agent dispensing container according to any one of the items described above, in which the head portion includes a tubular portion having a shaft center extending in the one direction, and the operating portion is disposed on the extension of the shaft center of the tubular portion.

[26] The liquid-agent dispensing container according to any one of the items described above, in which the entire tubular portion is covered with the operating portion when the liquid-agent dispensing container is viewed in the one direction.

[27] The liquid-agent dispensing container according to any one of the items described above, in which at least a part of the guide mechanism is covered with the operating portion when the liquid-agent dispensing container is viewed in the one direction.

[28] The liquid-agent dispensing container according to any one of the items described above, in which the entire guide mechanism is covered with the operating portion when the liquid-agent dispensing container is viewed in the one direction.

[29] The liquid-agent dispensing container according to any one of the items described above, in which the guiding portion includes a guiding rib or a guiding groove that extends in the one direction, and the guided portion includes a guided groove or a guided rib that extends in the one direction and is guided by the guiding rib or the guiding groove.

[30] The liquid-agent dispensing container according to any one of the items described above, in which the head portion includes a tubular portion having a shaft center extending in the one direction, and includes the guiding portion at a plurality of portions on the outer peripheral surface of the tubular portion.

[31] The liquid-agent dispensing container according to any one of the items described above, in which the head portion includes a pair of guiding portions that are each disposed on each of both end portions of the tubular portion in the axial direction of the pivotally supporting portion with the shaft center of the tubular portion being the reference.

[32] The liquid-agent dispensing container according to any one of the items described above, in which the swing portion includes a cover portion that covers the acting portion when the liquid-agent dispensing container is viewed in the axial direction of the pivotally supporting portion.

[33] The liquid-agent dispensing container according to any one of the items described above, in which the head portion includes a tubular portion having a shaft center extending in the one direction, and the cover portion covers an end edge of the tubular portion on a side of the one direction when the liquid-agent dispensing container is viewed in the axial direction of the pivotally supporting portion.

[34] The liquid-agent dispensing container according to any one of the items described above, in which the cover portion covers an end edge of the tubular portion on the side of the one direction when the liquid-agent dispensing container is viewed in the axial direction of the pivotally supporting portion, regardless of the amount of the head portion being pressed with respect to the mounting portion.

[35] The liquid-agent dispensing container according to any one of the items described above, in which the operating portion includes:

an operation receiving portion that is formed into a plate-like shape perpendicular to the one direction and receives a pressing operation; and a skirt portion that extends in the one direction from each of both end portions in the axial direction of the pivotally supporting portion of the operation receiving portion.

[36] The liquid-agent dispensing container according to any one of the items described above, in which, when the operating portion is pressed, the skirt portion covers an end portion of the head portion on a side of the direction opposite to the one direction when the liquid-agent dispensing container is viewed in the axial direction of the pivotally supporting portion.

[37] The liquid-agent dispensing container according to any one of the items described above, in which, when the liquid-agent dispensing container is viewed in the one direction, the pivotally supporting portion and the force application portion are disposed on the opposite sides to each other with the tubular portion being disposed therebetween in a direction perpendicular to both of the one direction and the axial direction of the pivotally supporting portion, when the liquid-agent dispensing container is viewed in the axial direction of the pivotally supporting portion, the swing portion includes:

a first portion that extends from the pivotally supporting portion toward the force application portion; and a second portion that extends from an end portion of the first portion on the side of the force application portion in a direction having a component of the direction opposite to the one direction and toward the force application portion, the swing portion is bent at a boundary portion between the first portion and the second portion convexly toward the one direction, and the acting portion is configured to include the boundary portion of the swing portion and a projection portion that projects from an outer peripheral surface of the tubular portion.

[38] The liquid-agent dispensing container according to any one of the items described above, including:

a holding mechanism that restricts movement of the head portion and the operating portion in the direction opposite to the one direction relatively to the mounting portion to hold the head portion and the operating portion in a pressed state.

[39] The liquid-agent dispensing container according to any one of the items described above, in which the second mounting portion and the swing portion are formed integrally with each other, and the pivotally supporting portion is made out of a thin-thickness hinge formed at a boundary between the second mounting portion and the swing portion.

[40] The liquid-agent dispensing container according to any one of the items described above, in which the head portion includes the guiding portion at each of three or more portions on the outer peripheral surface of the tubular portion.

[41] The liquid-agent dispensing container according to any one of the items described above, including a nozzle portion that projects outward in a radial direction of the tubular portion from an outer peripheral surface of the tubular portion and has the dispensing outlet at a tip end portion thereof, in which the head portion includes:

two of the guiding portions disposed such that the nozzle portion is disposed therebetween, and one of the guiding portions that is disposed at a position opposite to the nozzle portion with in the tubular portion.

[42] The liquid-agent dispensing container according to any one of the items described above, in which the acting portion is configured to include a boundary portion between the first portion and the second portion of the swing portion, and a projection portion that projects from an outer peripheral surface of the tubular portion of the head portion.

[43] A liquid-agent dispensing container that includes a container body that stores a liquid agent, including:

a mounting portion that is mounted on the container body;

a head portion that is held by the mounting portion movably with respect to the mounting portion in one direction and a direction opposite to the one direction, and allows the liquid agent to pass through the head portion with the head portion being pressed in the one direction relatively to the mounting portion;

a dispensing outlet that discharges the liquid agent that has passed through the head portion;

a swing portion that is pivotally supported at a pivotally supporting portion in a swingable manner relatively to the mounting portion in a direction having a component of the one direction and a direction opposite to this direction, and has a force application portion that receives a pressing force;

an operating portion that is pressed relatively to the mounting portion with an operation made by a user, and has a pressing portion that presses the force application portion when the operating portion is pressed;

an acting portion that is located between the force application portion and the pivotally supporting portion, and transfers a pressing force from the swing portion to the head portion when the swing portion swings in the direction having the component of the one direction with the force application portion being pressed; and a guide mechanism that guides the operating portion in the one direction and the direction opposite to the one direction relatively to the head portion, in which the pressing portion and the force application portion are engaged with each other in a state in which relative movement is possible in a direction having a component in a direction intersecting both an axial direction of the pivotally supporting portion and the one direction.

[44] A liquid-agent dispensing container that includes a container body that stores a liquid agent, including:

a mounting portion that is mounted on the container body;

a head portion that is held by the mounting portion movably with respect to the mounting portion in one direction and a direction opposite to the one direction, and allows the liquid agent to pass through the head portion with the head portion being pressed in the one direction relatively to the mounting portion;

a dispensing outlet that discharges the liquid agent that has passed through the head portion;

a swing portion that is pivotally supported at a pivotally supporting portion in a swingable manner relatively to the mounting portion in a direction having a component of the one direction and a direction opposite to this direction, and has a force application portion that receives a pressing force;

an operating portion that is pressed relatively to the mounting portion with an operation made by a user, and has a pressing portion that presses the force application portion when the operating portion is pressed;

an acting portion that is located between the force application portion and the pivotally supporting portion, and transfers a pressing force from the swing portion to the head portion when the swing portion swings in the direction having the component of the one direction with the force application portion being pressed; and a guide mechanism that guides the operating portion in a path having an arc shape, in which the force application portion is pivotally supported by the pressing portion in a manner such that the swing portion can swing relatively to the operating portion.

[45] The liquid-agent dispensing container according to any one of the items described above, in which the pressing portion has a plane that is perpendicular to the one direction and faces the one direction, and presses the force application portion with this plane.

[46] The liquid-agent dispensing container according to any one of the items described above, including:

a second mounting portion that is mounted on the mounting portion, in which the swing portion is pivotally supported at the pivotally supporting portion by the second mounting portion.

[47] The liquid-agent dispensing container according to any one of the items described above, further including:

an erected tube that stands from the mounting portion in a direction opposite to the one direction, in which the second mounting portion includes:

an inner-peripheral wall portion into which the erected tube is fitted, so that the inner-peripheral wall portion is mounted on the mounting portion; and an outer-peripheral wall portion that is disposed coaxially with the inner-peripheral wall portion, the inner-peripheral wall portion and the outer-peripheral wall portion are each formed into an arc shape when viewed in the one direction, the head portion includes a tubular portion, and with the head portion being pressed, a part of a peripheral wall of the tubular portion is entered into a space between the inner-peripheral wall portion and the outer-peripheral wall portion.

[48] A liquid-agent dispensing container that includes a container body that stores a liquid agent, including:

a mounting portion that is mounted on the container body;

a head portion that is held by the mounting portion movably with respect to the mounting portion in one direction and a direction opposite to the one direction, and allows the liquid agent to pass through the head portion with the head portion being pressed in the one direction relatively to the mounting portion;

a dispensing outlet that discharges the liquid agent that has passed through the head portion;

a swing portion that is pivotally supported at a pivotally supporting portion in a swingable manner relatively to the mounting portion in a direction having a component of the one direction and a direction opposite to this direction, and has a force application portion that receives a pressing force;

an operating portion that is pressed relatively to the mounting portion with an operation made by a user, and has a pressing portion that presses the force application portion when the operating portion is pressed;

an acting portion that is located between the force application portion and the pivotally supporting portion, and transfers a pressing force from the swing portion to the head portion when the swing portion swings in the direction having the component of the one direction with the force application portion being pressed; and a guide mechanism that guides a relative movement of the operating portion with respect to the head portion while maintaining a posture of the operating portion when the operating portion is pressed, in which at least a part of the head portion is located inside of a contour line of the operating portion when the liquid-agent dispensing container is viewed in the one direction.

[49] A liquid-agent dispensing container that includes a container body that stores a liquid agent, including:

a mounting portion that is mounted on the container body;

a head portion that is held by the mounting portion movably with respect to the mounting portion in one direction and a direction opposite to the one direction, and allows the liquid agent to pass through the head portion with the head portion being pressed in the one direction relatively to the mounting portion;

a dispensing outlet that discharges the liquid agent that has passed through the head portion;

a swing portion that is pivotally supported at a pivotally supporting portion in a swingable manner relatively to the mounting portion in a direction having a component of the one direction and a direction opposite to this direction, and has a force application portion that receives a pressing force;

an operating portion that is pressed relatively to the mounting portion with an operation made by a user, and has a pressing portion that presses the force application portion when the operating portion is pressed;

an acting portion that is located between the force application portion and the pivotally supporting portion, and transfers a pressing force from the swing portion to the head portion when the swing portion swings in the direction having the component of the one direction with the force application portion being pressed; and a guide mechanism that guides a relative movement of the operating portion with respect to the head portion while maintaining a posture of the operating portion when the operating portion is pressed, in which the operating portion is disposed so as to be spaced apart from the head portion in a direction opposite to the one direction.

[50] The liquid-agent dispensing container according to any one of the items described above, in which the center of gravity of the operating portion overlaps with the head portion when the liquid-agent dispensing container is viewed in the one direction.

EXPLANATION OF REFERENCE CHARACTERS

10 container body
11 body portion
12 shoulder portion
13 neck portion
14 bottom portion
20 operating portion
21 pushing-down portion
21*a* lower surface
24 guided portion
24*a* guided groove
24*b* guided rib
25 operation receiving portion
26 cover portion (space covering portion)
26*a* bottom end portion (point-of-force-application covering portion)
26*b* lower portion
27 forward-movement restricting portion
28 skirt portion
29 second guided portion
30 head portion
30*a* upper surface
30*b* shaft center
31 head main body portion
32 external tubular portion (tubular portion)
32*a* internal thread portion
33 projection portion (acting portion)
33*a* erected wall
34 internal tubular portion
35 connecting portion
38 guiding portion
38*a* first guiding rib
38*b* second guiding rib
38*c* guiding groove
38*d* supporting portion
38*e* guiding pillar
39 second guiding portion
40 nozzle portion
41 dispensing outlet
50 liquid-agent dispensing cap
50*a* elevation portion
51 foam generating portion
52 mounting portion
52*a* encircled groove portion
52*b* encircled eaves portion
52*c* encircled sloped bottom surface
52*d* encircled locking claw portion
53 erected tube
53*a* circular rib
53*b* external thread portion
54 supporting portion
55 piston portion
56 housing
57 suction pipe
58 spring body
59 valve body
60 swing portion
61 first portion
62 second portion
63 acting surface (acting portion)
70 supporting pillar portion
71 first portion
72 second portion
73 guided projection (guided portion)
76 pivotally supporting pin

91 pivotally supporting portion
92 second pivotally supporting portion
95 fixing portion
100 liquid-agent dispensing container
110 guide formation portion
111 guiding groove (guiding portion)
150 liquid agent
155 connecting tube portion
160 swing portion
161 force application portion
161*a* pivotally supporting hole
161*b* erected wall
162 first portion
163 second portion
164 shaft portion
164*a* erected wall
165 boundary portion
165*a* acting surface (acting portion)
166 cover portion
167 bearing portion
167*a* opening
170 second mounting portion
171 inner-peripheral wall portion
172 outer-peripheral wall portion
173 connecting portion
174 supporting portion
175 bearing portion
176 connecting portion
176*a* bottom portion
176*b* recessed portion
176*c* locking portion
177 shaft portion
178 annular C-shaped mounting portion
178*a* groove
180 head cover portion
181 top surface portion
182 outer peripheral surface portion
183 slit
190 swing portion unit
200 liquid-agent dispensing container product
221 tube portion
260 pillar

The invention claimed is:

1. A liquid-agent dispensing container that includes a container body that stores a liquid agent, comprising:

a mounting portion that is mounted on the container body;

a head portion that is held by the mounting portion movably with respect to the mounting portion in one direction and a direction opposite to the one direction, and allows the liquid agent to pass through the head portion with the head portion being pressed in the one direction relatively to the mounting portion;

a dispensing outlet that discharges the liquid agent that has passed through the head portion;

a swing portion that is pivotally supported at a pivotally supporting portion in a swingable manner relatively to the mounting portion in a direction having a component of the one direction and a direction opposite to this direction, and has a force application portion that receives a pressing force;

an operating portion that is pressed relatively to the mounting portion with an operation made by a user, and has a pressing portion that presses the force application portion when the operating portion is pressed;

an acting portion that is located between the force application portion and the pivotally supporting portion, and transfers a pressing force from the swing portion to the head portion when the swing portion swings in the direction having the component of the one direction with the force application portion being pressed; and a guide mechanism that guides a relative movement of the operating portion with respect to the head portion while maintaining a posture of the operating portion when the operating portion is pressed, wherein at least a part of the head portion is covered with the operating portion when the liquid-agent dispensing container is viewed in the one direction.

2. The liquid-agent dispensing container according to claim 1, wherein the guide mechanism guides the operating portion in the one direction and the direction opposite to the one direction relatively to the head portion.

3. The liquid-agent dispensing container according to claim 2, wherein a direction in which the operating portion is pushed is the same as the direction in which the operating portion is guided by the guide mechanism, the guide mechanism includes a guiding portion that the head portion has, and a guided portion that the operating portion has, the guided portion being guided by the guiding portion, and the guiding portion guides, in the one direction and in the direction opposite to this one direction, at least two portions of the guided portion that are spaced apart from each other in the one direction.

4. The liquid-agent dispensing container according to claim 3, wherein the pressing portion and the force application portion are engaged with each other in a state in which relative movement is possible in a direction having a component in a direction intersecting both an axial direction of the pivotally supporting portion and the one direction.

5. The liquid-agent dispensing container according to claim 1, wherein the operating portion includes a point-of-force-application covering portion that covers the force application portion when the liquid-agent dispensing container is viewed in an axial direction of the pivotally supporting portion.

6. The liquid-agent dispensing container according to claim 1, wherein the force application portion is pivotally supported by the pressing portion in a manner such that the swing portion can swing relatively to the operating portion, and the guide mechanism guides the operating portion in a path having an arc shape.

7. The liquid-agent dispensing container according to claim 1, wherein the operating portion includes:

an operation receiving portion that is disposed at a position in a direction opposite to the one direction with the head portion being the reference, and receives a pressing operation; and a space covering portion that, when the liquid-agent dispensing container is viewed in an axial direction of the pivotally supporting portion, covers a space between a plane of the operation receiving portion on a side of the head portion and a plane of the head portion on a side of the operation receiving portion.

8. The liquid-agent dispensing container according to claim 1, comprising:

a second mounting portion that is detachably mounted on the mounting portion, wherein the swing portion is pivotally supported at the pivotally supporting portion by the second mounting portion.

9. The liquid-agent dispensing container according to claim 8, wherein the mounting portion includes a mounting tubular portion that has a shaft center extending in the one direction, the second mounting portion is mounted on the mounting tubular portion so as to be able to move in a circumferential direction of the mounting tubular portion, and the swing portion, the head portion, the dispensing outlet, and the operating portion rotate integrally around an axis of the mounting tubular portion in association with movement of the second mounting portion in the circumferential direction of the mounting tubular portion.

10. The liquid-agent dispensing container according to claim 9, wherein the one direction is the downward direction, and the second mounting portion is fitted into a groove formed in an outer peripheral surface of the mounting tubular portion, thereby being detachably mounted on the mounting tubular portion.

11. The liquid-agent dispensing container according to claim 10, wherein the bottom surface of the groove of the mounting tubular portion is sloped downward toward the outside in a radial direction of the mounting tubular portion.

12. The liquid-agent dispensing container according to claim 8, wherein the pivotally supporting portion is configured to include:

a rod-shaped shaft portion that is formed on the second mounting portion and extends in an axial direction of the pivotally supporting portion; and a bearing portion that is formed in the swing portion and supports the shaft portion.

13. The liquid-agent dispensing container according to claim 1, wherein the head portion includes a tubular portion that has a shaft center extending in the one direction, the swing portion is formed into an annular shape that surrounds the tubular portion when the liquid-agent dispensing container is viewed in the one direction, and the liquid-agent dispensing container includes a pair of acting portions that are spaced apart from each other in an axial direction of the pivotally supporting portion.

14. The liquid-agent dispensing container according to claim 13, wherein the pivotally supporting portion and the force application portion are disposed on the opposite sides to each other with the tubular portion being disposed therebetween in a direction perpendicular to both of the one direction and the axial direction of the pivotally supporting portion, when the liquid-agent dispensing container is viewed in the axial direction of the pivotally supporting portion, the swing portion includes:

a first portion that extends from the pivotally supporting portion in a direction having a component of the direction opposite to the one direction and on a side of the force application portion; and a second portion that extends toward the force application portion from an end portion of the first portion on the side of the force application portion, the swing portion is bent at a boundary portion between the first portion and the second portion convexly toward the direction opposite to the one direction, and the acting portion is configured to include the boundary portion of the swing portion and a projection portion that projects from an outer peripheral surface of the tubular portion.

15. A liquid-agent dispensing container, comprising:

a container body that stores a liquid agent;

a mounting portion that is mounted on the container body;

a head portion that is held by the mounting portion so as to be able to move in a top-bottom direction with respect to the mounting portion, and allows the liquid agent to pass through the head portion with the head portion being pushed down relatively to the mounting portion;

a dispensing outlet that discharges the liquid agent that has passed through the head portion;

a swing portion that is pivotally supported at a pivotally supporting portion in a manner swingable in a direction having a downward component relatively to the mounting portion and a direction opposite to this direction, and has a force application portion that receives a pushing-down force;

an operating portion that is pushed down relatively to the mounting portion, and has a pushing-down portion that pushes down the force application portion when the operating portion is pushed down;

an acting portion that is located between the force application portion and the pivotally supporting portion, and transfers a pushing-down force from the swing portion to the head portion when the swing portion swings in the direction having the downward component with the force application portion being pushed down; and a guide mechanism that guides a relative movement of the operating portion with respect to the head portion while maintaining a posture of the operating portion when the operating portion is pushed down, wherein the guide mechanism includes a guiding portion that the head portion has, and a guided portion that the operating portion has, the guided portion being guided by the guiding portion.

16. A liquid-agent dispensing cap including a mounting portion that is mounted on a container body that stores a liquid agent, the liquid-agent dispensing cap comprising:

a head portion that is held by the mounting portion movably with respect to the mounting portion in one direction and a direction opposite to the one direction, and allows the liquid agent to pass through the head portion with the head portion being pressed in the one direction relatively to the mounting portion;

a dispensing outlet that discharges the liquid agent that has passed through the head portion;

a swing portion that is pivotally supported at a pivotally supporting portion in a swingable manner relatively to the mounting portion in a direction having a component of the one direction and a direction opposite to this direction, and has a force application portion that receives a pressing force;

an operating portion that is pressed relatively to the mounting portion with an operation made by a user, and has a pressing portion that presses the force application portion when the operating portion is pressed;

an acting portion that is located between the force application portion and the pivotally supporting portion, and transfers a pressing force from the swing portion to the head portion when the swing portion swings in the direction having the component of the one direction with the force application portion being pressed; and a guide mechanism that guides a relative movement of the operating portion with respect to the head portion while maintaining a posture of the operating portion when the operating portion is pressed, wherein at least a part of the head portion is covered with the operating portion when the liquid-agent dispensing cap is viewed in the one direction.

17. An attachment for a liquid-agent dispenser used by being mounted on a liquid-agent dispensing cap including: a mounting portion that is mounted on a container body that stores a liquid agent; a head portion that is held by the mounting portion movably with respect to the mounting portion in one direction and a direction opposite to the one direction, and allows the liquid agent to pass through the head portion with the head portion being pressed in the one direction relatively to the mounting portion; and a dispensing outlet that discharges the liquid agent that has passed through the head portion, the attachment for a liquid-agent dispenser comprising:

a second mounting portion that is mounted on the mounting portion;

a swing portion that is pivotally supported at a pivotally supporting portion in a swingable manner relatively to the second mounting portion in a direction having a component of the one direction and a direction opposite to this direction, and has a force application portion that receives a pressing force;

an operating portion that is pressed relatively to the second mounting portion with an operation made by a user, and has a pressing portion that presses the force application portion when the operating portion is pressed;

a head cover portion that is mounted on the head portion in a state where a movement thereof to the one direction relatively to the head portion is restricted;

an acting portion that is located between the force application portion and the pivotally supporting portion, and transfers a pressing force from the swing portion to the head cover portion when the swing portion swings in the direction having the component of the one direction with the force application portion being pressed;

a guide mechanism that guides a relative movement of the operating portion with respect to the head cover portion while maintaining a posture of the operating portion when the operating portion is pressed, wherein at least a part of the head portion is covered with the operating portion when the attachment for a liquid-agent dispenser is viewed in the one direction.

18. A liquid-agent dispensing container product, comprising:

the liquid-agent dispensing container according to claim 1; and the liquid agent filled in the container body.

19. The liquid-agent dispensing container according to claim 1, further comprising:

a nozzle portion having the dispensing outlet, wherein the nozzle portion is provided integrally with the operating portion.

20. The liquid-agent dispensing container according to claim 1, wherein the operating portion includes an operation receiving portion which receives a pressing operation and a tube portion which protrudes in the one direction from the operation receiving portion, the head portion includes an external tubular portion and an internal tubular portion, the guide mechanism includes:

the external tubular portion and the internal tubular portion of the head portion, and the tube portion of the operating portion, wherein an outer peripheral surface and an inner peripheral surface of the tube portion are guided by an inner peripheral surface of the external tubular portion and an outer peripheral surface of the internal tubular portion.

* * * * *